US006473107B2

(12) United States Patent
Koga et al.

(10) Patent No.: US 6,473,107 B2
(45) Date of Patent: Oct. 29, 2002

(54) IMAGE FORMING APPARATUS

(75) Inventors: Yoshiro Koga, Nagano-Ken (JP); Shinichi Kamoshida, Nagano-Ken (JP); Kaneo Yoda, Nagano-Ken (JP); Nobumasa Abe, Nagano-Ken (JP); Yujiro Nomura, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/968,505

(22) Filed: Oct. 2, 2001

(65) Prior Publication Data

US 2002/0047887 A1 Apr. 25, 2002

(30) Foreign Application Priority Data

| | | |
|---|---|---|
| Oct. 2, 2000 | (JP) | 2000-302491 |
| Oct. 2, 2000 | (JP) | 2000-302492 |
| Oct. 2, 2000 | (JP) | 2000-302493 |
| Nov. 1, 2000 | (JP) | 2000-334630 |
| Nov. 9, 2000 | (JP) | 2000-314328 |
| Nov. 9, 2000 | (JP) | 2000-341329 |

(51) Int. Cl.[7] ..... B41J 2/41

(52) U.S. Cl. ..... 347/141; 347/153; 347/155; 347/158

(58) Field of Search ..... 347/141–150, 347/115, 117, 153, 154, 155, 158

(56) References Cited

U.S. PATENT DOCUMENTS

| | | | | |
|---|---|---|---|---|
| 3,792,494 A | * | 2/1974 | Matkan et al. | 347/153 |
| 4,233,611 A | * | 11/1980 | Nakano et al. | 347/147 |
| 4,468,681 A | * | 8/1984 | Wako et al. | 347/141 |

FOREIGN PATENT DOCUMENTS

| | | | | |
|---|---|---|---|---|
| JP | 63-45102 B2 | | 9/1988 | G03G/13/09 |
| JP | 63-45104 B2 | | 9/1988 | G03G/15/00 |
| JP | 5-313445 | * | 11/1993 | |
| JP | 6-166206 A | | 6/1994 | B41J/2/415 |

* cited by examiner

*Primary Examiner*—Joan Pendegrass
(74) *Attorney, Agent, or Firm*—Sughrue Mion, PLLC

(57) ABSTRACT

In an image forming apparatus comprising a latent image carrier and a writing means having a plurality of writing electrodes which are aligned in the axial direction of the latent image carrier and arranged in contact with or proximity to the latent image carrier to form an electrostatic latent image on the latent image carrier, the contact width of the writing means relative to the latent image carrier is set to be smaller than the contact width of any cleaning means, the width of a toner carrying portion of a developing means confronting the latent image carrier, the width of a transferring means, and the width of a charge removing portion of a charge removing means. In addition, the width of the writing means is set to be smaller than the width of the latent image carrier.

10 Claims, 32 Drawing Sheets

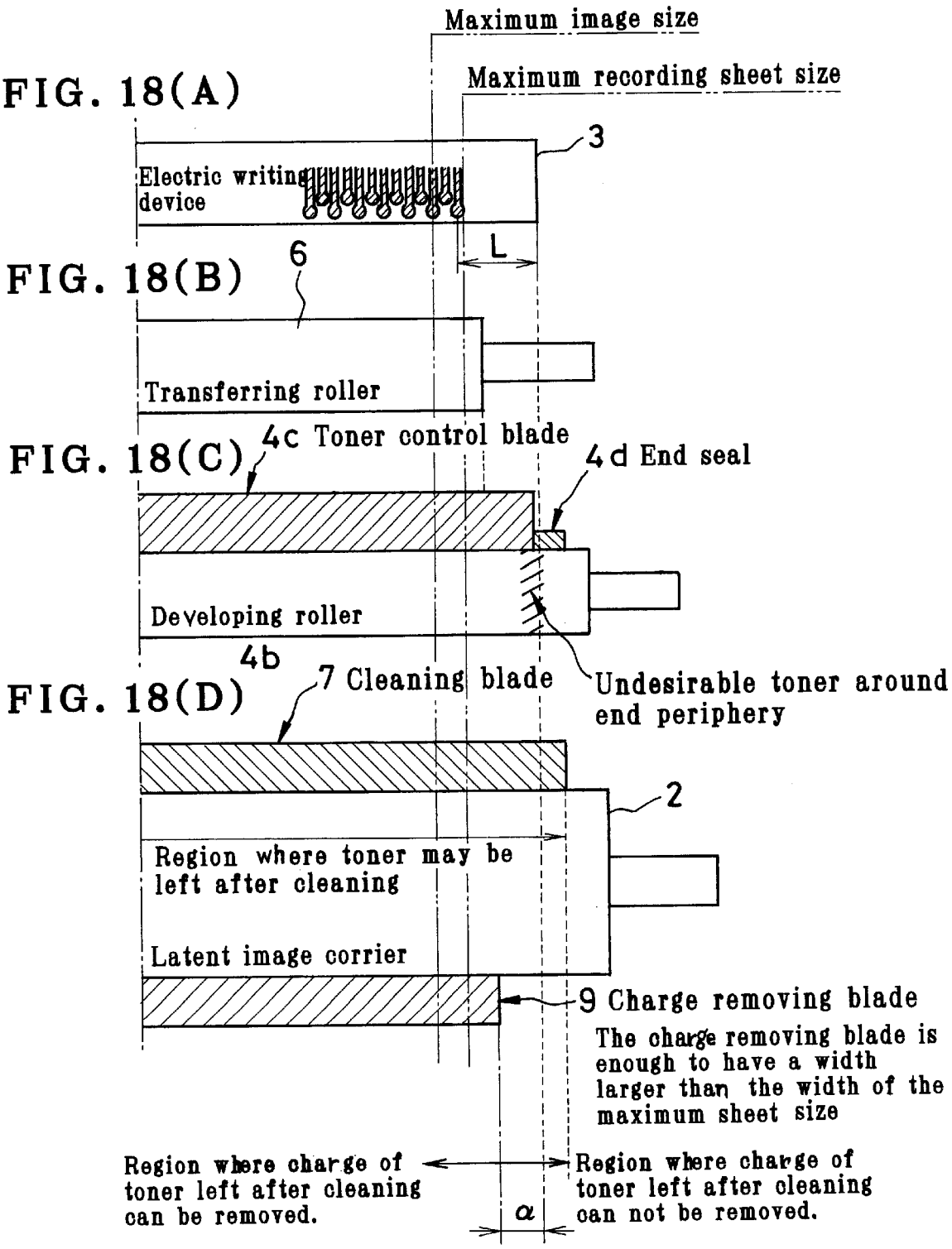
Maximum image size
Maximum recording sheet size
FIG. 18(A)
3
Electric writing device
L
FIG. 18(B)
6
Transferring roller
FIG. 18(C)
4c Toner control blade
4d End seal
Developing roller
Undesirable toner around end periphery
FIG. 18(D)
4b
7 Cleaning blade
2
Region where toner may be left after cleaning
Latent image corrier
9 Charge removing blade
The charge removing blade is enough to have a width larger than the width of the maximum sheet size
Region where charge of toner left after cleaning can be removed.
Region where charge of toner left after cleaning can not be removed.
α

Maximum image size

Maximum recording sheet size
3
Electric writing device
L

6
Transferring roller

4c Toner control blade
4d End seal
Developing roller
Undesirable toner around end periphery 4b
7 Cleaning blade
2
Region where toner may be left after cleaning
Latent image corrier
9 Charge removing blade

IMAGE FORMING APPARATUS

BACKGROUND OF THE INVENTION

The present invention relates to an image forming apparatus comprising an electric writing device of which a substrate is arranged in elastic contact with a latent image carrier and which forms an electrostatic latent image onto the latent image carrier by writing electrodes disposed on the substrate.

Among conventional known image forming apparatuses, there is a type of using a large number of needle electrodes to form an electrostatic latent image onto a latent image carrier. In an image forming apparatus of this type of using needle electrodes, an electrostatic latent image is formed onto a latent image carrier by discharge from the needle electrodes. The needle electrodes are employed as discharge portion of this image forming apparatus because such a needle electrode can discharge at the lowest possible starting voltage and has an acute tip that is preferable in terms of improving the image resolution. Generally, the needle electrodes are arranged to have a slight space from, i.e. in non-contact with, the latent image carrier and the formation of an electrostatic latent image onto the latent image carrier is conducted by discharge phenomenon.

However, variation of starting voltage for discharge due to fluctuation in the space directly causes the scatter in potential of the electrostatic latent image, leading to major image defects such as linear stains, irregularities, interruption, blur, and/or dusts. Accordingly, to stably keep the space constant, the needle electrodes are required to have high precision and high rigidity and a holding member of positioning and supporting the needle electrodes is also required to have high precision and high rigidity. In addition, the needle electrodes should be precisely positioned on a bus line of the latent image carrier in the circumferential direction of the latent image carrier. If not, the fluctuation in the space should be occurred and thus uniform charge can not be ensured. Further, run-out of the rotational axis of the latent image carrier is sure to cause fluctuation in the space. For this, spacers are provided for controlling the space. However, in case of high-speed printing in which the latent image carrier rotates at a high ratio, it is hard or impossible to keep the space constant due to vibration. As a result, the printing speed should be set at a lower speed.

As a means for solving the aforementioned problems, an image forming apparatus has been proposed in Japanese Patent Publication No. S63-45104 (hereinafter, '104B publication), in which needle electrodes are kept in contact with a latent image carrier coated by an organic glass and lubricant oil is applied to the latent image carrier to prevent wearing or damage of the latent image carrier due to the contact of the needle electrodes.

However, the invention of '104B publication has another problem of wearing of the needle electrodes. The wearing of the needle electrodes causes variation in starting voltage for discharge, leading to change in size of the electrostatic latent image and change in charged potential. Since application of oil to the latent image carrier is necessity for reducing the wearing, developing powder such as toner can not directly deposited so that the latent image carrier can only functions as an intermediate image transferring medium.

As mentioned above, the type of using a large number of needle electrodes has a problem that scatter in potential of an electrostatic latent image is easily caused so that the latent image resolution is varied with time, thus deteriorating the quality of obtained images. Since a holding member and/or a positioning member having high precision are required for holding and positioning the needle electrodes and the latent image carrier and the space therebetween, there is also a problem that the apparatus should be complex and large. There are still problems that the electrodes and the latent image carrier should be damaged for a short period of time due to high contact pressure of needle-type electrodes, that high-speed printing is hardly achieved, and that the apparatus should be large because of the use of the latent image carrier as an intermediate image transferring medium.

To solve these problems, the applicant of this application has proposed an image forming apparatus comprising an electric writing device of which a substrate is arranged in elastic contact with a latent image carrier and which forms an electrostatic latent image onto the latent image carrier by writing electrodes disposed on the substrate. According to this image forming apparatus, the electrodes receive writing signals to form an electrostatic latent image on the latent image carrier. During this, the contact between the substrate and the latent image carrier is stabilized so as to enables homogeneous writing by application of charge, thereby obtaining a high-quality image without image irregularities nor linear stains.

However, the image forming apparatus mentioned above has some problems. As shown in FIG. 9 as will be described later, in the image forming apparatus, a length L between a distal electrode 3*b*R of the writing electrodes 3*b* and a side edge of the substrate 3*a* is required to be so long as to stabilize the contact of the distal electrode 3*b*R. Without enough length L, the pressing force onto the distal electrode 3*b*R and the writing electrodes near the distal electrode 3*b*R against the latent image carrier 2 should be smaller than that of the writing electrodes located at a middle portion. In this case, homogeneous application of charge for writing can not be achieved. On the other hand, in a cleaning device 7 disposed downstream of a transferring device 6, it is impossible to completely seal toner at contact boundary faces between a cleaning blade 7*a* and an end seal 7*b* so as to produce leakage toner T which adheres to the latent image carrier 2. Because of the great length L, however, the leakage toner T passes under the substrate 3*a* so as to adhere to contact portions between the writing electrodes 3*b* and the latent image carrier 2, causing variation in the gap between the electrodes and the latent image carrier 2. This variation leads to image irregularities.

As shown in FIG. 11(A), in a developing device 4 arranged around the periphery of the latent image carrier 2 as well as the electric writing device 3 and the transferring device 6, it is impossible to completely seal toner at contact boundary faces between a toner control blade 4*c* and an end seal 4*d* to produce leakage toner T which adheres to the latent image carrier 2 as shown in FIG. 11(B). Because of the great length L, however, the leakage toner T passes under the substrate 3*a* so as to adhere to contact portions between the writing electrodes 3*b* and the latent image carrier 2, causing variation in the gap between the electrodes and the latent image carrier 2. This variation leads to image irregularities.

In order to prevent this problem, the width of the electric writing device 3 is set to be smaller than the width of the toner control blade 4*c* as shown in FIG. 13. In this case, a transferring roller of the transferring device 6 is required to have a width obtained by adding an allowance for the sheet feeding accuracy to the width of the maximum recording sheet size. To prevent the leakage toner T from adhering to the transferring roller, the width of the transferring roller should be smaller than that of the toner control blade 4*c*. The width of the latent image carrier 2 should be the largest among the other components mentioned above to achieve stable contact among the components. When the width dimensions are set in the manner as mentioned above, remainder toner adheres to the transferring roller in a region a between an end of the largest recording sheet and an end of the transferring roller. In addition, even after transfer to the recording sheet, remainder toner exists on the latent image carrier 2 in a region β between the end of the transferring roller and the end of the toner control blade 4*c*. Further, remainder toner in a region γ between the end of the transferring roller and the end of the electric writing device 3 adheres to the end of the electric writing device 3 little by little, whereby the contact of the writing electrodes 3*b* near the end becomes unsteady with time, thus causing variation in the gap between the electrodes and the latent image carrier 2. This variation leads to image irregularities.

In order to solve this problem, the applicant of this application has proposed an image forming apparatus comprising a writing device of which a substrate is arranged in elastic contact with a latent image carrier and which forms an electrostatic latent image onto the latent image carrier by writing electrodes disposed on the substrate. According to this image forming apparatus, the electrodes receive writing signals to form an electrostatic latent image on the latent image carrier. During this, the contact between the substrate and the latent image carrier is stabilized so as to enables homogeneous writing, thereby obtaining a high-quality image without image irregularities nor linear stains.

However, this image forming apparatus still has a problem that even residual toner after transfer is removed by a cleaning means, toner leaks at their ends and the leakage toner passes under the substrate of the writing device and adheres to contact portions between the writing electrodes and the latent image carrier because the substrate of the writing device is in elastic contact with the latent image carrier. The toner adhering to the contact portions between the writing electrodes and the latent image carrier causes variation in the gap between the electrodes and the latent image carrier. This variation leads to image irregularities.

SUMMARY OF THE INVENTION

It is an object of the present invention to stabilize the potential and size of an electrostatic latent image so as to obtain a high resolution and high quality image and to reduce the friction of electrodes and a latent image carrier so as to improve the durability.

It is another object of the present invention to prevent toner leaking at end seals of a developing device, a cleaning device, and the like from adhering to writing electrodes so as to prevent error in writing an electrostatic latent image.

It is still another object of the present invention to prevent leakage toner from causing variation in gap between the writing electrodes and the latent image carrier so as to prevent occurrence of image irregularities.

It is further still another object of the present invention to prevent remainder toner left on non-image portions at both ends of a developing means from adhering the writing electrodes so as to prevent error in writing an electrostatic latent image.

To achieve the aforementioned object, an image forming apparatus comprises a latent image carrier, a writing means having a plurality of writing electrodes which are aligned in the axial direction of said latent image carrier and arranged in contact with or proximity to said latent image carrier to form an electrostatic latent image on said latent image carrier, a developing means for developing the electrostatic latent image on said latent image carrier, and is characterized in that the contact width of said writing means relative to said latent image carrier is set within the width of a toner carrying portion of said developing means confronting said latent image carrier. In an image forming apparatus further comprising a cleaning means which is arranged in contact with said latent image carrier to remove residual toner, the contact width of said writing means relative to said latent image carrier is set within the contact width of said cleaning means relative to said latent image carrier.

In an image forming apparatus further comprising a transferring means, a relation L1<L2 and a relation L1<L3 are satisfied and a relation L1<L3<L2 is satisfied, wherein L1 is the contact width of said writing means relative to said latent image carrier, L2 is the width of a toner carrying portion of said developing means confronting said latent image carrier, L0 is the width of said latent image carrier, and L3 is the width of said transferring means.

In an image forming apparatus further comprising a charge removing means for removing charge from residual toner on said latent image carrier, at least the width of a charge removing portion of said charge removing means is set to be larger than the contact width of said writing means relative to said latent image carrier, and the width of a charge removing portion of said charge removing means is set to be larger than the width of a toner control portion of said developing means.

In an image forming apparatus further comprising an intermediate transferring member for temporally transferring a toner image obtained on said latent image carrier by the deploying and a cleaning means which is arranged in contact with said intermediate transferring member to remove residual toner, wherein the toner image on said intermediate transferring member is transferred to a recording medium, at least the contact width of said cleaning means relative to said intermediate transferring member is set to be larger than the contact width of said writing means relative to said latent image carrier, at least the width of said latent image carrier is set to be larger than the width of said writing means and the contact width of said cleaning means relative to said intermediate transferring member is set to be larger than the width of said latent image carrier.

In an image forming apparatus further comprising a transferring means for transferring a toner image obtained on said latent image carrier by the deploying to a recording medium fed by a recording medium feeding means, and a cleaning means which is arranged in contact with said recording medium feeding means to remove residual toner, at least the contact width of said cleaning means relative to said recording medium feeding means is set to be larger than the contact width of said writing means and least the contact width of said cleaning means relative to said recording medium feeding means is set to be larger than the width of said latent image carrier.

BRIEF DESCRIPTION OF THE DRAWINGS

FIGS. 1(A) and 1(B) show an example of the image forming apparatus in accordance with the present invention, wherein FIG. 1(A) is a schematic illustration of the entire structure and FIG. 1(B) is a perspective view partially showing a latent image carrier and an electric writing device shown in FIG. 1(A);

FIGS. 11(A), 11(B) are views for explaining another problem to be solved by the present invention, wherein FIG. 11(A) is a perspective view showing an example of an image forming device using an electric writing device and FIG. 11(B) is a partial sectional view of FIG. 11(A).;

FIGS. 18(A)–18(D) are views for explaining a problem caused by that charge of residual toner left after cleaning is not removed;

DESCRIPTION OF THE PREFERRED EMBODIMENTS

Figure 1A:
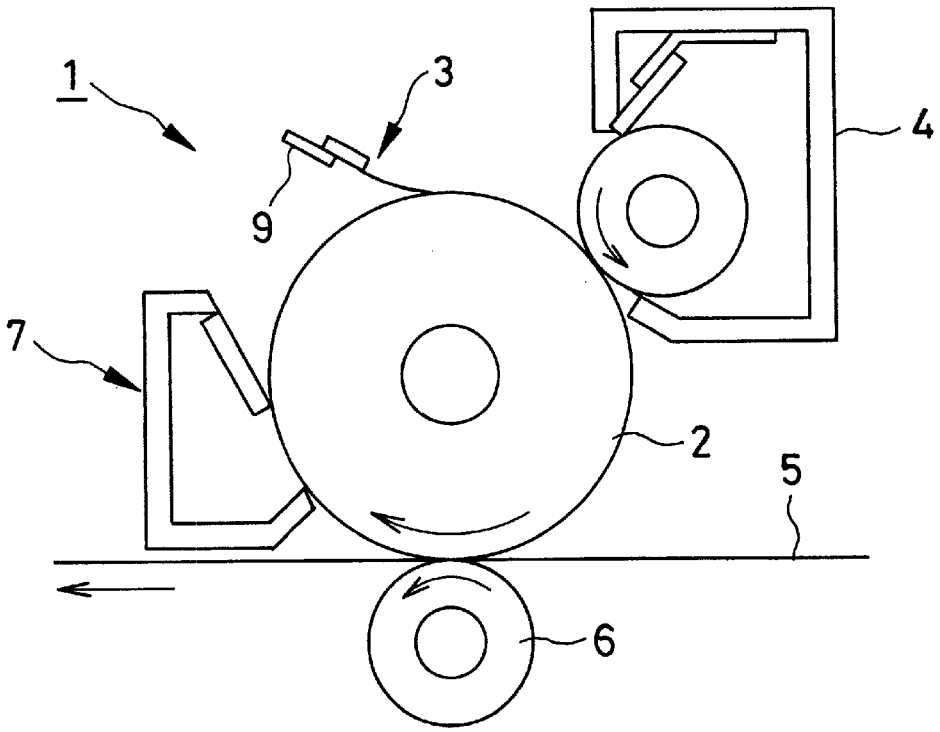
Figure 1B:
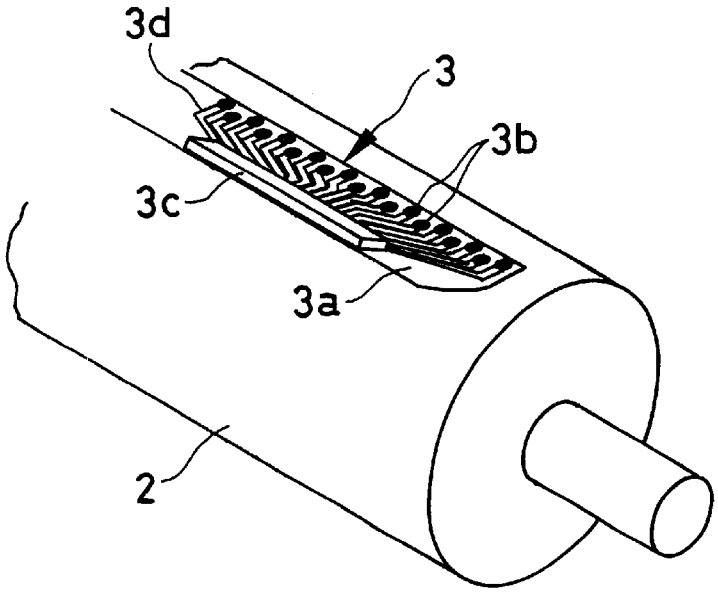
Figure 2A:
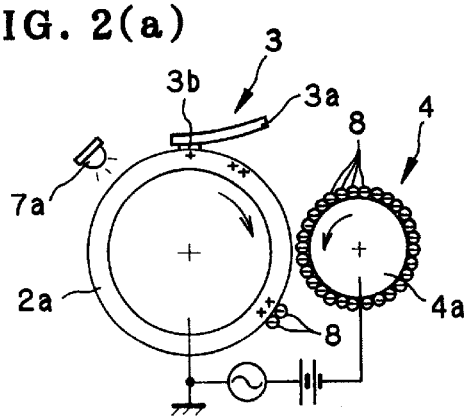
FIGS. 2(*a*)–2(*h*) are views each illustrating an example of the basic process of forming an image in the image forming apparatus of the present invention.
Figure 2B:
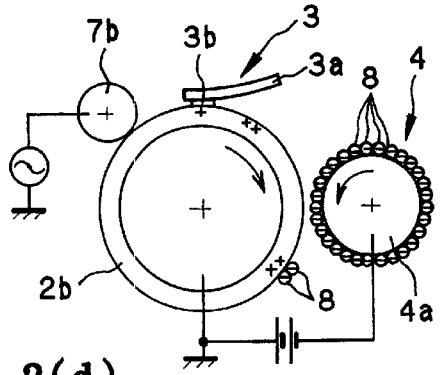
Figure 2C:
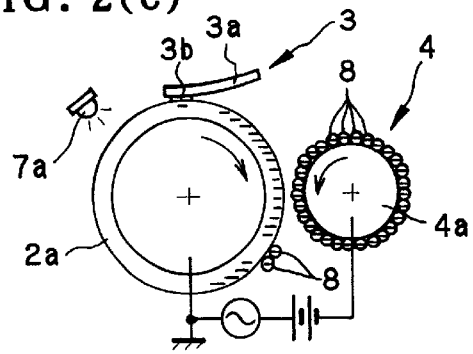
Figure 2D:
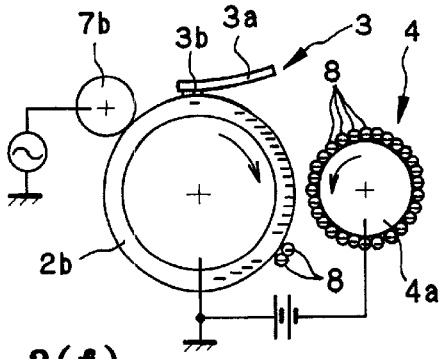
Figure 2E:
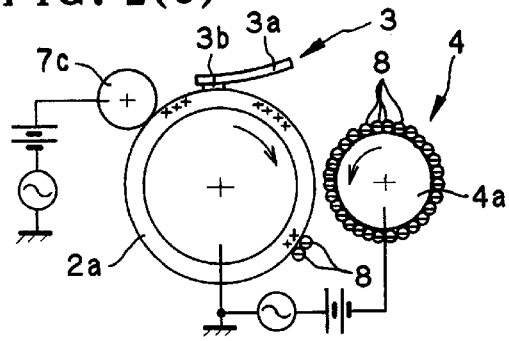
Figure 2F:
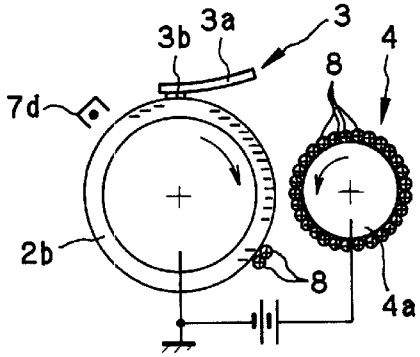
Figure 2G:
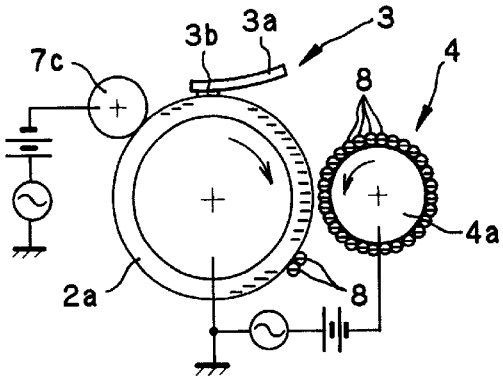
Figure 2H:
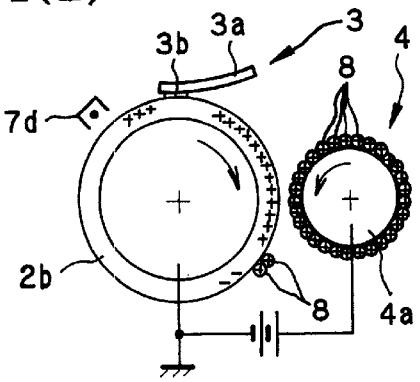
Figure 3A:
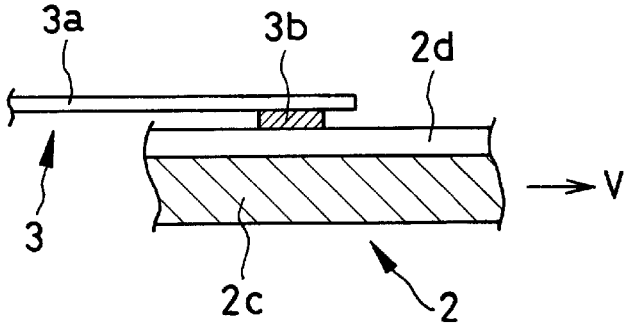
FIGS. 3(*a*)–3(*f*) are views for explaining the principle of writing an electrostatic latent image by writing electrodes of a writing device through application or removal of charge, wherein FIG. 3(*a*) is an enlarged view of a portion where a writing electrode is in contact with the latent image carrier, FIG. 3(*b*) is a diagram of an electrical equivalent circuit of the contact portion, and FIGS. 3(*c*)–3(*f*) are graphs each showing the relation between each parameter and the surface potential of the latent image carrier.
Figure 3B:
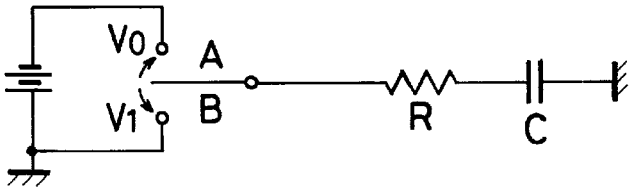
Figure 3C:
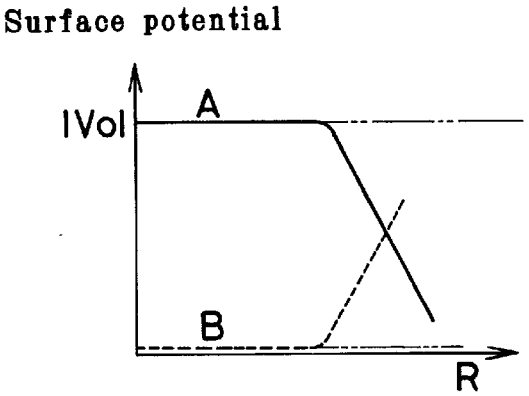
Figure 3D:
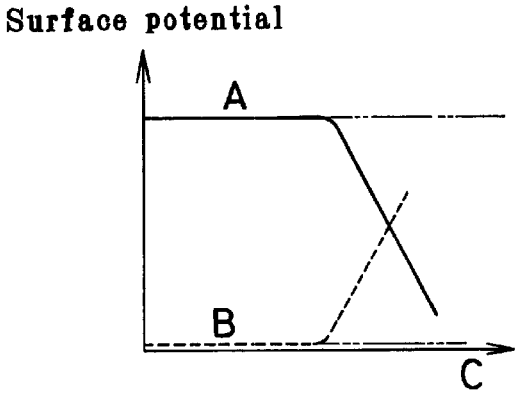
Figure 3E:
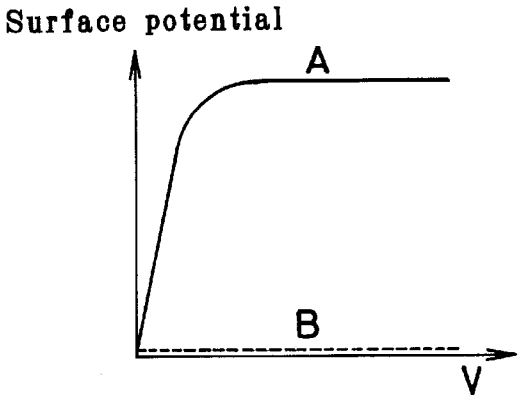
Figure 3F:
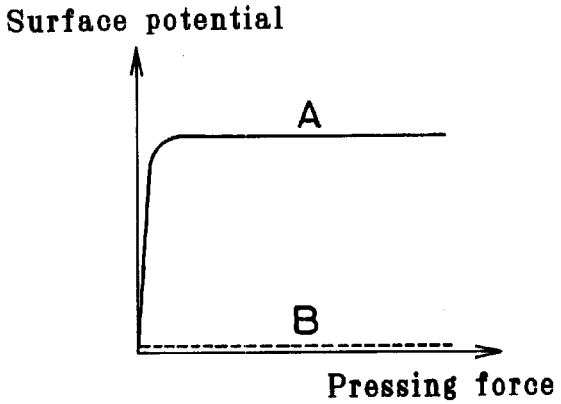

The embodiments of the present invention will be described hereinafter with reference to the drawings. FIGS. 1(A) and 1(B) show an example of the image forming apparatus in accordance with the present invention, wherein FIG. 1(A) is a schematic illustration of the entire structure and FIG. 1(B) is a perspective view partially showing a latent image carrier and an electric writing device shown in FIG. 1(A). It should be noted that, in the following description, similar or corresponding components are sometimes marked by the same numerals in the respective drawings to omit the description for the components.

In FIG. 1(A), an image forming apparatus 1 according to the present invention comprises, at least, a latent image carrier 2 on which an electrostatic latent image is formed, an electric writing device 3 having a plurality of writing electrodes 3*b* which are arranged in contact with or in proximity to the latent image carrier 2 along the axial direction of the latent image carrier 2 to write the electrostatic latent image onto the latent image carrier 2, a developing device 4 which develops the electrostatic latent image on the latent image carrier 2 with developing powder, a transferring device 6 which transfers the image developed by the developing device, i.e. a toner image, on the latent image carrier 2 to a receiving medium 5 such as a recording sheet, and a cleaning device 7 which remove residual toner left on the latent image carrier 2 after the transfer. The electric writing device 3 is supported, at its one end, by a fixing means 9 in the cantilevered form and is, at its other end, in contact with the latent image carrier 2.

As shown in FIG. 1(B), the electric writing device 3 comprises a flexible substrate 3*a*, having high insulation property and being relatively soft and elastic, such as a FPC (Flexible Print Circuit) or a PET film and writing electrodes 3*b* which are formed on the substrate 3*a* and which are pressed lightly against the latent image carrier 2 by weak elastic restoring force created by deflection of the substrate 3*a* so that the writing electrodes 3*b* are in contact with or in proximity to the latent image carrier 2. Also formed on the substrate 3*a* are drivers 3*c*, and conductive patterns 3*d* which are connected to the writing electrodes 3*b*. Pressing force applied to the writing electrodes 3*b* may be 10 N or less per 300 mm in width, that is a linear load of 0.33 N/mm or less, that is preferable for stabilizing the contact between the writing electrodes 3*b* and the latent image carrier 2 and for stabilizing the charge injection or (the space for) the discharge. In view of wearing, it is preferable to achieve the smallest possible linear load while keeping the contact stability.

FIGS. 2(*a*)–2(*h*) are views each illustrating an example of the basic process of forming an image in the image forming apparatus 1 of the present invention.

As the basic process of forming an image in the image forming apparatus 1 of the present invention, there are four types as follows: (1) making uniformly charged state by removal of charge—writing by contact application of charge—normal developing; (2) making uniformly charged state by removal of charge—writing by contact application of charge reversal developing; (3) making uniformly charged state by application of charge—writing by contact removal of charge—normal developing; and (4) making uniformly charged state by application of charge—writing by contact removal of charge—reversal developing. Following description will be made as regard to these image forming processes.

(1) Making Uniformly Charged State by Removal of Charge—Writing by Contact Application of Charge—Normal Developing A process illustrated in FIG. 2(*a*) is an example of this image forming process. As shown in FIG. 2(*a*), in this example, a photoreceptor 2*a* is employed as the latent image carrier 2 and a charge removing lump 7*a* is employed as the charge control device 7. By positively (+) charging image portions of the photoreceptor 2*a* through the writing electrodes 3*b* of the writing device 3 which are in contact with the photoreceptor 2*a*, an electrostatic latent image is written on the photoreceptor 2*a*. In addition, a bias voltage composed of an alternating current superimposed on a direct current of a negative (−) polarity is applied to a developing roller 4*a* of the developing device 4, as in conventional ones. Accordingly, the developing roller 4*a* conveys negatively (−) charged developing powder 8 to the photoreceptor 2*a*. It should be noted that a bias voltage composed of a direct current of a negative (−) polarity only may be applied to the developing roller 4*a*.

In the image forming process of this example, the charge removing lump 7*a* removes charge from the surface of the photoreceptor 2*a* to make the surface into the uniformly charged (charge-removed) state with nearly 0V (zero volt) and, after that, the image portions of the photoreceptor 2*a* are positively (+) charged by the writing electrodes 3*b* of the writing device 3, thereby writing an electrostatic latent image onto the photoreceptor 2*a*. Then, negatively (−) charged developing powder 8 conveyed by the developing roller 4*a* of the developing device 4 adheres to the positively (+) charged image portions of the photoreceptor 2*a*, thereby normally developing the electrostatic latent image.

A process illustrated in FIG. 2(*b*) is another example of this image forming process. As shown in FIG. 2(*b*), in this example, a dielectric body 2*b* is employed as the latent image carrier 2 and a charge removing roller 7*b* is employed as the charge control device 7. As in conventional ones, a bias voltage composed of a direct current of a negative (−) polarity may be applied to the developing roller 4*a*. It should be noted that a bias voltage composed of an alternating current superimposed on a direct current of a negative (−) polarity may be applied to the developing roller 4*a*. On the other hand, a bias voltage composed of an alternating current is applied to the charge removing roller 7*b*. Other structures of this example are the same as those of the aforementioned example shown in FIG. 2(*a*).

In the image forming process of this example, the charge removing roller 7*b* is in contact with the dielectric body 2*b* so as to remove charge from the surface of the dielectric body 2*b* to make the surface of the dielectric body 2*b* into the uniformly charged (charge-removed) state with nearly 0V (zero volt). The image forming actions after that are the same as those of the aforementioned example shown in FIG. 2(*a*), except that the dielectric body 2*b* is used instead of the photoreceptor 2*a*.

(2) Making Uniformly Charged State by Removal of Charge—Writing by Contact Application of Charge—Reversal Developing A process shown in FIG. 2(*c*) is an example of this image forming process. As shown in FIG. 2(*c*), in this example, a photoreceptor 2*a* is employed as the latent image carrier 2 and a charge removing lump 7*a* is employed as the charge control device 7 just like the example shown in FIG. 2(*a*). The writing electrodes 3*b* of the writing device 3 are in contact with the photoreceptor 2*a* so that non-image portions of the photoreceptor 2*a* are negatively (−) charged. Other structures of this example are the same as those of the aforementioned example shown in FIG. 2(*a*).

In the image forming process of this example, the charge removing lump 7*a* removes charge from the surface of the photoreceptor 2*a* to make the surface of the photoreceptor 2*a* into the uniformly charged (charge-removed) state with nearly 0V (zero volt) and, after that, the non-image portions of the photoreceptor 2*a* are negatively (−) charged by the writing electrodes 3*b* of the writing device 3, thereby writing an electrostatic latent image onto the photoreceptor 2*a*. Then, negatively (−) charged developing powder 8 conveyed by the developing roller 4*a* of the developing device 4 adheres to image portions, not negatively (−) charged and having nearly 0V (zero volt), of the photoreceptor 2*a*, thereby reversely developing the electrostatic latent image.

A process illustrated in FIG. 2(*d*) is another example of this image forming process. As shown in FIG. 2(*d*), in this example, a dielectric body 2*b* is employed as the latent image carrier 2 and a charge removing roller 7*b* is employed as the charge control device 7 just like the example shown in FIG. 2(*b*). The writing electrodes 3*b* of the writing device 3 are arranged in contact with the dielectric body 2*b* to negatively (−) charge non-image portions of the dielectric body 2*b*. Other structures of this example are the same as those of the aforementioned example shown in FIG. 2(*b*).

In the image forming process of this example, the charge removing roller 7*b* is in contact with the dielectric body 2*b* so as to remove charge from the surface of the dielectric body 2*b* to make the surface into the uniformly charged (charge-removed) state with nearly 0V (zero volt). The image forming actions after that are the same as those of the aforementioned example shown in FIG. 2(*c*), except that the dielectric body 2*b* is used instead of the photoreceptor 2*a*.

(3) Making Uniformly Charged State by Application of Charge—Writing by Contact Removal of Charge—Normal Developing A process shown in FIG. 2(*e*) is an example of this image forming process. As shown in FIG. 2(*e*), in this example, a photoreceptor 2*a* is employed as the latent image carrier 2 and a charging roller 7*c* is employed as the charge control device 7. A bias voltage composed of an alternating current superimposed on a direct current of a positive (+) polarity is applied to the charging roller 7*c* so that the charging roller 7*c* uniformly positively (+) charges the surface of the photoreceptor 2*a*. It should be noted that a bias voltage composed of a direct current of a positive (+) polarity only may be applied to the charging roller 7*c*. In addition, the writing electrodes 3*b* of the writing device 3 are in contact with the photoreceptor 2*a* so that positive (+) charge is removed from the non-image portions of the photoreceptor 2*a*. Other structures of this example are the same as those of the aforementioned example shown in FIG. 2(*a*).

In the image forming process of this example, the charging roller 7*c* is arranged in contact with the photoreceptor 2*a* so as to positively (+) charge the surface of the photoreceptor 2*a* to make the surface into the uniformly charged state with a predetermined voltage and, after that, positive (+) charge is removed from the non-image portions of the photoreceptor 2*a* by the writing electrodes 3*b* of the writing device 3, thereby writing an electrostatic latent image onto the photoreceptor 2*a*. Then, negatively (−) charged developing powder 8 conveyed by the developing roller 4*a* of the developing device 4 adheres to the image portions, positively (+) charged, of the photoreceptor 2*a*, thereby normally developing the electrostatic latent image.

A process illustrated in FIG. 2(*f*) is another example of this image forming process. As shown in FIG. 2(*f*), in this example, a dielectric body 2*b* is employed as the latent image carrier 2 and a corona charging device 7*d* is employed as the charge control device 7. A bias voltage composed of a direct current of a negative (−) polarity or a bias voltage composed of an alternating current superimposed on a direct current of a negative (−) polarity is applied to the corona charging device 7*d* in the same manner as the conventional one, but not illustrated. The writing electrodes 3*b* of the writing device 3 are arranged in contact with the dielectric body 2*b* to remove negative (−) charge from the non-image portions of the dielectric body 2*b*. Moreover, a bias voltage composed of a direct current of a positive (+) polarity is applied to the developing roller 4*a* so that the developing roller 4*a* conveys positively (+) charged developing powder 8 to the dielectric body 2*b*. It should be noted that a bias voltage composed of an alternating current superimposed on a direct current of a positive (+) polarity may be applied to the developing roller 4*a*. Other structures of this example are the same as those of the aforementioned example shown in FIG. 2(*b*).

In the image forming process of this example, the surface of the dielectric body 2*b* is negatively (−) charged by the corona charging device 7*d* to make the surface of the dielectric body 2*b* into the uniformly charged state with the predetermined voltage and, after that, negative (−) charge is removed from the non-image portions of the dielectric body 2*b* by the writing electrodes 3*b* of the writing device 3, thereby writing an electrostatic latent image on the dielectric body 2*b*. Then, positively (+) charged developing powder 8 conveyed by the developing roller 4*a* of the developing device 4 adheres to the image portions, negatively (−) charged, of the dielectric body 2*b*, thereby normally developing the electrostatic latent image.

(4) Making Uniformly Charged State by Application of Charge—Writing by Contact Removal of Charge—Reversal Developing A process shown in FIG. 2(*g*) is an example of this image forming process. As shown in FIG. 2(*g*), in this example, a photoreceptor 2*a* is employed as the latent image carrier 2 and a charging roller 7*c* is employed as the charge control device 7. A bias voltage composed of an alternating current superimposed on a direct current of a negative (−) polarity is applied to the charging roller 7*c* so that the charging roller 7*c* uniformly negatively (−) charges the surface of the photoreceptor 2*a*. It should be noted that a bias voltage composed only of a direct current of a negative (−) polarity may be applied to the charging roller 7*c*. The writing electrodes 3*b* of the writing device 3 are in contact with the photoreceptor 2*a* so that negative (−) charge is removed from the image portions of the photoreceptor 2*a*. Other structures of this example are the same as those of the aforementioned example shown in FIG. 2(*a*).

In the image forming process of this example, the charging roller 7*c* is arranged in contact with the photoreceptor 2*a* to negatively (−) charge the surface of the photoreceptor 2*a* to make the surface into the uniformly charged state with a predetermined voltage and, after that, negative (−) charge is removed from the image portions of the photoreceptor 2*a* by the writing electrodes 3*b* of the writing device 3, thereby writing an electrostatic latent image onto the photoreceptor 2*a*. Then, negatively (−) charged developing powder 8 conveyed by the developing roller 4*a* of the developing device 4 adheres to the image portions, not negatively (−) charged, of the photoreceptor 2*a*, thereby reversely developing the electrostatic latent image.

A process illustrated in FIG. 2(*h*) is another example of this image forming process. As shown in FIG. 2(*h*), in this example, a dielectric body 2*b* is employed as the latent image carrier 2 and a corona charging device 7*d* is employed as the charge control device 7. A bias voltage composed of a direct current of a positive (+) polarity or a bias voltage composed of an alternating current superimposed on a direct current of a positive (+) polarity is applied to the corona charging device 7*d*, but not illustrated. Other structures of this example are the same as those of the aforementioned example shown in FIG. 2(*f*).

In the image forming process of this example, the surface of the dielectric body 2*b* is positively (+) charged by the corona charging device 7*d* to make the surface of the dielectric body 2*b* into the uniformly charged state with the predetermined voltage and, after that, positive (+) charge is removed from the image portions of the dielectric body 2*b* by the writing electrodes 3*b* of the writing device 3, thereby writing an electrostatic latent image onto the dielectric body 2*b*. Then, positively (+) charged developing powder 8 conveyed by the developing roller 4*a* of the developing device 4 adheres to the image portions, not positively (+) charged, of the dielectric body 2*b*, thereby reversely developing the electrostatic latent image.

FIGS. 3(*a*)–3(*f*) are views for explaining the principle of writing an electrostatic latent image by the writing electrodes 3*b* of the writing device 3 through application or removal of charge, wherein FIG. 3(*a*) is an enlarged view of a contact portion where a writing electrode 3*b* is in contact with the latent image carrier 2, FIG. 3(*b*) is a diagram of an electrical equivalent circuit of the contact portion, and FIGS. 3(*c*)–3(*f*) are graphs each showing the relation between each parameter and the surface potential of the latent image carrier 2.

As shown in FIG. 3(*a*), the latent image carrier 2 comprises a base member 2*c* which is made of a conductive material such as aluminum and is grounded and an insulating charged layer 2*d* formed on the outer periphery of the base member 2*c*. The writing electrodes 3*b* supported by the flexible substrate 3*a* made of FPC or the like of the writing device 3 are in contact with the charged layer 2*d* with a predetermined small pressing force and the latent image carrier 2 travels (rotates) at a predetermined speed "v". As the aforementioned small pressing force, 10N or less per 300 mm in width, that is, a linear load of 0.03N/mm or less is preferable in view of stabilization of contact between the writing electrodes 3*b* and the latent image carrier 2 or proximity of the writing electrodes 3*b* relative to the latent image carrier 2 (space between the writing electrodes 3*b* and the latent image carrier 2) and stabilization of the charge injection or discharge. In view of wearing, it is preferable to achieve the smallest possible linear load while keeping the contact stability.

Either of a predetermined high voltage $V_0$ and a predetermined low voltage $V_1$ is selectively impressed to the writing electrodes 3*b* through the substrate 3*a* (as mentioned, since there are positive (+) and negative (−) charges, the high voltage is a voltage having a high absolute value and the low voltage is a voltage of the same polarity as the high voltage and having a low absolute value or 0V (zero volt). In the description of the present invention in this application, the low voltage is a ground voltage. In the following description, therefore, the high voltage $V_0$ is referred to as the predetermined voltage $V_0$ and the low voltage $V_1$ is referred to as the ground voltage $V_1$. It should be understood that the ground voltage $V_1$ is 0V (zero volt).)

That is, the contact portion (nip portion) between each writing electrode 3*b* and the latent image carrier 2 is provided with an electrical equivalent circuit shown in FIG. 3(*b*). In FIG. 3(*b*), "R" designates the resistance of the writing electrode 3*b* and "C" designates the capacity of the latent image carrier 2. The resistance R of the writing electrode 3*b* is selectively switched to be connected to the A side of the predetermined voltage $V_0$ of a negative (−) polarity or to the B side of the ground voltage $V_1$.

FIG. 3(*c*) shows the relation between the resistance R of the writing electrode 3*b* and the surface potential of the latent image carrier 2. The aforementioned relation when the writing electrode 3*b* is connected to the A side in the electrical equivalent circuit to impress the predetermined voltage $V_0$ of a negative (−) polarity to the writing electrode 3*b* is represented by a solid line in FIG. 3(*c*). As shown by the solid line in FIG. 3(*c*), the surface potential of the latent image carrier 2 is constant at the predetermined voltage $V_0$ in a region where the resistance R of the writing electrode 3*b* is small, and the absolute value of the surface potential of the latent image carrier 2 decreases in a region where the resistance R of the writing electrode 3*b* is greater than a predetermined value. On the other hand the relation between the resistance R of the writing electrode 3*b* and the surface potential of the latent image carrier 2 when the writing electrode 3*b* is connected to the B side to ground the electrode 3*b* is represented by a dotted line in FIG. 3(*c*). As shown by the dotted line in FIG. 3(*c*), the surface potential of the latent image carrier 2 is constant at substantially the ground voltage $V_1$ in a region where the resistance R of the writing electrode 3*b* is small, and the absolute value of the surface potential of the latent image carrier 2 increases in a region where the resistance R of the writing electrode 3*b* is greater than the predetermined value.

Figure 4A:
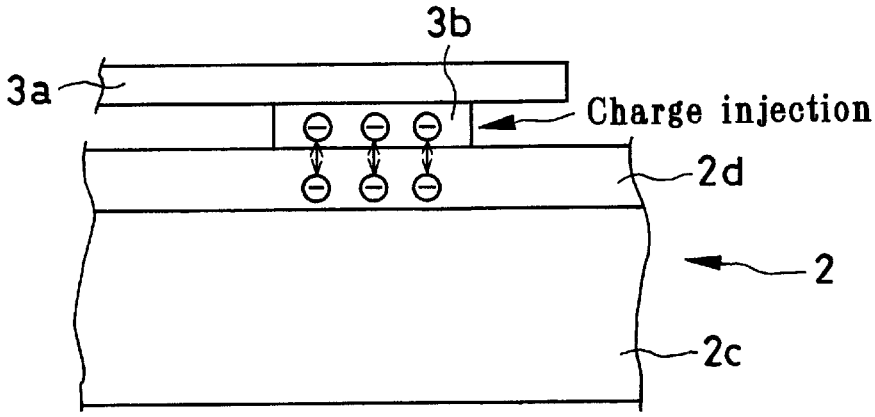
FIGS. 4(*a*)–4(*c*) are views for explaining the application or removal of charge relative to the latent image carrier, wherein FIG. 4(*a*) is a view for explaining the application or removal of charge relative to the latent image carrier via the charge injection, FIG. 4(*b*) is a view for explaining the application or removal of charge relative to the latent image carrier via the discharge, and FIG. 4(*c*) is a graph for explaining Paschen's law.
Figure 4B:
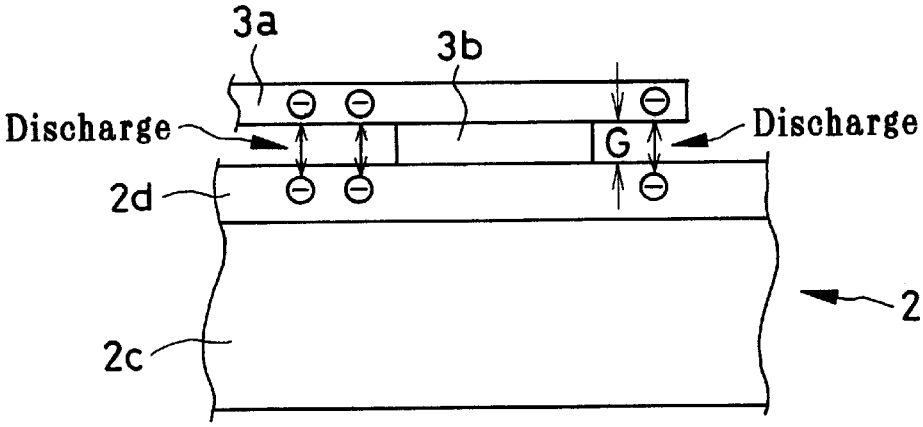
Figure 4C:
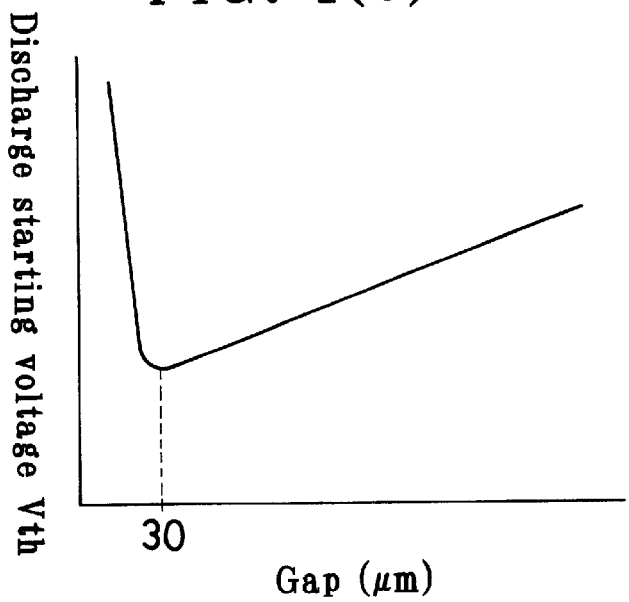

In the region where the resistance R of the writing electrode 3*b* is small and the surface potential of the latent image carrier 2 is constant at the predetermined voltage $V_0$ or constant at the ground voltage $V_1$, injection of negative (−) charge is conducted directly from a lower voltage side to a higher voltage side between the writing electrode 3*b* being in contact with the latent image carrier 2 and the charged layer 2*d* of the latent image carrier 2, as shown in FIG. 4(*a*). This means that charge is applied to or removed from the latent image carrier 2 via the charge injection. In the region where the resistance R of the writing electrode 3*b* is great and the surface potential of the latent image carrier 2 starts to vary, the application or removal of charge relative to the latent image carrier 2 via the charge injection is gradually reduced and discharge is occurred between a conductive pattern (will be described later) of the substrate 3*a* and the latent image carrier 2 as shown in FIG. 4(*b*) as the resistance R of the writing electrode 3*b* is increased.

The discharge between the conductive pattern of the substrate 3*a* and the base member 2*c* of the latent image carrier 2 is occurred when the absolute value of the voltage (the predetermined voltage $V_0$) between the substrate 3*a* and the latent image carrier 2 becomes higher than a discharge starting voltage $V_{th}$. The relation between the gap G, between the substrate 3*a* and the latent image carrier 2, and the discharge starting voltage $V_{th}$ is just as shown in FIG. 4(*c*), according to Paschen's law. That is, the discharge starting voltage $V_{th}$ is the lowest when the gap G is in a range about 30 $\mu$m, so the discharge starting voltage $V_{th}$ should be high when the gap G is either larger or smaller than the range about 30 $\mu$m, making the occurrence of discharge difficult. Even via the discharge, charge can be applied to or removed from the surface of the latent image carrier 2. However, when the resistance R of the writing electrode 3*b* is in this region, the application or removal of charge relative to the latent image carrier 2 via the charge injection is greater while the application or removal of charge relative to the latent image carrier 2 via the discharge is smaller. This means that the application or removal of charge relative to the latent image carrier 2 is dominated by the application or removal of charge via the charge injection. By the application or removal of charge via the charge injection, the surface potential of the latent image carrier 2 becomes to the predetermined voltage $V_0$ to be impressed to the writing electrode 3*d* or the ground voltage $V_1$. In case of the application of charge via the charge injection, the predetermined voltage $V_0$ to be supplied to the writing electrode 3*b* is preferably set to a voltage equal to or less than the discharge starting voltage $V_{th}$ at which the discharge is occurred between the writing electrode 3*b* and the base member 2*c* of the latent image carrier 2.

When the resistance R of the writing electrode 3*b* is greater than the region, the application or removal of charge relative to the latent image carrier 2 via the charge injection is smaller while the application or removal of charge relative to the latent image carrier 2 via the discharge is greater than that via the charge injection. The application or removal of charge relative to the latent image carrier 2 gradually becomes dominated by the application or removal of charge via the discharge. That is, as the resistance R of the writing electrode 3*b* becomes greater, the application or removal of charge relative to the surface of the latent image carrier 2 is performed mainly via the discharge and rarely via the charge injection. By the application or removal of charge via the discharge, the surface potential of the latent image carrier 2 becomes to a voltage obtained by subtracting the discharge starting voltage $V_{th}$ from the predetermined voltage $V_0$ to be impressed to the writing electrode 3*d* or the ground voltage $V_1$. It should be noted that the same is true when the predetermined voltage $V_0$ is of a positive (+) polarity.

Therefore, the application or removal of charge relative to the latent image carrier 2 via the charge injection can be achieved by satisfying a condition that the resistance R of the electrode 3*b* is set in such a small range as to allow the surface potential of the latent image carrier 2 to be constant at the predetermined voltage $|V_0|$ (this is an absolute value because voltages of opposite (±) polarities are available) or constant at the ground voltage $V_1$ and by controlling the voltage to be impressed to the writing electrode 3*b* to be switched between the predetermined voltage $V_0$ and the ground voltage $V_1$.

FIG. 3(*d*) shows the relation between the capacity C of the latent image carrier 2 and the surface potential of the latent image carrier 2. The aforementioned relation when the writing electrode 3*b* is connected to the A side to impress the predetermined voltage $V_0$ of a negative (−) polarity to the writing electrode 3*b* is represented by a solid line in FIG. 3(*d*). As shown by the solid line in FIG. 3(*d*), the surface potential of the latent image carrier 2 is constant at the predetermined voltage $V_0$ in a region where the capacity C of the latent image carrier 2 is small, and the absolute value of the surface potential of the latent image carrier 2 decreases in a region where the capacity C of the latent image carrier 2 is larger than a predetermined value. On the other hand, the relation between the capacity C of the latent image carrier 2 and the surface potential of the latent image carrier 2 when the writing electrode 3*b* is connected to the B side to ground the writing electrode 3*b* is represented by a dotted line in FIG. 3(*d*). As shown by the dotted line in FIG. 3(*d*), the surface potential of the latent image carrier 2 is constant at substantially the ground voltage $V_1$ in a region where the capacity C of the latent image carrier 2 is small, and the absolute value of the surface potential of the latent image carrier 2 increases where the capacity C of the latent image carrier 2 is larger than a predetermined value.

In the region where the capacity C of the latent image carrier 2 is small and the surface potential of the latent image carrier 2 is constant at the predetermined voltage $V_0$ or constant at the ground voltage $V_1$, charge injection of negative (−) charge is conducted directly between the writing electrode 3*b* being in contact with the latent image carrier 2 and the charged layer 2*d* of the latent image carrier 2. That is, charge is applied to or removed from the latent image carrier 2 via the charge injection. In the region where the capacity C of the latent image carrier 2 is large and the surface potential of the latent image carrier 2 starts to vary, the application or removal of charge relative to the latent image carrier 2 via the charge injection is gradually reduced and discharge is started between the substrate 3*a* and the latent image carrier 2 as shown in FIG. 4(*b*) as the capacity C of the latent image carrier 2 is increased. Even via the discharge, charge can be applied to or removed from the surface of the latent image carrier 2. However, when the capacity C of the latent image carrier 2 is in this region, the application or removal of charge relative to the latent image carrier 2 via the charge injection is greater while the application or removal of charge relative to the latent image carrier 2 via the discharge is smaller. This means that the application or removal of charge relative to the latent image carrier 2 is dominated by the application or removal of charge via the charge injection. By the application or removal of charge via the charge injection, the surface potential of the latent image carrier 2 becomes to the predetermined voltage $V_0$ to be impressed to the writing electrode 3*d* or the ground voltage $V_1$.

When the capacity C of the latent image carrier 2 is greater than the region, there is now little charge injection between the writing electrode 3*b* and the charged layer 2*d* of the latent image carrier 2. This means that little or no charge is applied to or removed from the latent image carrier 2 via the charge injection. It should be noted that the same is true when the predetermined voltage $V_0$ is of a positive (+) polarity.

Therefore, the application or removal of charge relative to the latent image carrier 2 via the charge injection can be achieved by satisfying a condition that capacity C of the latent image carrier 2 is set in such a small range as to allow the surface potential of the latent image carrier 2 to be constant at the predetermined voltage $|V_0|$ (this is an absolute value because voltages of opposite (±) polarities are available) or constant at the ground voltage $V_1$ and by controlling the voltage to be impressed to the writing electrode 3*b* to be switched between the predetermined voltage $V_0$ and the ground voltage $V_1$.

FIG. 3(*e*) shows the relation between the velocity (peripheral velocity) v of the latent image carrier 2 and the surface potential of the latent image carrier 2. The aforementioned relation when the writing electrode 3*b* is connected to the A side to impress the predetermined voltage $V_0$ of a negative (−) polarity to the writing electrode 3*b* is represented by a solid line in FIG. 3(*e*). As shown by the solid line in FIG. 3(*e*), the surface potential of the latent image carrier 2 increases as the velocity v increases in a region where the velocity v of the latent image carrier 2 is relatively low, and the absolute value of the surface potential of the latent image carrier 2 is constant in a region where the velocity v of the latent image carrier 2 is higher than a predetermined value. The reason of increase in the surface potential of the latent image carrier 2 with the increase in the velocity v of the latent image carrier 2 is considered as that the charge injection to the latent image carrier 2 is facilitated due to friction between the writing electrode 3*b* and the latent image carrier 2. The velocity v of the latent image carrier 2 has an extent above which the facilitation of the charge injection due to friction is no longer increased and becomes substantially constant. On the other hand, the relation between the velocity v of the latent image carrier 2 and the surface potential of the latent image carrier 2 when the writing electrode 3*b* is connected to the B side to ground the writing electrode 3*b* is represented by a dotted line in FIG. 3(*e*). As shown by the dotted line in FIG. 3(*e*), the surface potential of the latent image carrier 2 is constant at the ground voltage $V_1$ regardless of the velocity v of the latent image carrier 2. It should be noted that the same is true when the predetermined voltage $V_0$ is of a positive (+) polarity.

FIG. 3(*f*) shows the relation between the pressing force applied to the latent image carrier 2 by the writing electrode 3*b* (hereinafter, just referred to as "the pressure of the writing electrode 3*b*") and the surface potential of the latent image carrier 2. The aforementioned relation when the writing electrode 3*b* is connected to the A side to impress the predetermined voltage $V_0$ of a negative (−) polarity to the writing electrode 3*b* is represented by a solid line in FIG. 3(*f*). As shown by the solid line in FIG. 3(*f*), the surface potential of the latent image carrier 2 relatively rapidly increases as the pressure of the writing electrode 3*b* increases in a region where the pressure of the writing electrode 3*b* is very low, and the absolute value of the surface potential of the latent image carrier 2 is constant in a region where the pressure of the writing electrode 3*b* is higher than a predetermined value. The reason of the rapid increase in the surface potential of the latent image carrier 2 with the increase in the pressure of the writing electrode 3*b* is considered as that the contact between the writing electrode 3*b* and the latent image carrier 2 is further ensured by the increase in the pressure of the writing electrode 3*b*. The pressure of the writing electrode 3*b* has an extent above which the contact certainty between the writing electrode 3*b* and the latent image carrier 2 is no longer increased and becomes substantially constant. On the other hand, the relation between the pressure of the writing electrode 3*b* and the surface potential of the latent image carrier 2 when the writing electrode 3*b* is connected to the B side to ground the writing electrode 3*b* is represented by a dotted line in FIG. 3(*f*). As shown by the dotted line in FIG. 3(*f*), the surface potential of the latent image carrier 2 is constant at the ground voltage $V_1$ regardless of the pressure of the writing electrode 3*b*. It should be noted that the same is true when the predetermined voltage $V_0$ is of a positive (+) polarity.

Therefore, the application or removal of charge relative to the latent image carrier 2 via the charge injection can be securely and easily achieved by satisfying conditions that the resistance R of the writing electrode 3*b* and the capacity C of the latent image carrier 2 are set in such a manner as to allow the surface potential of the latent image carrier 2 to be constant at the predetermined voltage and that the velocity v of the latent image carrier 2 and the pressure of the writing electrode 3*b* are set in such a manner as to allow the surface potential of the latent image carrier 2 to be constant at the predetermined voltage, and by controlling the voltage to be impressed to the writing electrode 3*b* to be switched between the predetermined voltage $V_0$ and the ground voltage $V_1$.

Though the predetermined voltage $V_0$ to be impressed to the writing electrode 3*b* is a direct current voltage in the aforementioned embodiment, an alternating current voltage may be superimposed on a direct current voltage. When an alternating current voltage is superimposed, it is preferable that a DC component is set to be a voltage to be impressed to the latent image carrier 2, the amplitude of AC component is set to be twice or more as large as the discharge starting voltage $V_{th}$, and the frequency of AC component is set to be higher than the frequency in rotation of the latent image carrier 2 by about 500–1,000 times (for example, assuming that the diameter of the latent image carrier 2 is 30ϕ and the peripheral velocity of the latent image carrier 2 is 180 mm/sec, the frequency in rotation of the latent image carrier 2 is 2 Hz so that the frequency of AC component is 1,000–2,000 Hz.).

By superimposing an alternating current voltage on a direct current voltage as mentioned above, the application or removal of charge via discharge of the writing electrode 3*b* is further stabilized. In addition, the writing electrode 3*b* vibrates because of the existence of the alternating current, thereby removing foreign matters adhering to the writing electrode 3*b* and thus preventing contamination of the writing electrode 3*b*.

Figure 5A:
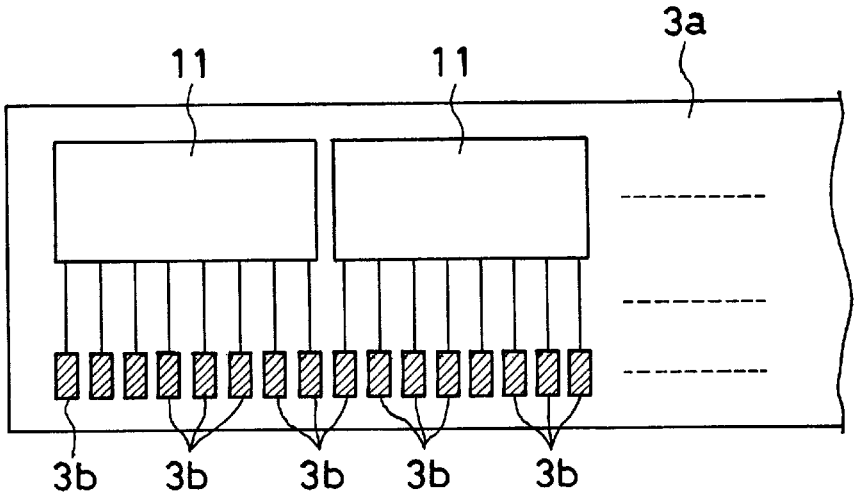
FIGS. 5(*a*)–5(*c*) show array patterns for arranging the writing electrodes of the writing device according to the present invention.
Figure 5B:
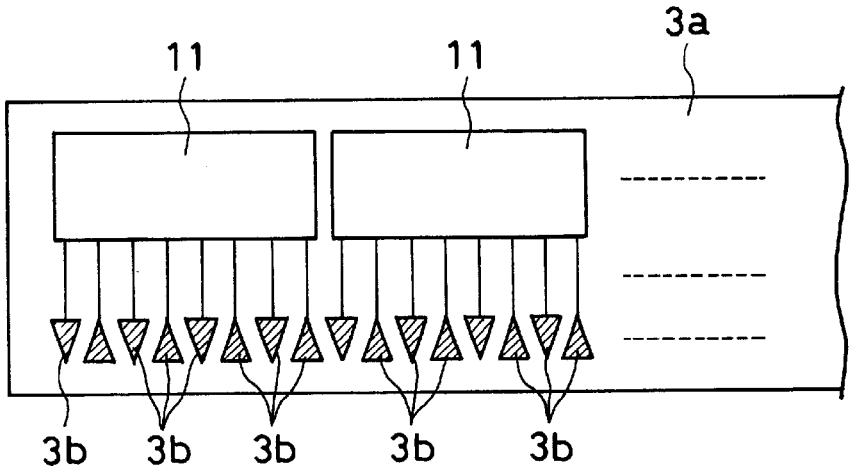
Figure 5C:
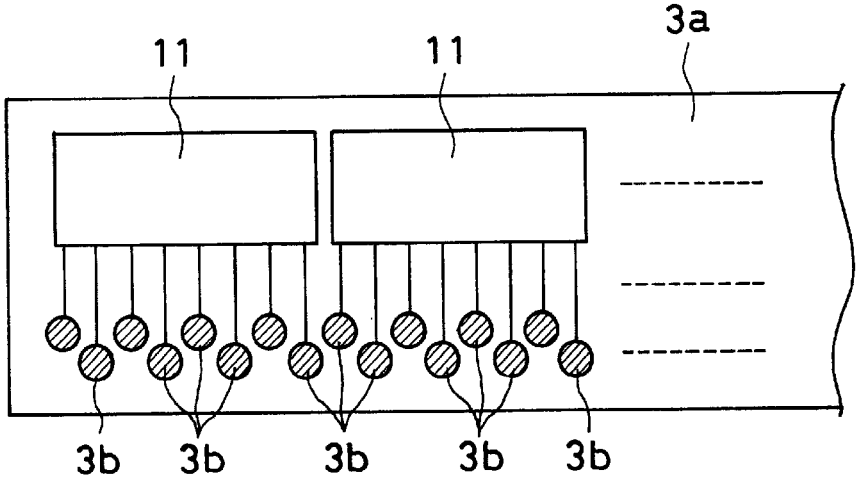

FIGS. 5(*a*)–5(*c*) show array patterns for arranging a plurality of electrodes 3*b* in the axial direction of the latent image carrier 2.

The simplest array pattern for the writing electrodes 3*b* is shown in FIG. 5(*a*). In this pattern, a plurality of rectangular writing electrodes 3*b* are aligned in an row extending in the axial direction of the latent image carrier 2 as shown in FIG. 5(*a*). In this case, among the writing electrodes 3*b*, a predetermined number (eight in the illustrated example) of writing electrodes 3*b* are connected to and thus united by a driver 11 which controls the corresponding electrodes 3*b* by switching the supply voltage between the predetermined voltage $V_0$ or the ground voltage $V_1$. Plural units of writing electrodes 3*b* are aligned in the same row extending in the axial direction of the latent image carrier 2.

However, when the rectangular electrodes 3*b* are simply aligned in one row extending in the axial direction of the latent image carrier 2 just like this pattern, there should be clearances between adjacent electrodes 3*b*. Portions of the surface of the latent image carrier 2 corresponding to the clearances can not be subjected to the application or removal of charge. Therefore, in the array pattern for the writing electrodes 3*b* shown in FIG. 5(*b*), the writing electrodes 3*b* are each formed in triangle and are alternately arranged in such a manner that the orientations of the adjacent electrodes 3*b* are opposite to each other. In this case, the electrodes are arranged such that ends of the triangle bases of adjacent electrodes which are opposed to each other are overlapped with each other in a direction perpendicular to the axial direction of the latent image carrier 2 (the rotational direction of the latent image carrier). The design of partially overlapping adjacent electrodes in the direction perpendicular to the axial direction of the latent image carrier 2 can eliminate such portions that are not subjected to the application or removal of charge as mentioned above, thereby achieving application or removal of charge relative to the entire surface of the latent image carrier 2. It should be noted that, instead of triangle, each electrode 3*b* may be formed in any configuration that allows adjacent electrodes to be partially overlapped with each other in the direction perpendicular to the axial direction of the latent image carrier, for example, trapezoid, parallelogram, and a configuration having at least one angled side among sides opposed to adjacent electrodes 3*b*.

In the array pattern for the writing electrodes 3*b* shown in FIG. 5(*c*), the writing electrodes 3*b* are each formed in circle and are aligned in two parallel rows (first and second rows) extending in the axial direction of the latent image carrier 2 in such a manner that the writing electrodes 3*b* are arranged in a zigzag fashion. In this case, the electrodes are arranged such that electrodes which are in different rows but adjacent to each other are partially overlapped with each other in the direction perpendicular to the axial direction of the latent image carrier 2. Also this array pattern can eliminate such portions in the surface of the latent image carrier 2 that are not subjected to the application or removal of charge as mentioned above, thereby achieving application or removal of charge relative to the entire surface of the latent image carrier 2. In this example, plural units are each formed of a predetermined number of electrodes 3*b* some of which are in the first row and the other are in the second row by connecting these electrodes 3*b* to one driver 11 and are aligned parallel to the axial direction of the latent image carrier 2. The respective drivers 11 are disposed on the same side of the corresponding electrodes 3*b*.

Figure 6:
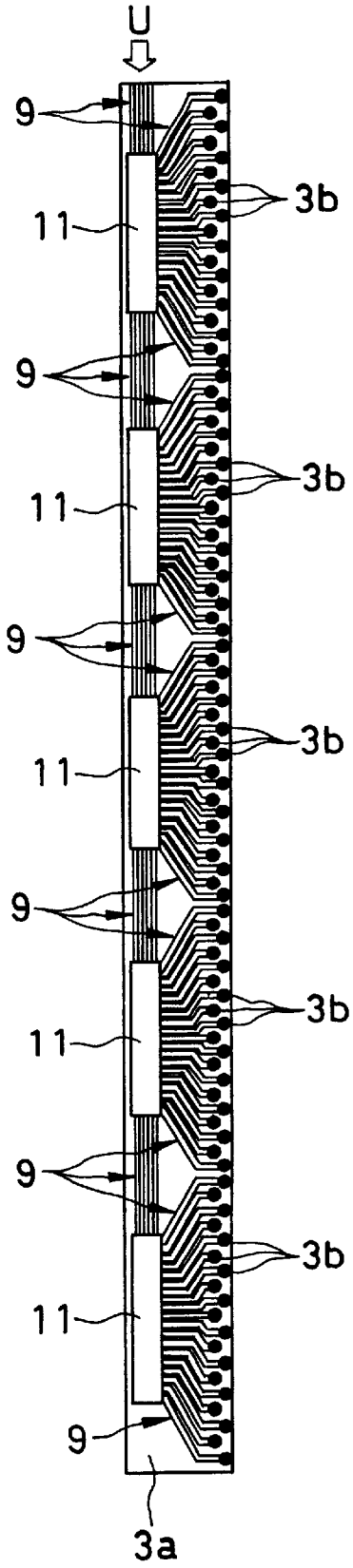
FIG. 6 is a plane view of the writing device according to the present invention.

As shown in FIG. 6, the respective drivers 11 are electrically connected by conductive patterns 9 made of copper foil which is formed on the substrate and each line of which is formed into a thin flat bar-like shape having a rectangular section. In the same manner, the drivers 11 are electrically connected to the corresponding electrodes 3*b* by the conductive patterns 9. The conductive patterns 9 can be formed by a conventional known film pattern forming method such as etching. By way of the conductive patterns 9, line data, writing timing signals, and high voltage power are supplied to the respective drivers 11 from the upper side U in FIG. 6.

Figure 7:
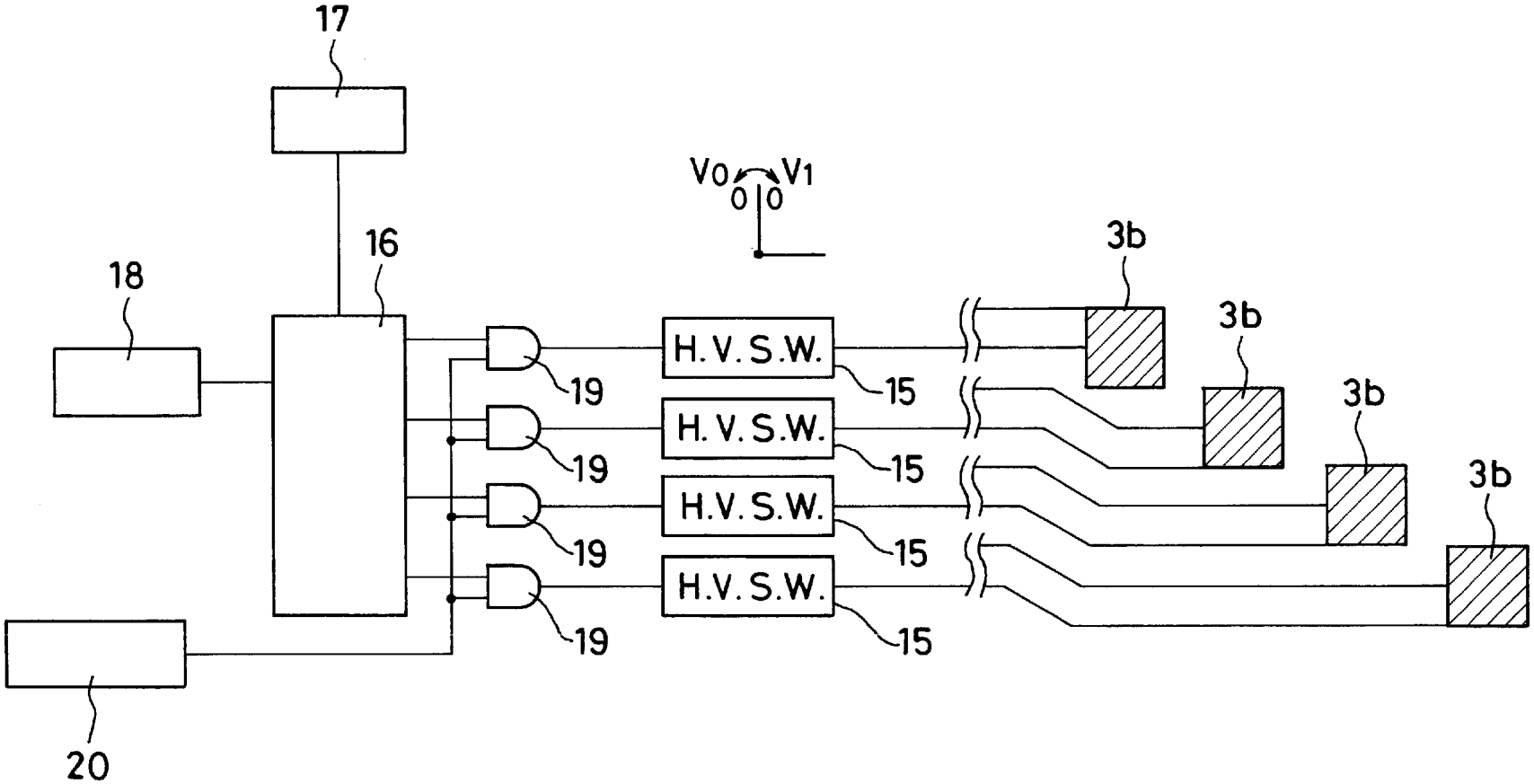
FIG. 7 is a diagram showing a switching circuit for switching the voltage to be connected to the writing electrodes between the predetermined voltage $V_0$ and the ground voltage $V_1$.

FIG. 7 is a diagram showing a switching circuit for switching the voltage to be connected to the writing electrodes 3*b* between the predetermined voltage $V_0$ and the ground voltage $V_1$. As shown in FIG. 7, the writing electrodes 3*b* which are arranged, for example, in four lines are connected to corresponding high voltage switches (H.V.S.W.) 15, respectively. Each of the high voltage switches 15 can switch the voltage to be supplied to the corresponding electrode 3*b* between the predetermined voltage $V_0$ and the ground voltage $V_1$. An image writing control signal is inputted into each high voltage switch 15 from a shift resistor (S.R.) 16, to which an image signal stored in a buffer 17 and a clock signal from a clock 18 are inputted. The image writing control signal is inputted into each high voltage switch 15 through each AND circuit 19 in accordance with a writing timing signal from an encoder 20. The high voltage switch 15 and the AND circuit 19 cooperate together to form the aforementioned driver 11 which controls the corresponding electrodes 3*b* by switching the supply voltage.

Figures 8A, 8B, 8C:
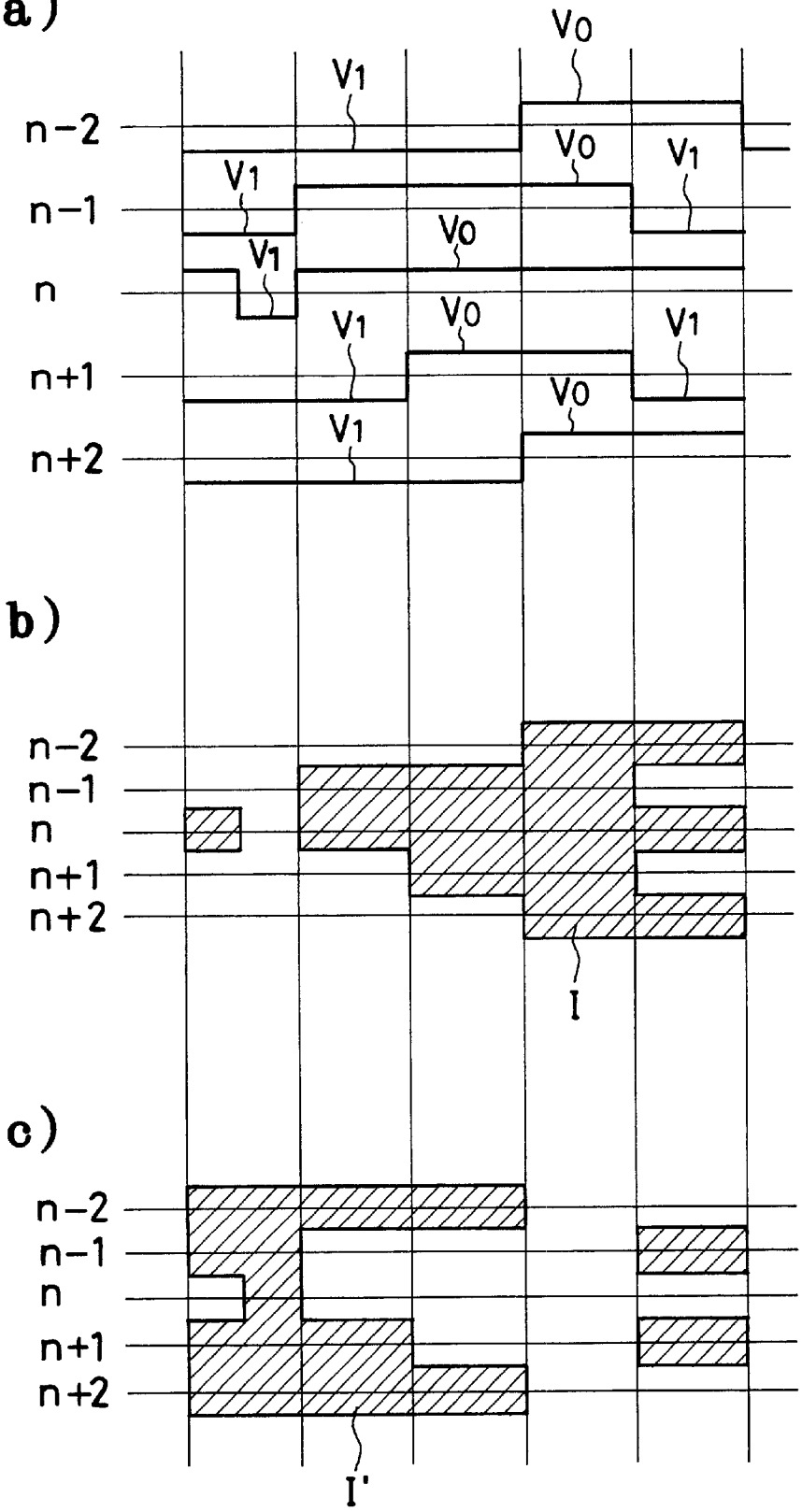
FIGS. 8(*a*)–8(*c*) show profiles when the supply voltage for each electrode is selectively controlled into the predetermined voltage $V_0$ or the ground voltage $V_1$ by switching operation of the corresponding high voltage switch, wherein FIG. 8(*a*) is a diagram showing the voltage profiles of the respective electrodes, FIG. 8(*b*) is a diagram showing a developing powder image obtained by normal developing with the voltage profiles shown in FIG. 8(*a*), and FIG. 8(*c*) is a diagram showing a developing powder image obtained by reverse developing with the voltage profiles shown in FIG. 8(*a*)

FIGS. 8(*a*)–8(*c*) show profiles when the supply voltage for each electrode is selectively controlled into the predetermined voltage $V_0$ or the ground voltage $V_1$ by switching operation of the corresponding high voltage switch 15, wherein FIG. 8(*a*) is a diagram showing the voltage profiles of the respective electrodes, FIG. 8(*b*) is a diagram showing a developing powder image obtained by normal developing with the voltage profiles shown in FIG. 8(*a*), and FIG. 8(*c*) is a diagram showing a developing powder image obtained by reverse developing with the voltage profiles shown in FIG. 8(*a*).

Assuming that the electrodes 3*b*, for example as shown in FIGS. 8(*a*)–8(*c*), five electrodes indicated by n−2, n−1, n, n+1, and n+2, respectively, are controlled to be into the voltage profiles shown in FIG. 8(*a*) by switching operation of the respective high voltage switches 15. When an electrostatic latent image is written on the latent image carrier 2 with the electrodes 3*b* having the aforementioned voltage profiles and is then developed normally, the developing powder 8 adheres to portions at the predetermined voltage $V_0$ of the latent image carrier 2, thereby obtaining a developing powder image I as shown by hatched portions in FIG. 8(*b*). When an electrostatic latent image is written in the same manner and is then developed reversely, the developing powder 8 adheres to portions at the ground voltage $V_1$ of the latent image carrier 2, thereby obtaining a developing powder image I' as shown by hatched portions in FIG. 8(*c*).

According to the image forming apparatus 1 employing the electric writing device 3 having the aforementioned structure, the writing electrodes 3*b* are supported by the flexible substrate 3*a* and are pressed lightly against and in contact with the latent image carrier 2 by weak elastic restoring force of the substrate 3*a*, thereby stably keeping the writing electrodes 3*b* in contact with the latent image carrier 2. Therefore, application of charge relative to the latent image carrier 2 by the writing electrodes 3*b* can be further stably conducted with high precision, thereby achieving stable writing of an electrostatic latent image and thus reliably obtaining a high quality image with high precision.

Since the writing electrodes 3*b* are kept in contact with the latent image carrier 2 by a small pressing force, the latent image carrier 2 can be prevented from being damaged by the writing electrodes 3*b*, thus improving the durability of the latent image carrier 2. Further, since the writing device 3 employs only the writing electrodes 3*b* without using a laser beam generating device or a LED light generating device which is large in size as conventionally used, the apparatus size can be reduced and the number of parts can also be reduced, thereby obtaining an image forming apparatus which is simple and low-price. Furthermore, generation of ozone can be further reduced by the writing electrodes 3*b*.

Figure 9:
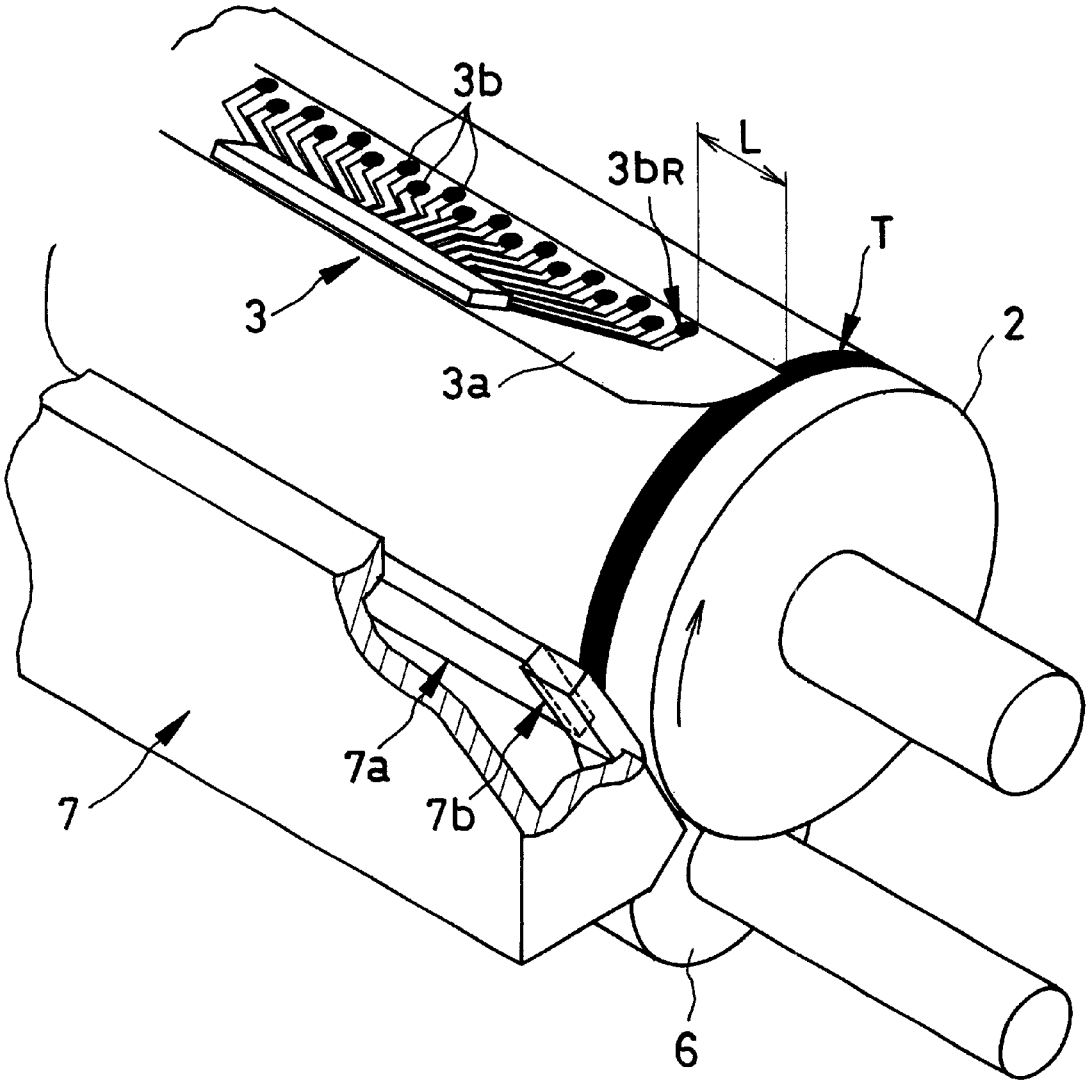
FIG. 9 is a perspective view partially showing an image forming apparatus for explaining a problem to be solved by the present invention.
Figure 10:
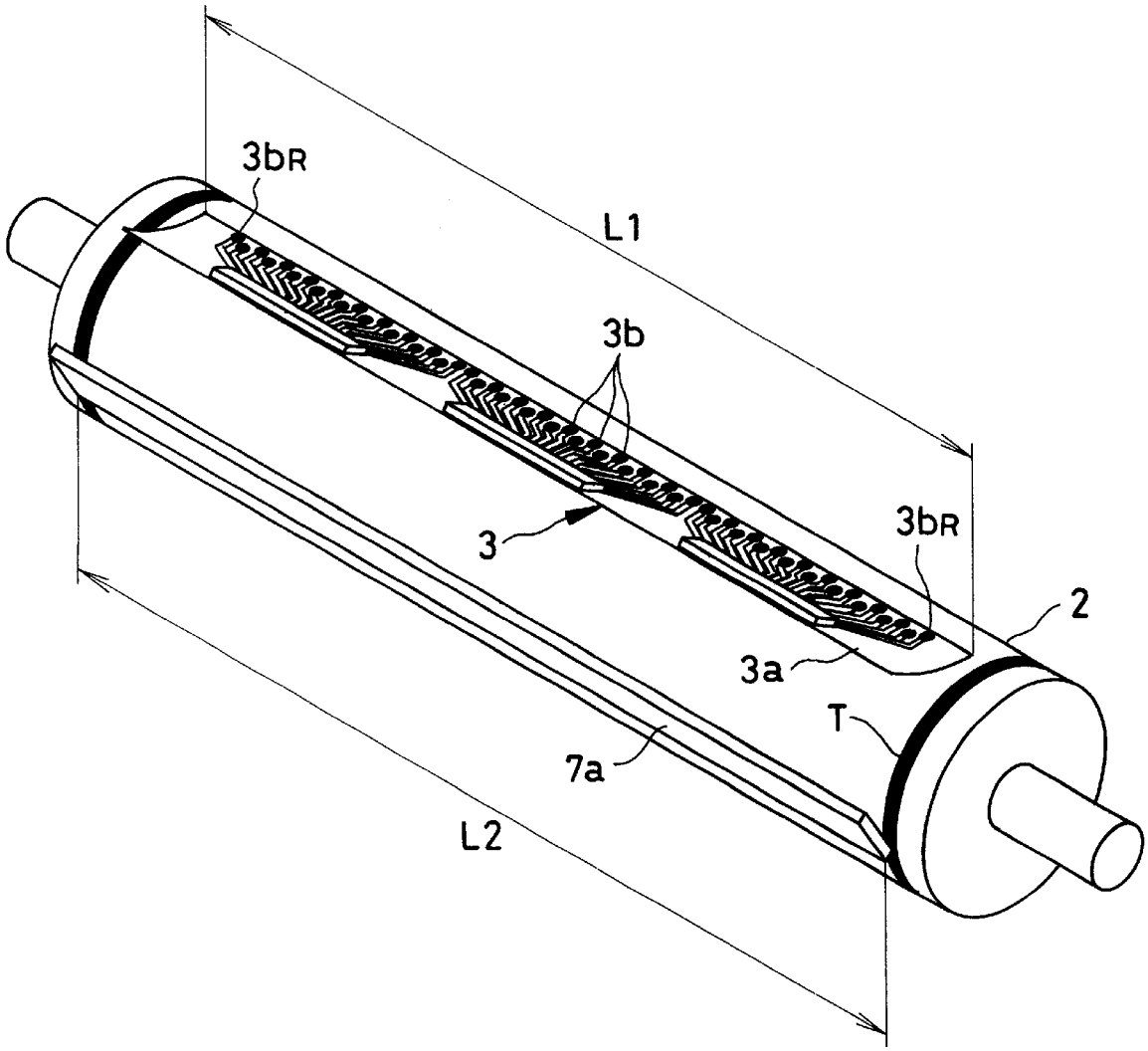
FIG. 10 is a perspective view partially showing an embodiment of the image forming apparatus according to the present invention.

FIG. 9 is a perspective view partially showing an image forming apparatus for explaining a problem to be solved by the present invention, and FIG. 10 is a perspective view partially showing an embodiment of the image forming apparatus according to the present invention.

The image forming apparatus of the present invention comprises an electric writing device 3, a developing device, a transferring device 6, and a cleaning device 7 which are arranged around the periphery of a latent image carrier 2, as shown in FIG. 9. The electric writing device 3 comprises a flexible substrate 3*a* having elasticity of which one end is fixed to a fixing portion 9 (FIG. 1(A)) and the other end is in elastic contact with the latent image carrier 2, and writing electrodes 3*b* disposed on a portion along the other end (on the latent image carrier side) of the substrate 3*a*.

In the writing device 3, a length L between a distal electrode 3*b*R of the writing electrodes 3*b* and a side edge of the substrate 3*a* is required to be so long as to stabilize the contact of the distal electrode 3*b*R. Without enough length L, the pressing force onto the distal electrode 3*b*R and the writing electrodes near the distal electrode 3*b*R against the latent image carrier 2 should be smaller than that of the writing electrodes located at a middle portion. In this case, homogeneous application of charge for writing can not be achieved. On the other hand, in the cleaning device 7 disposed downstream of the transferring device 6, it is impossible to completely seal toner at contact boundary faces between a cleaning blade 7*a* and an end seal 7*b* so as to produce leakage toner T which adheres to the latent image carrier 2. The leakage toner normally has the same polarity (generally, positive (+) polarity) as that of the transferring bias because the leakage toner is affected by the transferring bias.

Because of the great length L, however, the leakage toner T passes under the substrate 3*a* so as to adhere to contact portions between the writing electrodes 3*b* and the latent image carrier 2, causing variation in the gap between the electrodes and the latent image carrier 2. This variation leads to image irregularities.

In order to solve the aforementioned problem, according to the present invention, the substrate 3*a* of the electric writing device 3 is arranged within the range of the cleaning blade 7*a*. That is, assuming the contact width of the substrate 3*a* relative to the latent image carrier 2 as L1 and the contact width of the cleaning blade 7*a* relative to the latent image carrier 2 as L2 as shown in FIG. 10, the relation L1<L2 is satisfied. Therefore, the leakage toner T at the end seal of the cleaning device is prevented from moving to a position under the substrate 3*a*, thereby preventing error in writing an electrostatic latent image caused by the leakage toner T adhering to the distal electrode 3*b*R. Though this embodiment employs the cleaning blade 7*b*, any cleaning means such as a cleaning brush and a cleaning roller may be employed.

According to the present invention, contact between the electrode portion (composed of the writing electrodes) and the latent image carrier is stabilized so as to enable homogeneous writing by selective application of charge, thereby obtaining a high quality image without image irregularities nor linear stains. Leakage toner T at the end seal of the cleaning device can be prevented from adhering to the writing electrodes, thereby preventing error in writing an electrostatic latent image caused by the leakage toner T adhering to the writing electrodes.

Figure 11A:
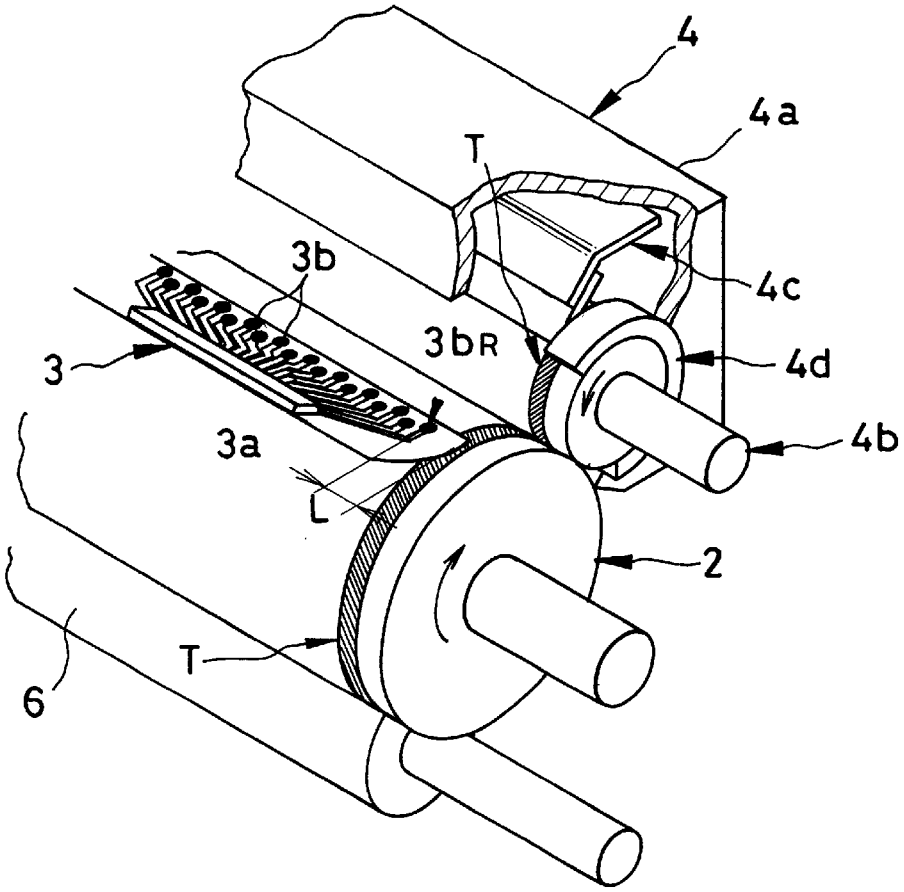
Figure 11B:
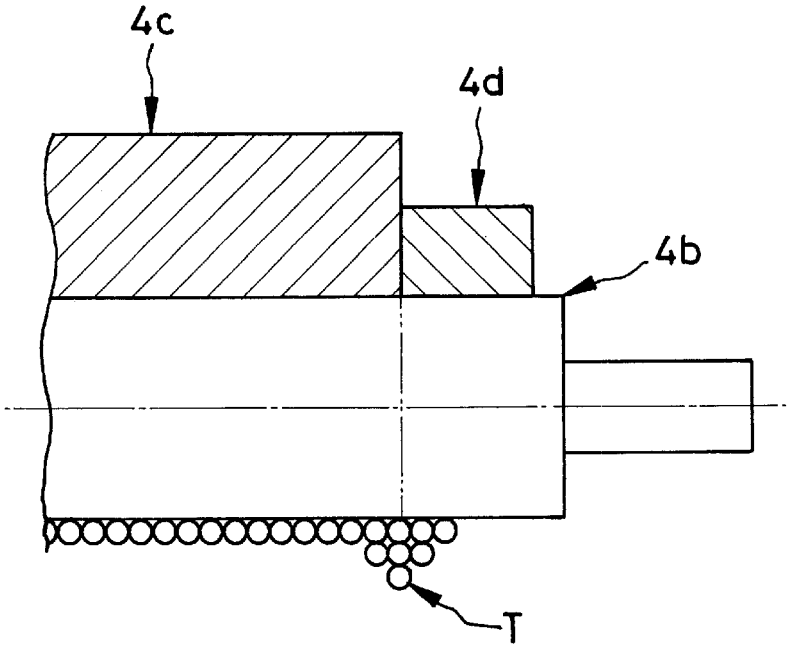

FIGS. 11(A), 11(B) are views for explaining another problem to be solved by the present invention, wherein FIG. 11(A) is a perspective view showing an example of an image forming device using an electric writing device and FIG. 11(B) is a partial sectional view of FIG. 11(A).

Arranged around a latent image carrier 2 are an electric writing device 3, a developing device 4, and a transferring device 6 as shown in FIG. 11(A), and also a cleaning device 7 as shown in FIG. 11(B). The electric writing device 3 comprises a flexible substrate 3*a* having elasticity of which one end is fixed to a fixing portion 9 (FIG. 1(A)) and the other end is in elastic contact with the latent image carrier 2, and writing electrodes 3*b* disposed on a portion along the other end (on the latent image carrier side) of the substrate 3*a*. The developing device 4 comprises a developing housing 4*a*, a developing roller 4*b*, and a toner control blade 4*c*. End seals 4*d* are fitted to the ends of the developing housing 4*a* and the developing roller 4*d* to prevent leakage of toner.

In the developing device 4, it is impossible to completely seal toner at contact boundary faces between the toner control blade 4*c* and the end seal 4*d* to produce leakage toner T which adheres to the latent image carrier 2 as shown in FIG. 11(B). It is normally designed so that the leakage toner T is located outside of a receiving medium in the width direction not to be transferred to the receiving medium. The leakage toner T has charge of the same polarity (generally, negative (−) polarity) as that of the toner on the developing roller 4*b*.

Because of the great length L, however, the leakage toner T passes under the substrate 3*a* so as to adhere to contact portions between the writing electrodes 3*b* and the latent image carrier 2, causing variation in the gap between the electrodes and the latent image carrier 2. This variation leads to image irregularities.

Figure 12:
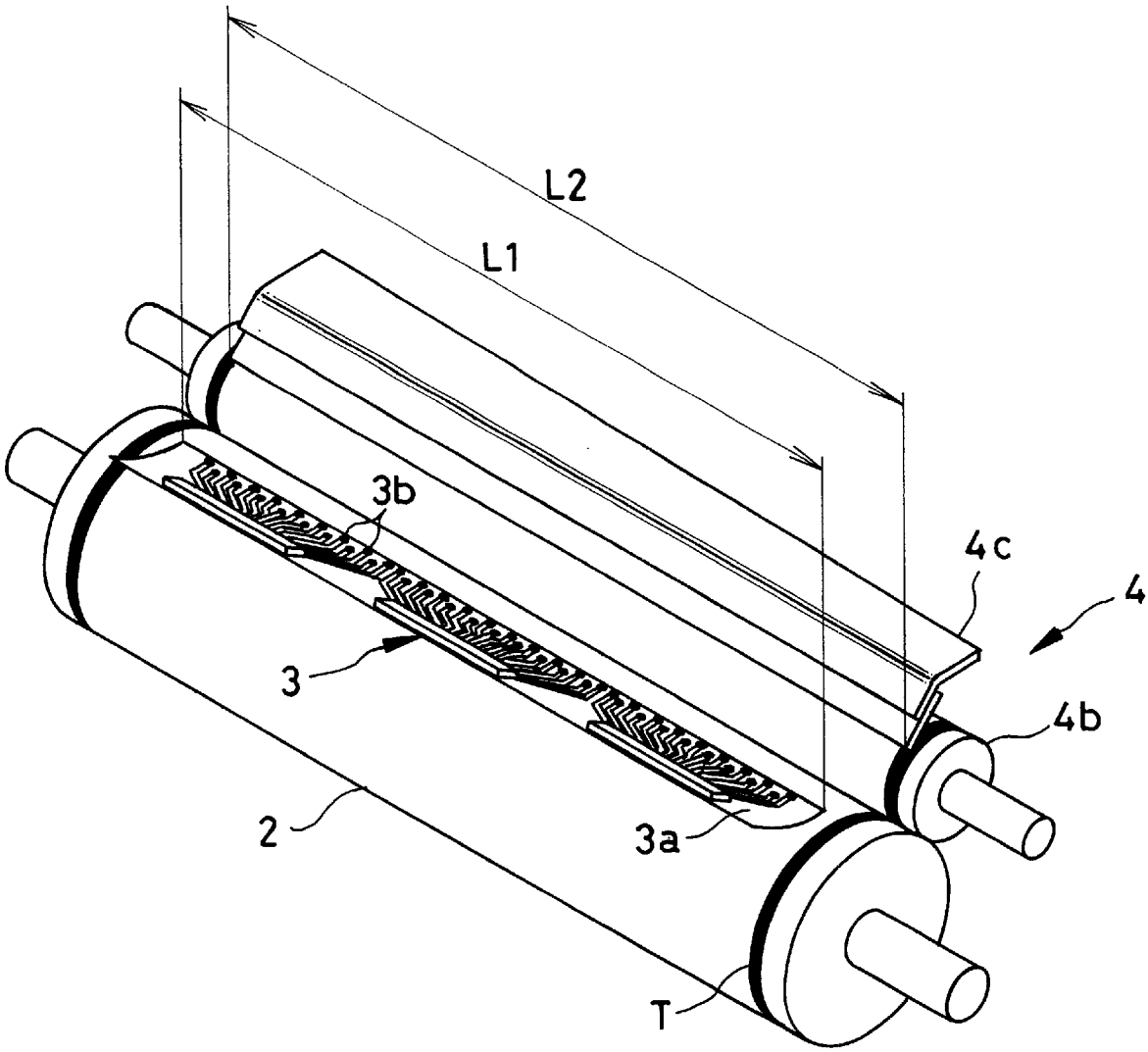
FIG. 12 is a perspective view partially showing another embodiment of the image forming apparatus according to the present invention.

In order to solve the aforementioned problem, according to the present invention, the substrate 3*a* of the electric writing device 3 is arranged within the range of the toner control blade 4*c* of the developing device 4. That is, assuming the contact width of the substrate 3*a* relative to the latent image carrier 2 as L1 and the contact width (the toner carrying width of a developing means) of the developing roller 4*b* of the toner control blade 4*c* relative to the latent image carrier 2 as L2 as shown in FIG. 12, the relation L1<L2 is satisfied. Therefore, the leakage toner T at the end seal of the developing device is prevented from moving to a position under the substrate 3*a*, thereby preventing error in writing an electrostatic latent image caused by the leakage toner T adhering to the distal electrode 3*b*R as described with regard to FIGS. 11(A), 11(B).

According to the present invention, contact between the electrode portion (composed of the writing electrodes) and the latent image carrier is stabilized so as to enable homogeneous writing by selective application of charge, thereby obtaining a high-quality image without image irregularities nor linear stains. Leakage toner T at the end seal of the developing device can be prevented from adhering to the writing electrodes, thereby preventing error in writing an electrostatic latent image caused by the leakage toner T adhering to the writing electrodes.

Figure 13:
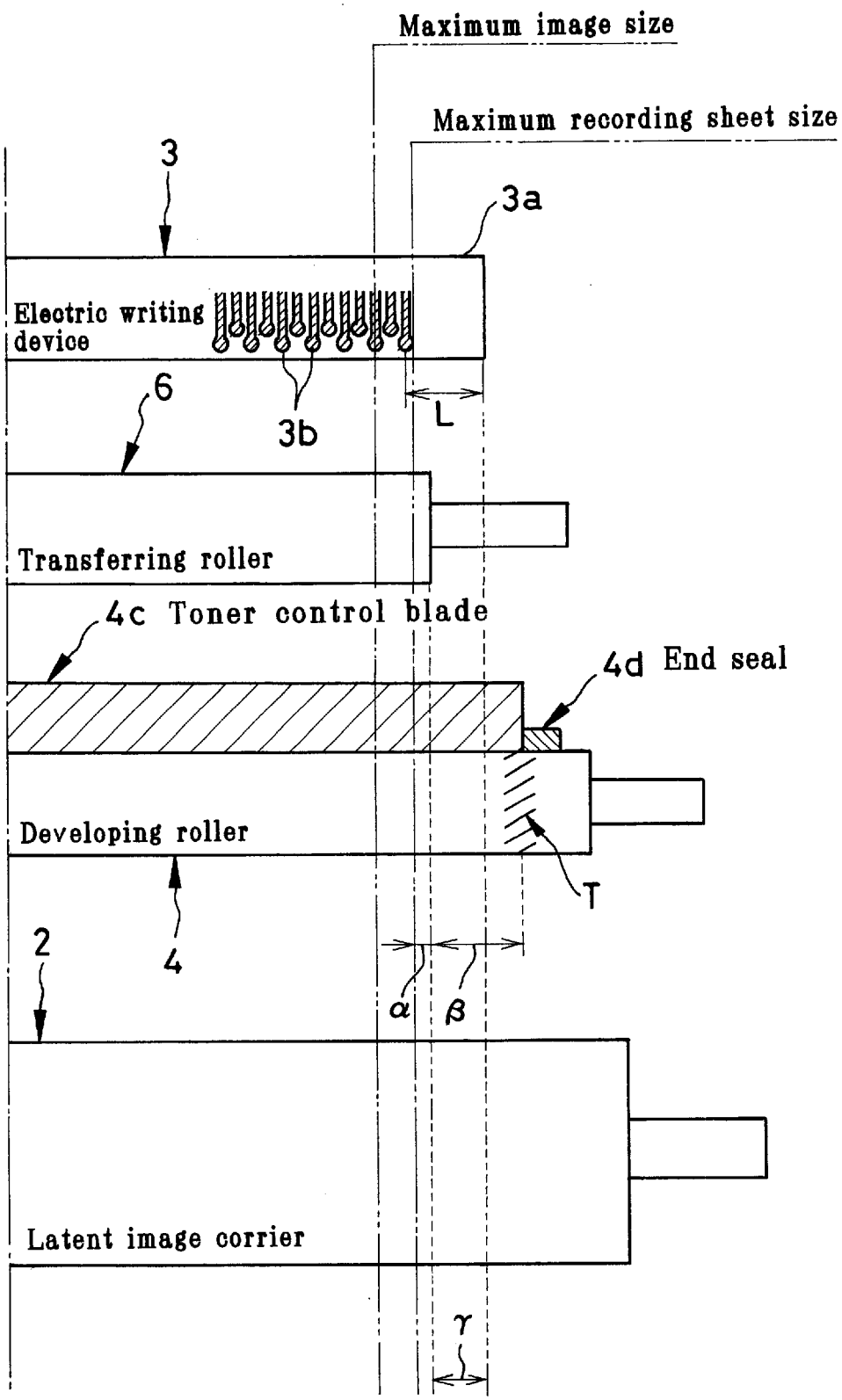
FIG. 13 is a view for explaining still another problem to be solved by the present invention and for explaining the width dimensions of the respective components.

As shown in FIG. 13, even when the width of the electric writing device 3 is set smaller than the width of the toner control blade 4*c*, the transferring roller of the transferring device 6 is required to have such a width obtained by adding an allowance for the sheet feeding accuracy to the width of the maximum recording sheet size. To prevent the leakage toner T from adhering to the transferring roller, the width of the transferring roller should be smaller than that of the toner control blade 4*c*. The width of the latent image carrier 2 should be the largest among the other components mentioned above. When the width dimensions are set in the manner as mentioned above, remainder toner adheres to the transferring roller in α region a between an end of the largest recording sheet and an end of the transferring roller. In addition, even after transfer to the recording sheet, remainder toner exists on the latent image carrier 2 in a region β between the end of the transferring roller and the end of the toner control blade 4*c*. Further, remainder toner in a region γ between the end of the transferring roller and the end of the electric writing device 3 adheres to the end of the electric writing device 3 little by little, whereby the contact of the writing electrodes 3*b* near the side edge becomes unsteady with time, thus causing variation in the gap between the electrodes and the latent image carrier 2. This variation leads to image irregularities.

Figure 14:
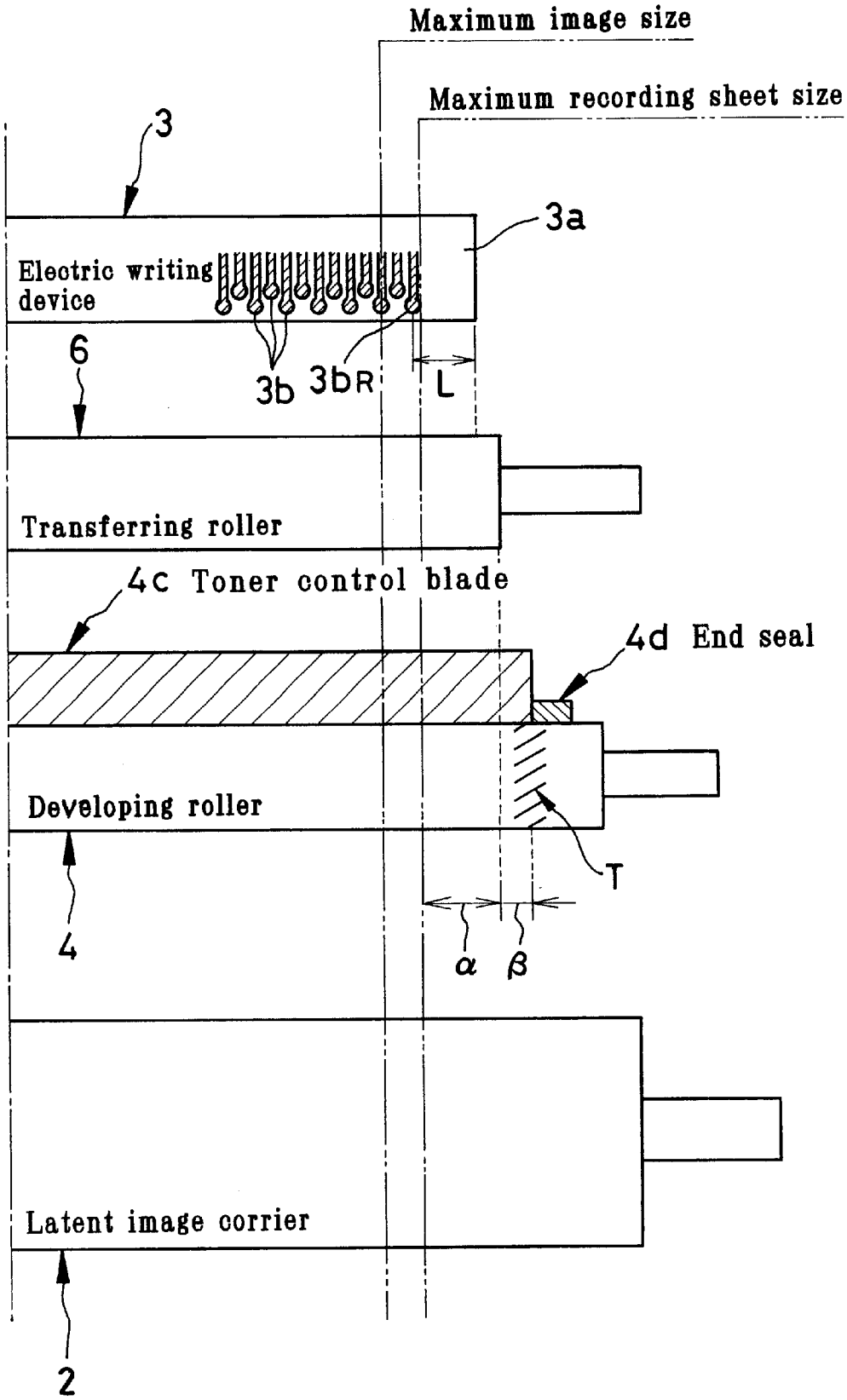
FIG. 14 is a view showing another embodiment of the image forming apparatus according to the present invention for explaining the width dimensions of the respective components.
Figure 15:
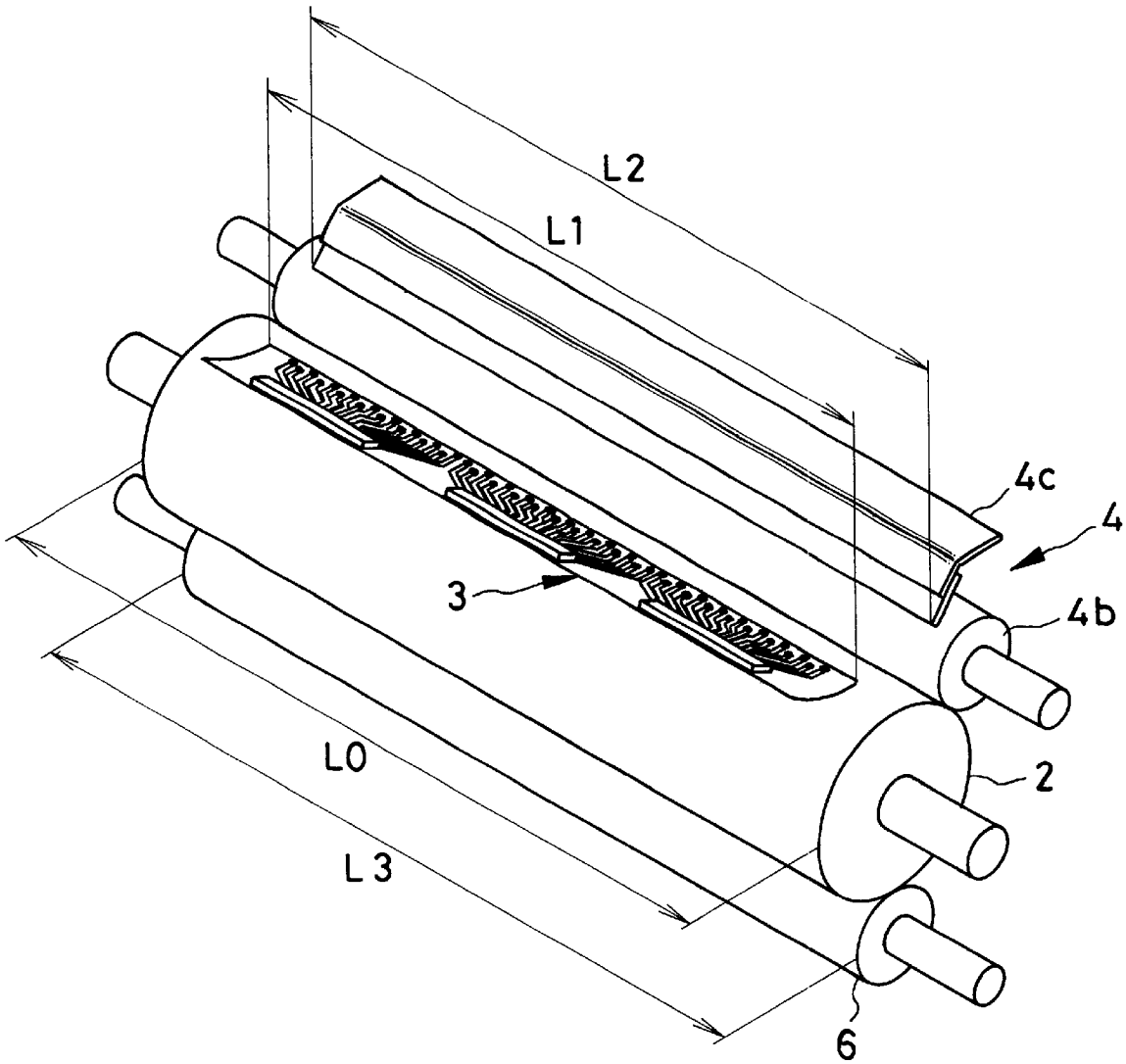
FIG. 15 is a perspective view partially showing the embodiment of the image forming apparatus according to the present invention shown in FIG. 14.

In order to solve this problem, as shown in FIG. 14, the length L between the distal electrode 3*b*R of the writing electrodes 3*b* and the end of the substrate 3*a* is set to be so great as to stabilize the contact of the distal electrode 3*b*R, and the width of the electric writing device 3 is set to be smaller than the width of the transferring roller of the transferring device 6. The width of the transferring roller should be a width obtained by adding an allowance for the sheet feeding accuracy to the width of the maximum recording sheet size. The width of the transferring roller is set to be smaller than the width of the toner control blade 4*c* to prevent leakage toner T at the end seal from adhering to the transferring roller. The width of the latent image carrier 2 should be the largest among the other components mentioned above to allow the respective components to stably contact with the latent image carrier 2.

When the respective components are set to have the width dimensions to satisfy the aforementioned conditions, the remainder toner produced in a region α between the end of the maximum recording sheet and the end of the transferring roller can be attracted to the transferring roller. The remainder toner produced in a region β between the end of the transferring roller and the end of the toner control blade 4*c* still exist on the latent image carrier 2 even after transfer to the recording sheet, but does not affect the electric writing device 3. Since the width of the electric writing device 3 is set to be smaller than the width of the transferring roller of the transferring device 6, there is no region γ described with regard to FIG. 13. Therefore, residual toner on non-image portions at both ends of the developing device 4 can be prevented from adhering to portions at the ends of the writing device 3.

To summarize the relations mentioned above, assuming the contact width of the electric writing device 3 relative to the latent image carrier as L1, the toner carrying width of the developing device 4 confronting the latent image carrier as L2, the width of the latent image carrier as L0, and the width of the transferring device 6 as L3, it is required to satisfy both of the relation L1<L2 and the relation L1<L3. It is preferable to satisfy the relation L1<L3<L2.

Figure 16:
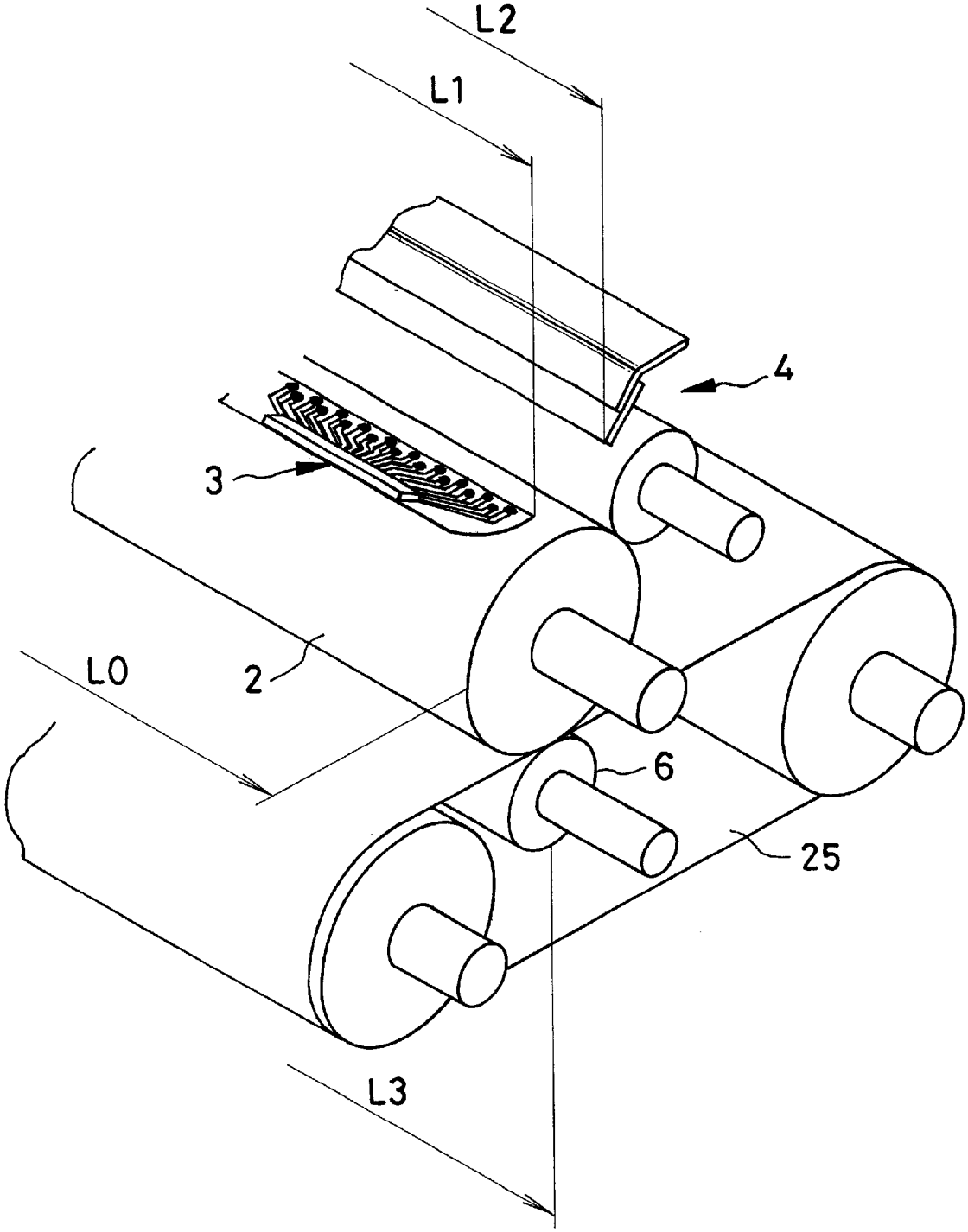
FIG. 16 is a view showing an example to which the present invention is applied to an image forming apparatus using an intermediate transferring belt.

FIG. 16 shows an example in which the present invention is applied to an image forming apparatus using an intermediate transferring belt 25. In this example, assuming the contact width of the electric writing device 3 relative to the latent image carrier as L1, the toner carrying width of the developing device 4 confronting the latent image carrier as L2, the width of the latent image carrier 2 as L0, and the width of the transferring device 6 as L3, it is required to satisfy both of the relation L1<L2 and the relation L1<L3. It is preferable to satisfy the relation L1<L3<L2.

According to the present invention, contact between the electrode portion (composed of the writing electrodes) and the latent image carrier is stabilized so as to enable homogeneous writing by selective application of charge, thereby obtaining a high-quality image without image irregularities nor linear stains. Remainder toner left on non-image portions at the both ends of the developing means can be prevented from adhering to the writing electrodes, thereby preventing error in writing an electrostatic latent image caused by the remainder toner adhering to the writing electrodes.

Figure 17:
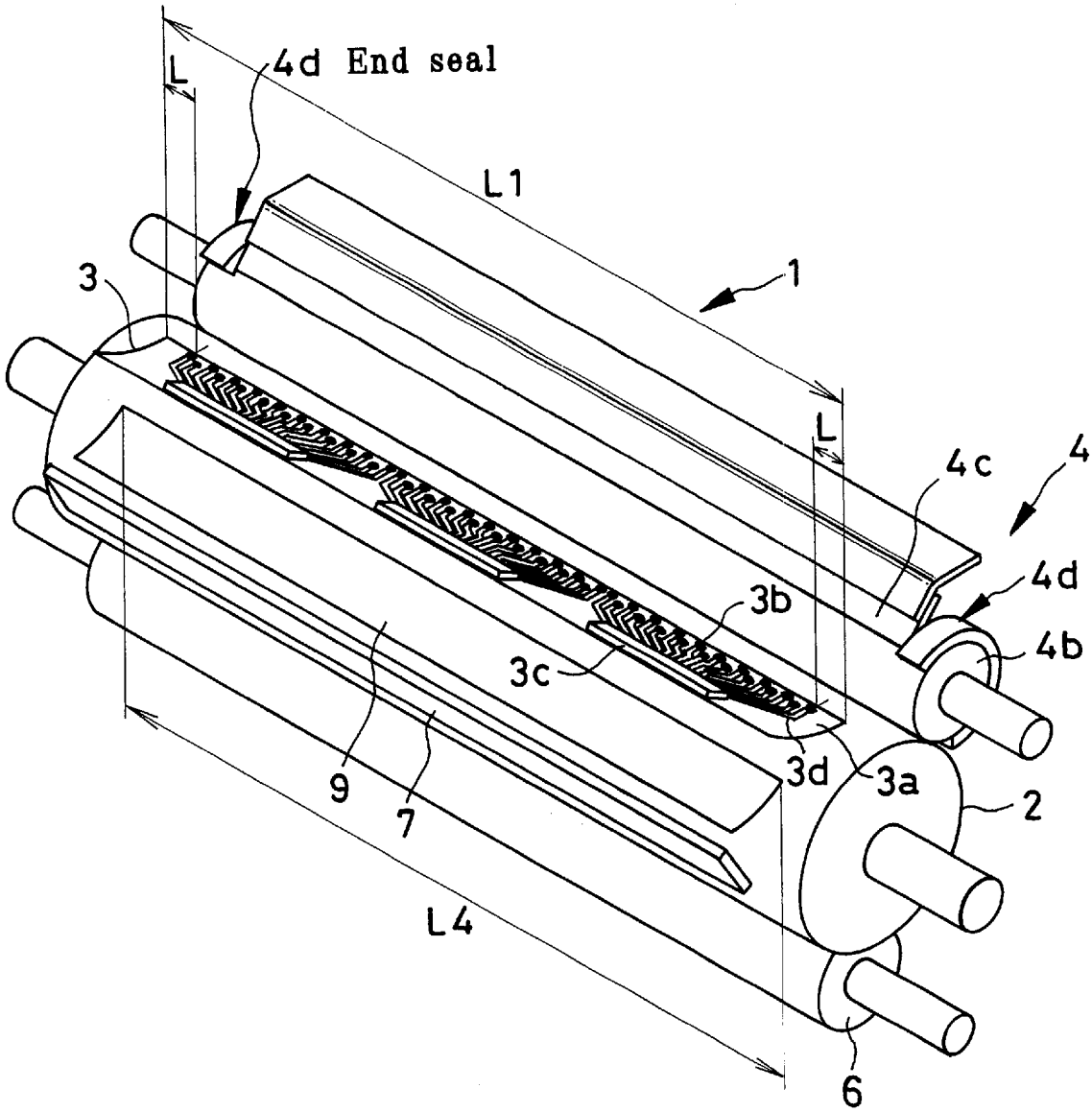
FIG. 17 is a perspective view partially showing another embodiment of the image forming apparatus according to the present invention.
Figure 20:
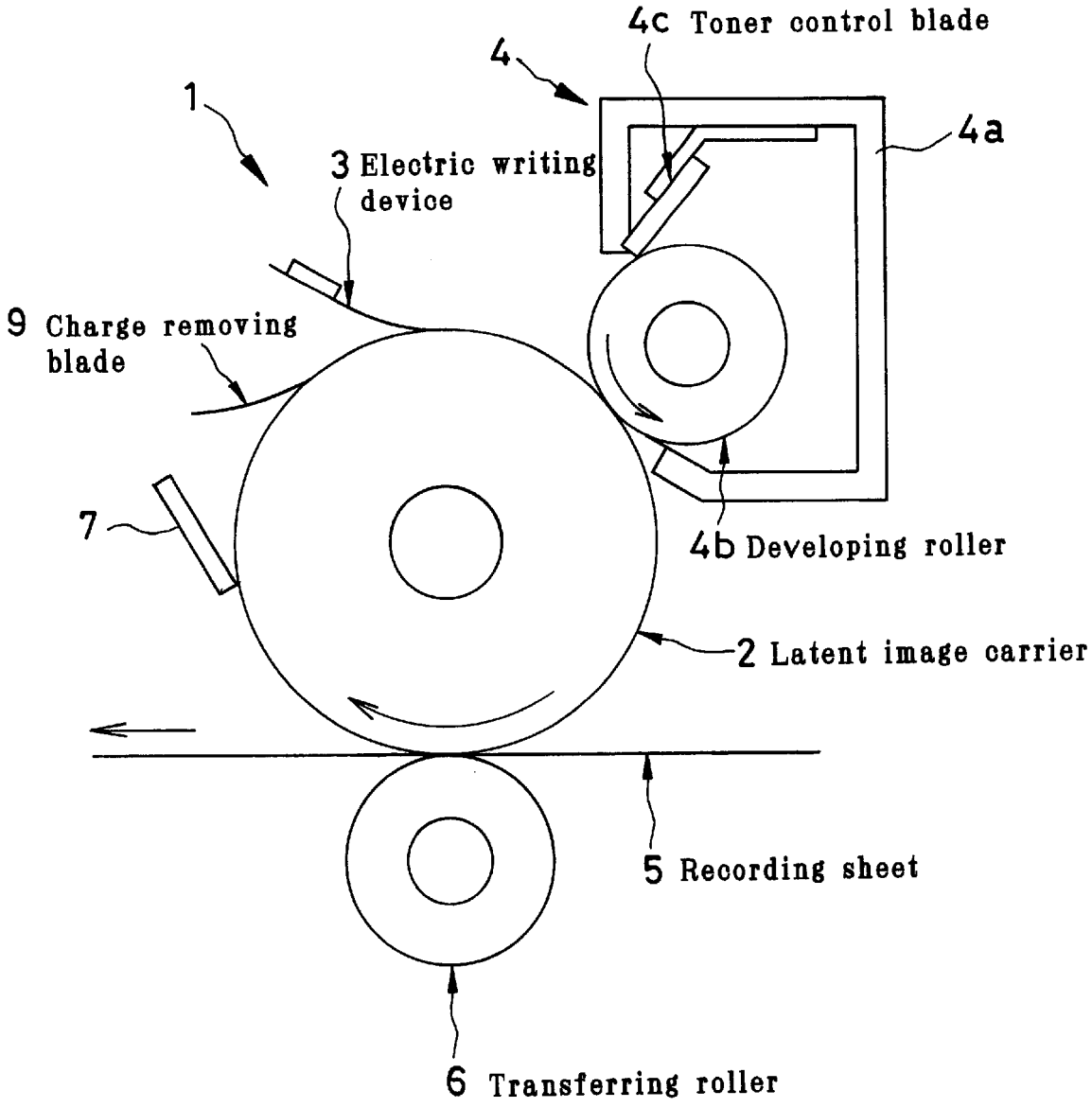
FIG. 20 is a sectional view showing a structural example of an image forming apparatus employing a charge removing blade as the charge removing means.

An image forming apparatus shown in FIG. 17 and FIG. 20 comprises, at least, a latent image carrier 2 on which an electrostatic latent image is formed, an electric writing device 3 which is arranged in contact with the latent image carrier 2 to write the electrostatic latent image onto the latent image carrier 2, a developing device 4 which develops the electrostatic latent image on the latent image carrier 2 with toner, a transferring roller 6 which transfers the image developed by the developing device 4, i.e. a toner image, on the latent image carrier 2 to a recording sheet 5 such as a paper, a cleaning blade 7 which remove residual toner left on the latent image carrier 2 after the transfer, and a charge removing blade 9 which re move charge from the latent image carrier 2 and from the residual toner left on the latent image carrier 2 after the cleaning. The electric writing device 3 is supported, at its one end, by a fixing portion in the cantilevered form and is, at its other end, in contact with the latent image carrier 2.

In the image forming apparatus according to the present invention, the electric writing device 3 has a plurality of writing electrodes 3*b* which are arranged in contact with or proximity to the latent image carrier 2 along the axial direction of the latent image carrier 2. A slight amount of residual toner is left on the latent image carrier 2 after the transfer. There are potential differences in the residual toner along the width direction of the latent image carrier 2 so t hat particles of the residual toner may inhomogeneously adhere to contact portion between the electric writing device 3 and the latent image carrier 2. The inhomogeneous adhering damages the formation of a latent image. Therefore, the width L4 of the charge removing blade 9 is set to be larger than the width L1 of the electric writing device 3 so as to efficiently remove charge, thus avoiding the aforementioned damaging factor. It should be noted that "L" designates a length from a side edge of the substrate 3*a* of the electric writing device 3 to a distal electrode. The length L exists at both ends of the substrate 3*a* to stabilize the pressing force to the distal electrodes 3*b*R.

Figures 19A, 19B, 19C, 19D:
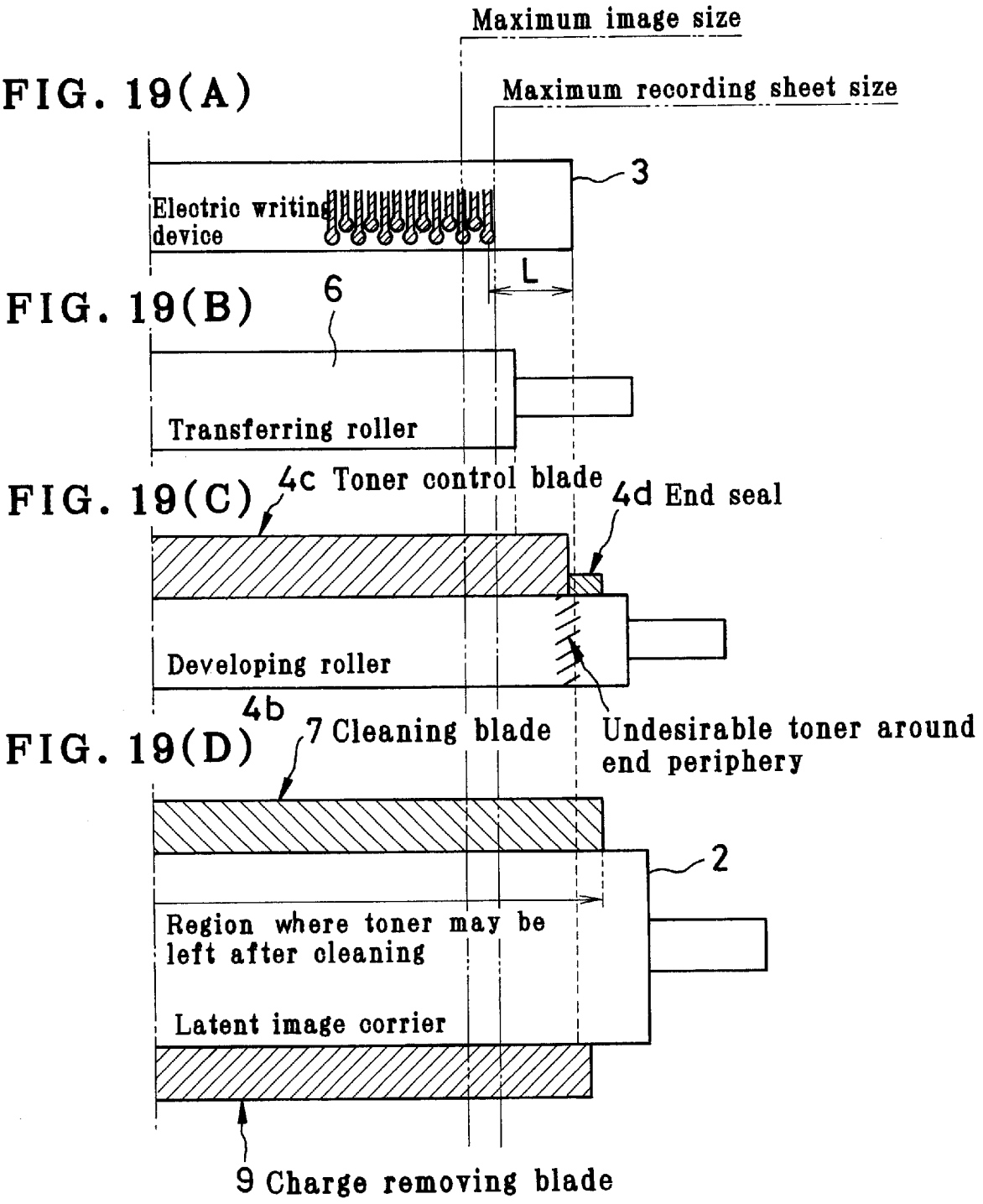
FIGS. 19(A)–19(D) are views for explaining the efficiency of the charge removing blade by preventing residual toner after cleaning from entering into the electric writing device.

Now, description will be made as regard to the efficiency of removing charge obtained by setting the width L4 of the charge removing blade 9 to be larger than the width L1 of the electric writing device 3. FIGS. 11(A), 11(B) are views for explaining occurrence of undesirable toner around the end periphery, FIG. 18 is a view for explaining a problem caused by that charge of residual toner left after cleaning is not removed, and FIG. 19 is a view for explaining the efficiency of the charge removing blade by preventing residual toner after cleaning from entering into the electric writing device.

The electric writing device 3 is provided with auxiliary wiring electrodes for adjusting the position of image relative to the maximum image size. The substrate 3*a* is provided with margins (length) L outside of the distal electrodes 3*b*R to stabilize the contact of the distal electrodes 3*b*R relative to the latent image carrier 2 as shown in FIG. 17, FIG. 11(A), (A) of FIG. 18, and (A) of FIG. 19. Without the margins L, the pressing force of the distal electrodes 3*b*R and the writing electrodes near the distal electrodes 3*b*R against the latent image carrier 2 should be smaller than that of the writing electrodes located at a middle portion. In this case, homogeneous application of charge for writing can not be achieved. On the other hand, as also shown in FIG. 11(B), it is impossible to completely seal toner at contact boundary faces between a toner control blade 4*c* of the developing device 4 and an end seal 4*b* so as to produce leakage toner T which adheres to the latent image carrier 2.

In a relationship relative to the electric writing device 3 as mentioned above, the transferring roller 6 is required to have a width obtained by adding an allowance for the sheet feeding accuracy to the width of the maximum recording sheet size as shown in (B) of FIG. 18. To prevent undesirable toner around the end periphery from adhering to the transferring roller 6, the width of the toner control blade 4*c* is set larger than the width of the transferring roller 6 as shown in (C) of FIG. 18. Further, to collect undesirable toner around the end periphery, the width of the cleaning blade 7 is set larger than the width of the toner control blade 4*c* as shown in (D) of FIG. 18. However, a slight amount of toner may not be cleaned. With satisfying these conditions, the width of the latent image carrier 2 should be the largest among the other components.

In general, the charge removing blade 9 is enough to have a width larger than the width of the maximum recording sheet size. However, a region on which charge of toner can not be removed is created outside of the charge removing blade 9. Therefore, when the width L4 of the charge removing blade 9 is smaller than the width L1 of the electric writing device 3, a region $\alpha$ as the difference in width is created which allows residual toner after cleaning having inhomogeneous potentials to enter into the electric writing device 3. That is, toner in this region $\alpha$ enters into the margin L of the electric writing device 3 little by little and is thus deposited on the margin L little by little, whereby the contact of the writing electrodes 3*b* near the side edge becomes unsteady with time. This unsteady contact leads to image irregularities.

Therefore, as shown in (D) of FIG. 19, according to the present invention, the width L4 of the charge removing blade 9 is set larger than the width L1 of the electric writing device 3, thereby preventing residual toner after cleaning having inhomogeneous potentials from entering into the electric writing device 3 and thus achieving steady formation of images regardless of operating time.

Figure 21:
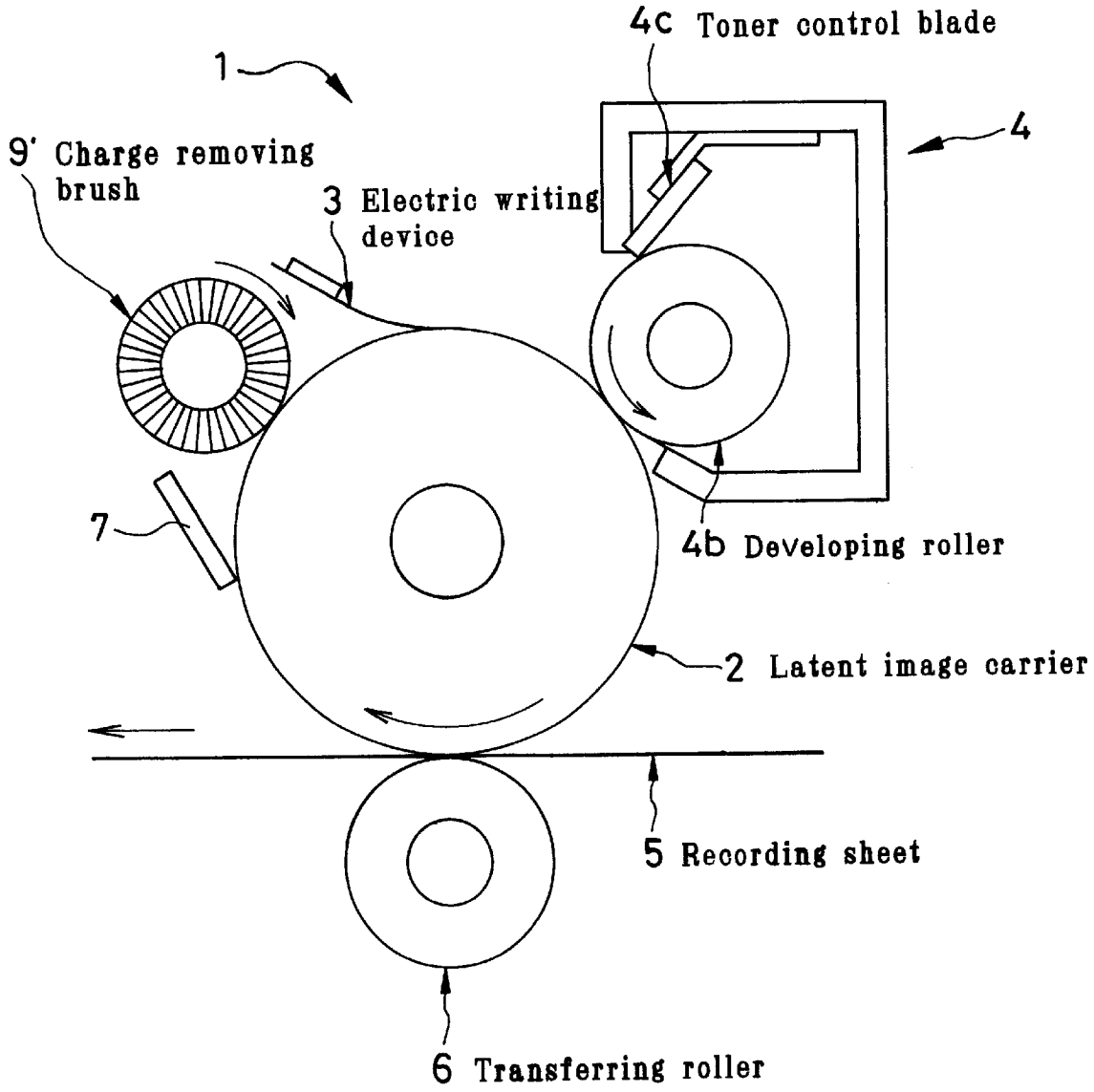
FIG. 21 is a view showing a structural example of an image forming apparatus employing a charge removing brush as the charge removing means.
Figure 22:
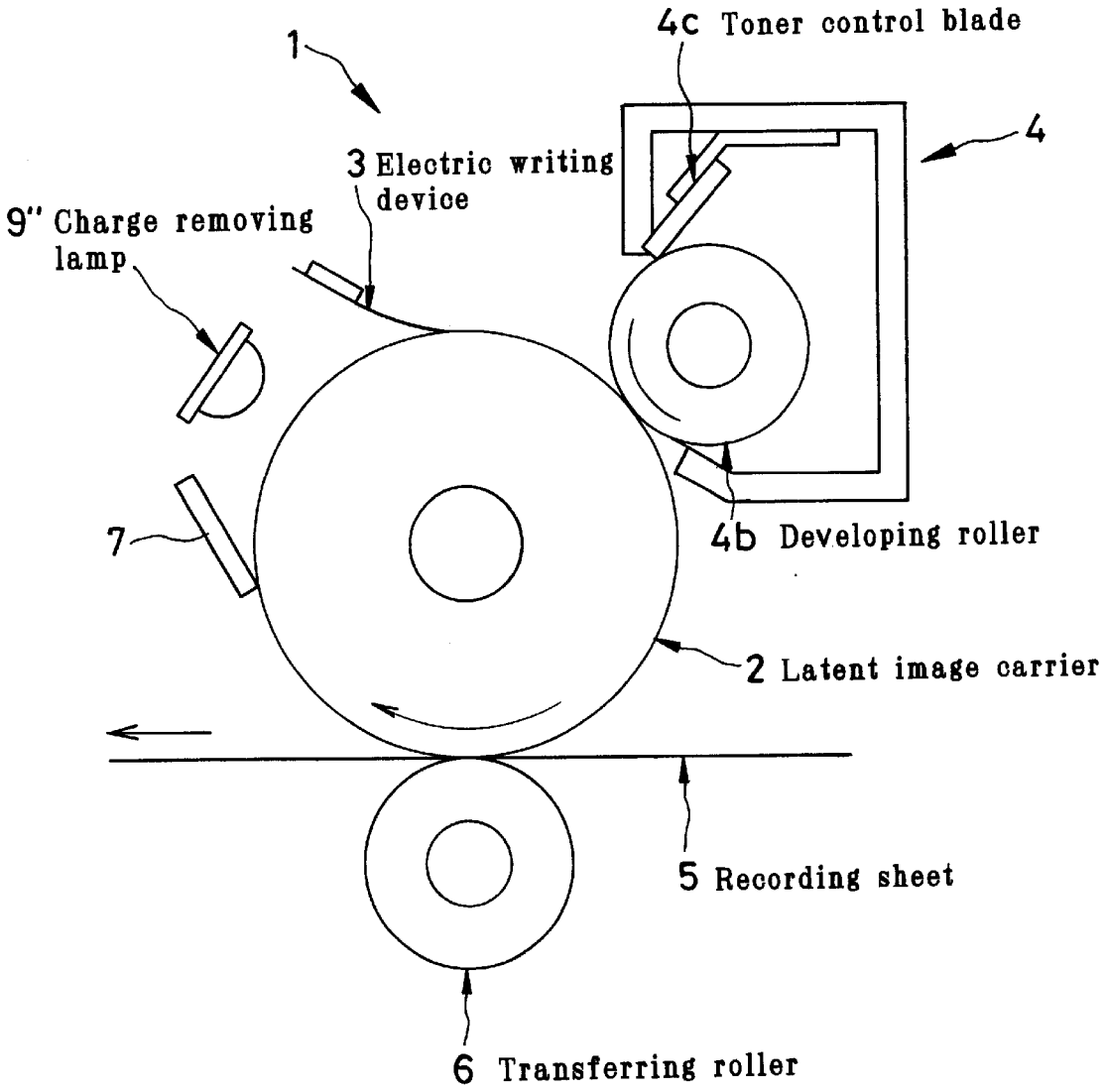
FIG. 22 is a view showing a structural example of an image forming apparatus employing a charge removing lamp as the charge removing means.

FIG. 21 is a view showing a structural example of an image forming apparatus employing a charge removing brush as the charge removing means and FIG. 22 is a view showing a structural example of an image forming apparatus employing a charge removing lamp as the charge removing means. In the drawings, numeral 9' designates a charge removing brush, numeral 9" designates a charge removing lamp, and parts similar or corresponding to the parts shown in FIG. 17 will be marked by the same reference numerals. It should be understood that the present invention can be applied not only to an image forming apparatus employing a charge removing blade made of a film, rubber, or the like as shown in FIGS. 17–19, but also to an image forming apparatus employing a charge removing brush 9' as shown in FIG. 21, an image forming apparatus employing a charge removing lamp 9" as shown in FIG. 22 wherein an electrophotographic photoreceptor is used as the latent image carrier, and other image forming apparatuses employing other charge removing means such as a charge removing roller.

According to the present invention as mentioned above, a slight amount of residual toner left on the latent image carrier after the transfer and having potential differences along the width direction of the latent image carrier 2 can be prevented from adhering to the contact portion between the electric writing device and the latent image carrier, thereby preventing damage onto the formation of latent images. Therefore, contact between the electric writing device and the latent image carrier can be stabilized so as to enable homogeneous writing by selective application of charge, thereby obtaining a high quality image without image irregularities nor linear stains.

Figure 23:
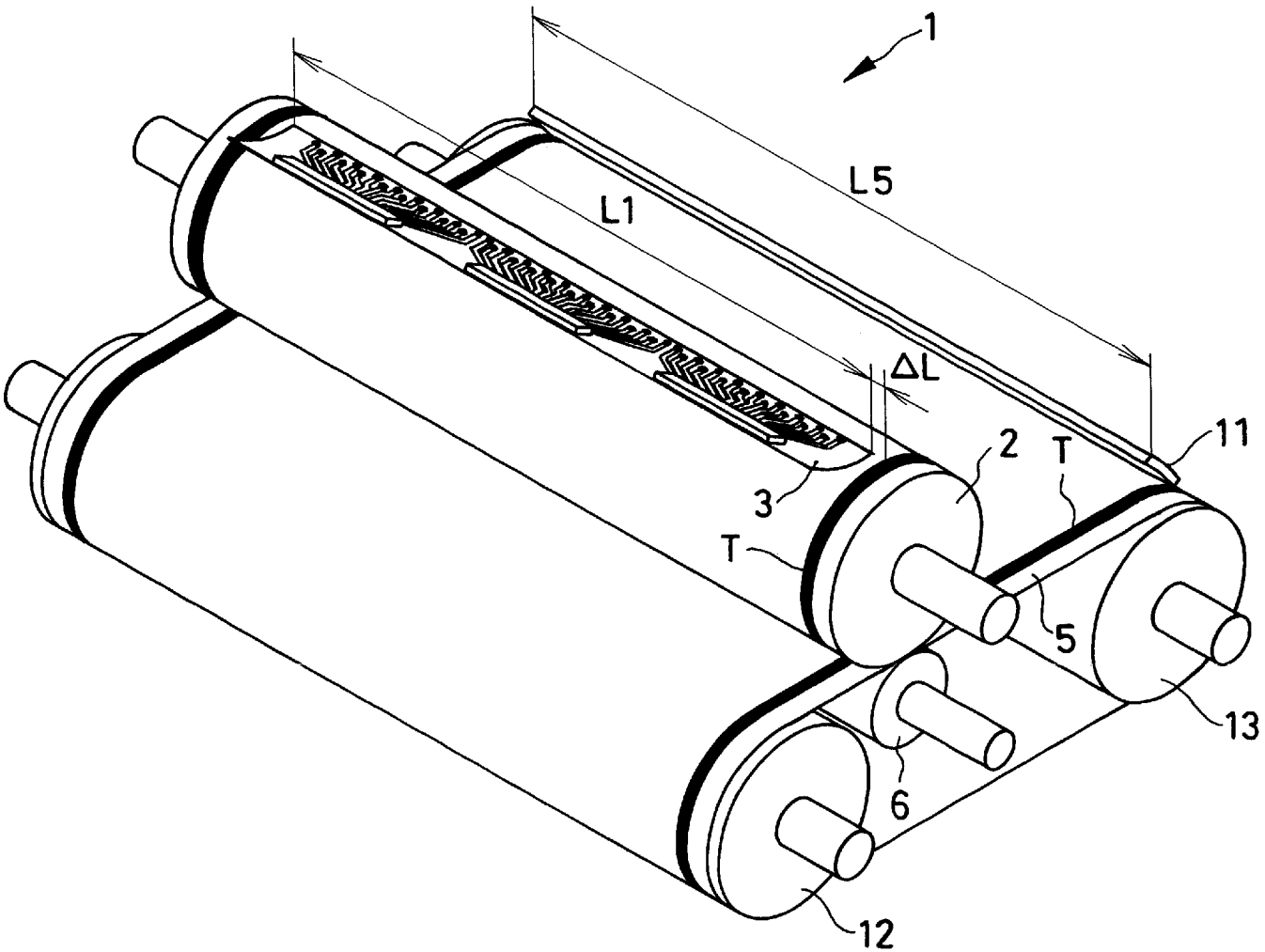
FIG. 23 is a perspective view partially showing another embodiment of the image forming apparatus of the present invention.

In an image forming apparatus shown in FIG. 23, to ensure a constant distance ΔL between a portion to which leakage toner T at an end of a cleaning blade 11 adheres and a side edge of the writing device 3, a cleaning blade width L5 which is a contact width of the cleaning blade 11 relative to a intermediate transferring belt 5 is set to be larger than a writing device width L1 which is a contact width of the writing device 3 relative the latent image carrier 2. That is, the relation ΔL=L5−L1 is satisfied. Because of this existence of the contact distance ΔL, the leakage toner T at the end of the cleaning blade 11 which is arranged in contact with the intermediate transferring belt 5 for removing residual toner cannot move from the latent image carrier 2 to a space under the substrate of the writing device 3, thereby preventing the leakage toner T at the end from adhering to the contact portion between the writing device 3 and the latent image carrier 2.

Hereinafter, respective components of the image forming apparatus will be described in detail. The image forming apparatus shown in FIG. 23 comprises, at least, the latent image carrier 2 on which an electrostatic latent image is formed, the writing device 3 which is arranged in contact with the latent image carrier 2 to write the electrostatic latent image onto the latent image carrier 2, a developing device 4 for developing the electrostatic latent image on the latent image carrier 2 with toner, the intermediate transferring belt 5 and a transferring roller 6 for temporally transferring the image developed by the developing device 4, i.e. a toner image, on the latent image carrier 2, a cleaning blade 7 for removing residual toner left on the latent image carrier 2 after the transfer, a cleaning blade 11 for removing toner left on the intermediate transferring belt 5 after transfer, and belt supporting rollers 12, 13 for supporting the intermediate transferring belt 5. The writing device 3 is supported, at its one end, by a fixing portion in the cantilevered form and is, at its other end, in contact with the latent image carrier 2.

In the image forming apparatus as mentioned above, the electric writing device 3 has a plurality of writing electrodes 3*b* which are arranged in contact with or proximity to the latent image carrier 2 along the axial direction of the latent image carrier 2. A slight amount of leakage toner at ends of the cleaning blade 11 is left on the latent image carrier 2 and on the intermediate transferring belt 5 and may inhomogeneously adhere to contact portion between the writing device 3 and the latent image carrier 2. The inhomogeneous adhering varies the pressing force of the writing device 3 to the latent image carrier 2 and/or contaminate the writing electrodes 3*b*, thereby damaging the formation of a latent image and producing image irregularities.

To avoid the aforementioned damaging factor, in the image forming apparatus according to the present invention, the cleaning blade width L5 as the contact width of the cleaning blade 11 relative to the intermediate transferring belt 5 is set to be larger than the writing device width L1 as the contact width of the writing device 3 relative to the latent image carrier 2. By this setting, the leakage toner at the ends of the cleaning blade 11 cannot move to the contact portion between the writing device 3 and the latent image carrier 2 through the latent image carrier 2 and thus can be prevented from adhering to the contact portion, thereby avoiding the aforementioned factor of damaging the formation of latent images.

Figure 24:
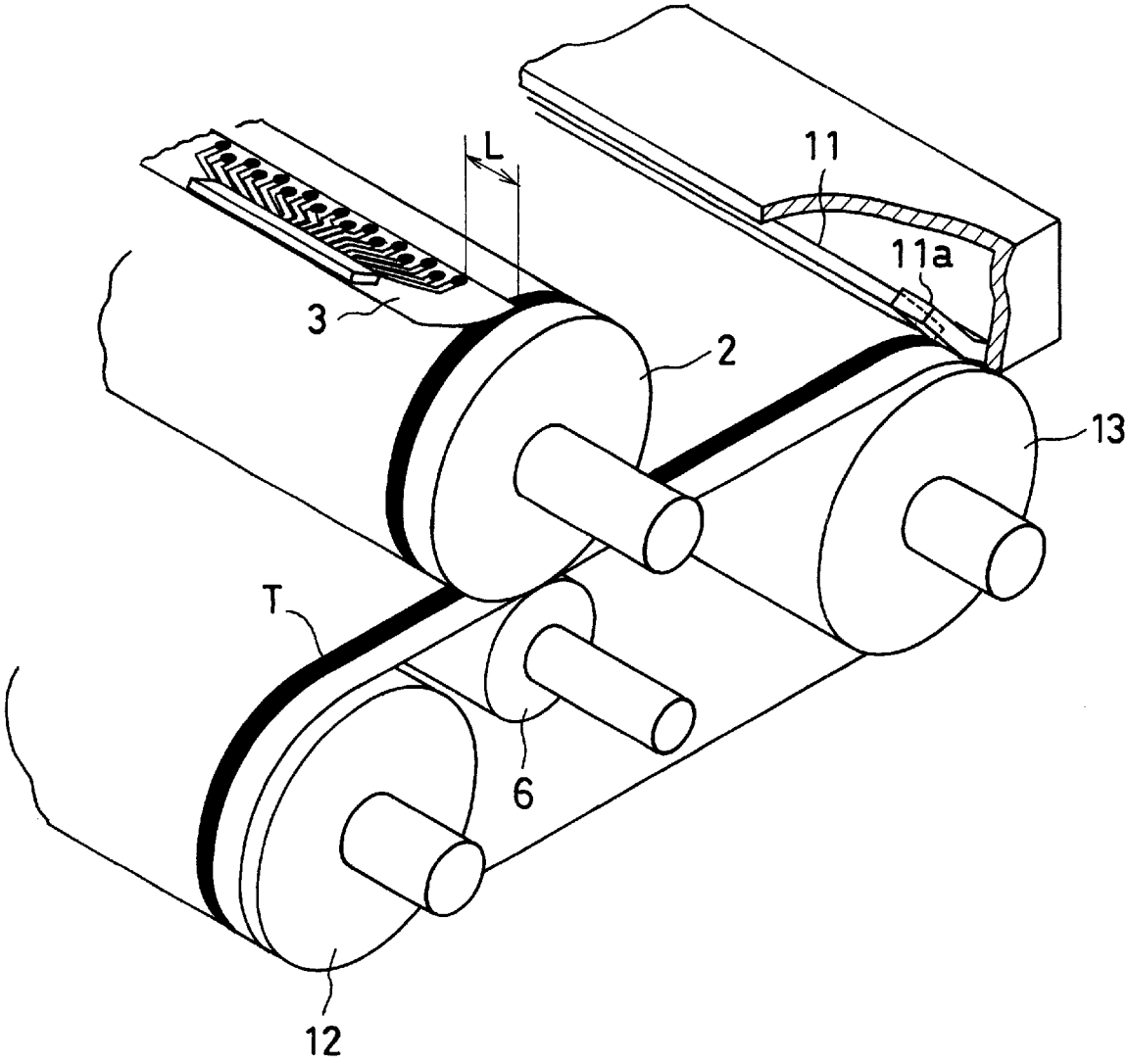
FIG. 24 is a view illustrating a case that the end leakage toner adheres to and thus is deposited on the writing device 3 through the latent image carrier 2.
Figure 25:
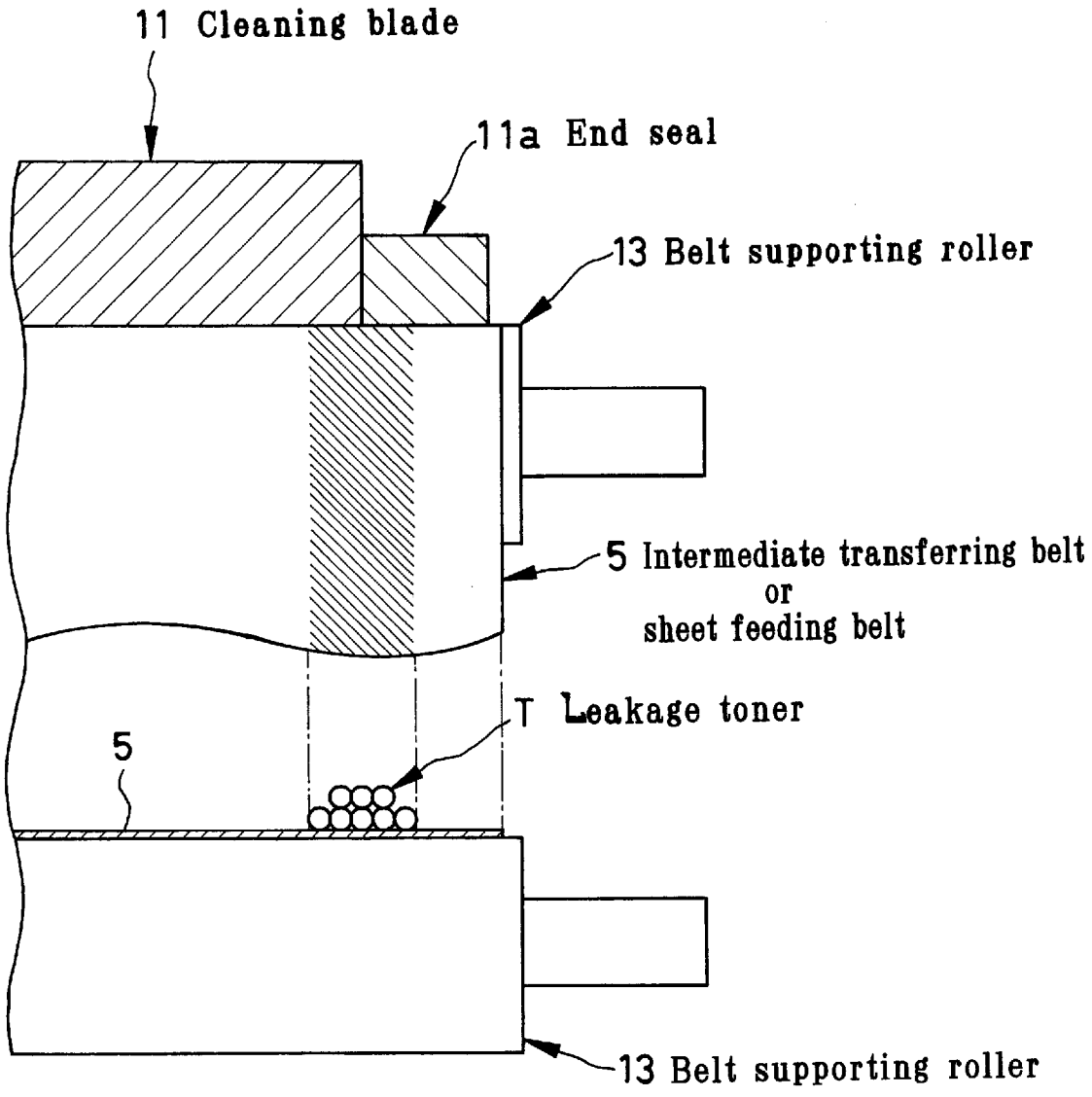
FIG. 25 is a view for explaining the production of end leakage toner.

Now, description will be made as regard to the efficiency obtained by setting the cleaning blade width L5 to be larger than the writing device width L1. FIG. 24 is a view illustrating a case that the end leakage toner adheres to and thus is deposited on the writing device 3 through the latent image carrier 2, and FIG. 25 is a view for explaining the production of end leakage toner.

The electric writing device 3 is provided with auxiliary wiring electrodes for adjusting the position of image relative to the maximum image size. The substrate 3*a* is provided with margins (length) L outside of the distal electrodes 3*b*R to stabilize the contact of the distal electrodes 3*b*R relative to the latent image carrier 2 as shown in FIG. 24. Without the margins L, the pressing force of the distal electrodes 3*b*R and the writing electrodes near the distal electrodes 3*b*R against the latent image carrier 2 should be smaller than that of the writing electrodes located at a middle portion. In this case, homogeneous application of charge for writing can not be achieved. On the other hand, as also shown in FIG. 25, it is impossible to completely remove toner at contact boundary faces between the cleaning blade 11 and an end seal 11*a* so as to produce leakage toner which adheres to the intermediate transferring belt 5.

In a relationship relative to the electric writing device 3, in general, the cleaning blade 11 is enough to have a width larger than the width of the maximum recording sheet size. However, a region on which toner can not be removed (to produce end leakage) is created outside of the cleaning blade 11. Therefore, when the cleaning blade width L5 as the contact width of the cleaning blade 11 relative to the intermediate transferring belt 5 is smaller than the width L1 of the writing device 3, residual toner after cleaning adheres to a side edge of the writing device 3 little by little, whereby the contact of the writing electrodes 3*b* near the side edge becomes unsteady with time, causing variation in the gap between the electrodes and the latent image carrier 2. This variation in the gap leads to image irregularities.

Therefore, as shown in FIG. 23, according to the present invention, by setting the cleaning blade width L5 larger than the width L1 of the writing device 3, leakage toner at the end seal of the cleaning blade 11 is prevented from entering through the side edge of the electric writing device 3, thereby avoiding the factor damaging the formation of latent images and thus achieving steady formation of images regardless of operating time.

Though the present invention has been described with regard to the aforementioned embodiments, the present invention is not limited thereto and various modifications can be made. For example, instead of the cleaning blade, other cleaning means such as a cleaning brush and a cleaning roller may be employed as the cleaning means. The present invention is directed to prevent leakage toner at the ends of the cleaning means for removing residual toner from adhering to contact portions between the writing electrodes and the latent image carrier through a space under the substrate of the writing device from the latent image carrier.

Therefore, the present invention is not limited to a cleaning means for removing residual toner from an intermediate transferring belt just like the aforementioned embodiment and may be applied to other cleaning means such as a cleaning means for removing residual toner from a sheet feeding belt for feeding recording media.

Figure 26:
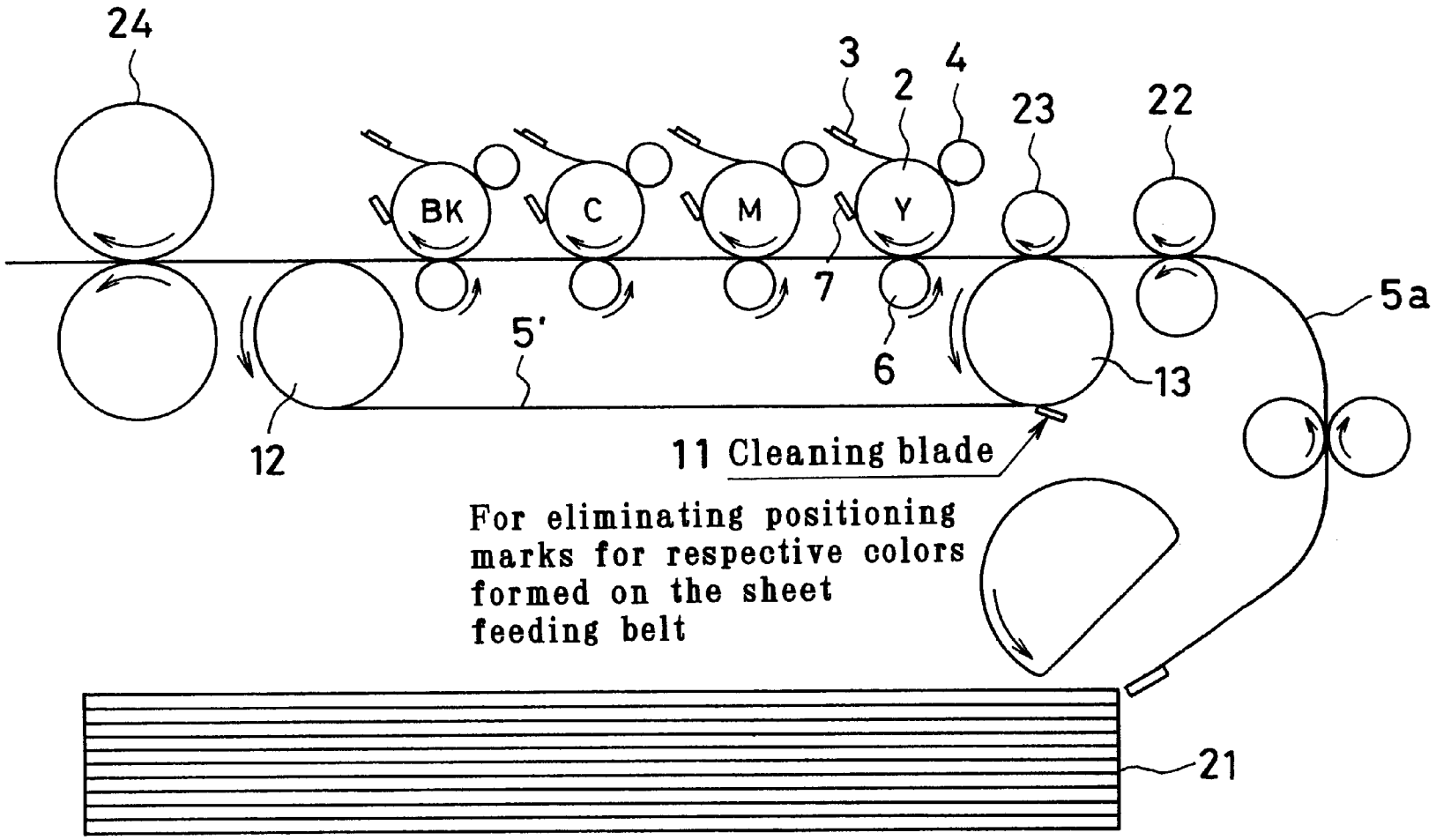
FIG. 26 is a view schematically showing a multicolor image forming apparatus of tandem type which has a cleaning means for removing residual toner on a carrying belt.
Figure 27:
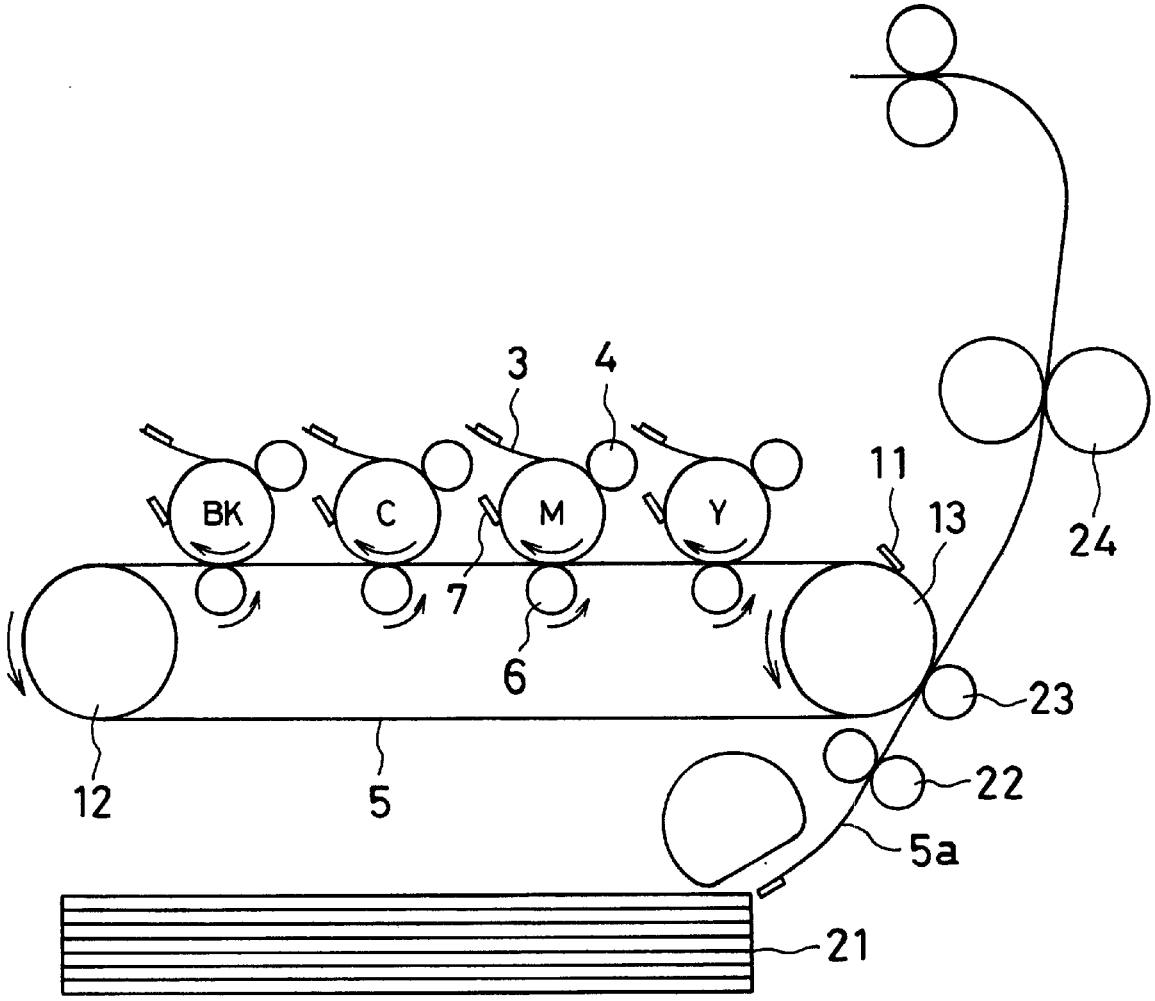
FIG. 27 is a view schematically showing an example of a multicolor image forming apparatus of tandem type which has a cleaning means for removing residual toner on an intermediate transferring belt.

In addition, the present invention can be applied to a black-and-white image forming apparatus, a monochrome image forming apparatus, and a multicolor image forming apparatus in the same manner. As for a multicolor image forming apparatus, the present invention can be applied to image forming apparatus of both types: a rotary type in which respective color developing devices are arranged around the periphery of a latent image carrier; and a tandem type in which respective color developing devices are arranged along a belt. Among these apparatuses, a concrete example will be described which is a multicolor image forming apparatus of tandem type employing a writing device of the present invention in which an electrode portion 3*b* is arranged in contact with a latent image carrier 2 to write an electrostatic latent image. FIG. 26 is a view schematically showing a multicolor image forming apparatus of tandem type which has a cleaning means for removing residual toner on a carrying belt and FIG. 27 is a view schematically showing an example of a multicolor image forming apparatus of tandem type which has a cleaning means for removing residual toner on an intermediate transferring belt. In the drawings, numeral 5' designates a sheet feeding belt for feeding recording sheets, 21 designates a paper tray, 22 designates a resist roller, 23 designates a transferring device, and 24 designates a fusing device.

First, description will be made as regard to an image forming apparatus in which toner images of respective colors are substantially superposed with each other and directly transferred onto a recording sheet, thereby forming a multicolored image. The image forming apparatus 1 shown in FIG. 26 comprises image forming units 1 for respective colors which are in tandem in the order of yellow Y, magenta M, cyan C, black BK from the upstream in the feeding direction of a recording sheet fed by a sheet feeding belt 5'. It should be understood that the image forming units 1 may be arranged in any order. Each image forming unit 1 comprises a latent image carrier 2, a writing device 3, a developing device 4, and a transferring device 6.

The actions of the image forming apparatus 1 having the aforementioned structure will now be described. First, in the image forming unit 1 for yellow Y, an electrostatic latent image for yellow Y is written on a surface of the latent image carrier 2 by electrodes 3*b* of the writing device 3. The electrostatic latent image for yellow Y is then developed by the developing device 4 so as to form a yellow toner image on the surface of the latent image carrier 2. The yellow toner image on the latent image carrier 2 is transferred to the recording sheet 5*a*, supplied from the paper tray 21, by the transferring device 6 so as to form a yellow toner image on the recording sheet 5*a*.

Subsequently, in the image forming unit 1 for magenta M, an electrostatic latent image for magenta M is written on a surface of the latent image carrier 2 by electrodes 3*b* of the writing device 3. The electrostatic latent image for magenta M is then developed by the developing device 4 so as to form a magenta toner image on the surface of the latent image carrier 2. The magenta toner image on the latent image carrier 2 is transferred to the recording sheet 5*a*, supplied and already having the yellow toner image thereon, by the transferring device 6 such that the magenta toner image is formed to be partly superposed on the yellow toner image on the recording sheet 5*a*.

In the same manner, in the image forming unit 1 for cyan C, an electrostatic latent image for cyan C is written on a surface of the latent image carrier 2 by electrodes 3*b* of the writing device 3 and is then developed by the developing device 4 to form a cyan toner image. The cyan toner image is transferred to the recording sheet 5*a* such that the cyan toner image is formed and partly superposed on the toner images already formed on the recording sheet 5*a*. After that, in the image forming unit 1 for black BK, an electrostatic latent image for black BK is written on a surface of the latent image carrier 2 by electrodes 3*b* of the writing device 3 and is then developed by the developing device 4 to form a black toner image. The black toner image is transferred to the recording sheet 5*a* such that the black toner image is formed and partly superposed on the toner images already formed on the recording sheet 5*a*, thereby superposing the toner images for the respective colors to produce a toned multicolored developing powder image on the recording sheet 5*a*.

The cleaning blade 11 is provided for the purpose of eliminating positioning marks for respective colors formed on the sheet feeding belt 5'. Leakage toner at ends of the cleaning blade 11 may move from the sheet feeding belt 5' to the contact portions between the writing devices 3 and the latent image carriers 2 so as to inhomogeneously adhere to contact portions between the writing devices 3 and the latent image carriers 2. The inhomogeneous adhering varies the pressing force of the writing devices 3 to the latent image carriers 2 and/or contaminate the writing electrodes 3*b*, thereby damaging the formation of a latent image and producing image irregularities.

To avoid the aforementioned damaging factor, in the image forming apparatus to which the present invention is applied, the cleaning blade width L5 as the contact width of the cleaning blade 11 relative to the sheet feeding belt 5' is set to be larger than the writing device width L1 as the contact width of each writing device 3 relative to each latent image carrier 2 just like the embodiment shown in FIG. 23. By this setting, the leakage toner at the ends of the cleaning blade 11 can be prevented from moving and adhering to the contact portions between the writing devices 3 and the latent image carriers 2 through the latent image carriers 2, thereby avoiding the aforementioned factor of damaging the formation of latent images.

Accordingly, employment of the writing devices 3 of the present invention achieves reduction in size and simplification of the structure of such a multicolor image forming apparatus comprising image forming units for the respective colors arranged in tandem. By setting the contact width of the cleaning blade 11 relative to the sheet feeding belt 5' to be larger than the contact width of each writing device 3 relative to each latent image carrier 2, gap between the writing electrodes and the corresponding latent image carrier can be prevented from varying due to end leakage toner adhering to the contact portions between the writing electrodes and the corresponding latent image carrier, thereby preventing the production of image irregularities.

In the image forming apparatus 1 of the example shown in FIG. 26 in which the image forming units for the respective colors are arranged in tandem, toner images for the respective colors formed on the respective latent image carriers 2 of the respective image forming units 1 are transferred to the recording sheet 5*a* fed by the sheet feeding belt 5' at every unit. In the image forming apparatus of the example shown in FIG. 27, however, toner images for the respective colors are temporally transferred to an intermediate transferring belt 5 before transferred to the recording sheet 5*a*. That is, the image forming apparatus 1 of this example shown in FIG. 27 is different from the image forming apparatus 1 of the example shown in FIG. 26 by including an intermediate transferring belt 5. The intermediate transferring belt 5 is an intermediate transferring member taking the form as an endless belt and is tightly held by two rollers 12, 13 and is rotated in the counter-clockwise direction in FIG. 27 by the drive of one (the roller 12) of the rollers 12, 13.

Image forming units 1 are arranged along a straight portion of the intermediate transferring belt S. Further, the image forming apparatus 1 has a secondary transferring device 23 disposed adjacent to the roller 13. The other structures of the image forming apparatus 1 of this example are the same as those of the image forming apparatus 1 of the example shown in FIG. 26.

In the image forming apparatus 1 of this example having the aforementioned structure, toner images for the respective colors are formed on the latent image carriers 2 in the same manner as the image forming apparatus 1 of the example shown in FIG. 26, and the toner images for the respective colors are transferred to the intermediate transferring belt 5 to be superposed and toned on each other in the same manner as the case of transferring toner images to the recording sheet 5*a* as shown in FIG. 26. The toner images for the respective colors temporally transferred to the intermediate transferring belt 5 are transferred to the recording sheet 5*a* by the secondary transferring device 23 so as to form a multicolored toner image on the recording sheet 5*a*. The other actions of the image forming apparatus 1 of this example are the same as those of the image forming apparatus 1 of the example shown in FIG. 26.

The cleaning blade 11 is provided for the purpose of removing residual toner left on the intermediate transferring belt 5 after transfer. Leakage toner at ends of the cleaning blade 11 may move from the intermediate transferring belt 5 to the contact portions between the writing devices 3 and the latent image carriers 2 so as to inhomogeneously adhere to contact portions between the writing devices 3 and the latent image carriers 2. The inhomogeneous adhering varies the pressing force of the writing devices 3 to the latent image carriers 2 and/or contaminate the writing electrodes 3*b*, thereby damaging the formation of a latent image and producing image irregularities.

To avoid the aforementioned damaging factor, in the image forming apparatus to which the present invention is applied, the cleaning blade width L5 as the contact width of the cleaning blade relative to the intermediate transferring belt 5 is set to be larger than the writing device width L1 as the contact width of each writing device 3 relative to each latent image carrier 2 just like the embodiment shown in FIG. 23. By this setting, the leakage toner at the ends of the cleaning blade 11 can be prevented from moving and adhering to the contact portions between the writing devices 2 and the latent image carriers 2 through the latent image carriers 2, thereby avoiding the aforementioned factor of damaging the formation of latent images.

Accordingly, employment of the writing devices 3 of the present invention still achieves reduction in size and simplification of the structure of such a multicolor image forming apparatus comprising an intermediate transferring belt 5 and image forming units for the respective colors arranged in tandem. By setting the contact width of the cleaning blade 11 relative to the intermediate transferring belt 5 to be larger than the contact width of each writing device 3 relative to each latent image carrier 2, gap between the writing electrodes and the corresponding latent image carrier can be prevented from varying due to end leakage toner adhering to the contact portions between the writing electrodes and the corresponding latent image carrier, thereby preventing the production of image irregularities.

Of course, employment of the writing devices 3 of the present invention still achieves reduction in size and simplification of the structure of a black-and-white image forming apparatus, a monochrome image forming apparatus, and a multicolor image forming apparatus of rotary type. By setting the contact width of a cleaning blade 11 to be larger than the contact width of a writing device 3 relative to a latent image carrier 2, gap between writing electrodes and the latent image carrier can be prevented from varying due to end leakage toner adhering to the contact portions between the writing electrodes and the latent image carrier, thereby preventing the production of image irregularities.

Though, in the illustrated example, the writing devices 3 and the developing devices 4 are arranged along a straight portion of the endless belt in the order of Y, M, C, BK from the upstream side of the rotational direction of the intermediate transferring belt 5, the writing devices 3 and the developing devices 4 may be arranged in any order other than the illustrated one. All of the respective writing electrodes 3*b* of the writing devices 3 are arranged in contact with the corresponding latent image carriers 2 by small pressing forces as mentioned above. In the image forming apparatus 1 of this example, the writing device 3 writes an electrostatic latent image after the surface of the latent image carrier 2 is made into the uniformly charged state by a charge control device. However, the apparatus may not comprise the charge control device.

According to the present invention, leakage toner at the ends of the cleaning means left in slight amount on the intermediate transferring belt can be prevented from inhomogeneously adhering to the contact portion between the writing device and the latent image carrier, thereby damage onto the formation of latent images. Therefore, contact between the electric writing device and the latent image carrier can be stabilized so as to enable homogeneous writing by selective application of charge, thereby obtaining a high quality image without image irregularities nor linear stains.

Figure 28:
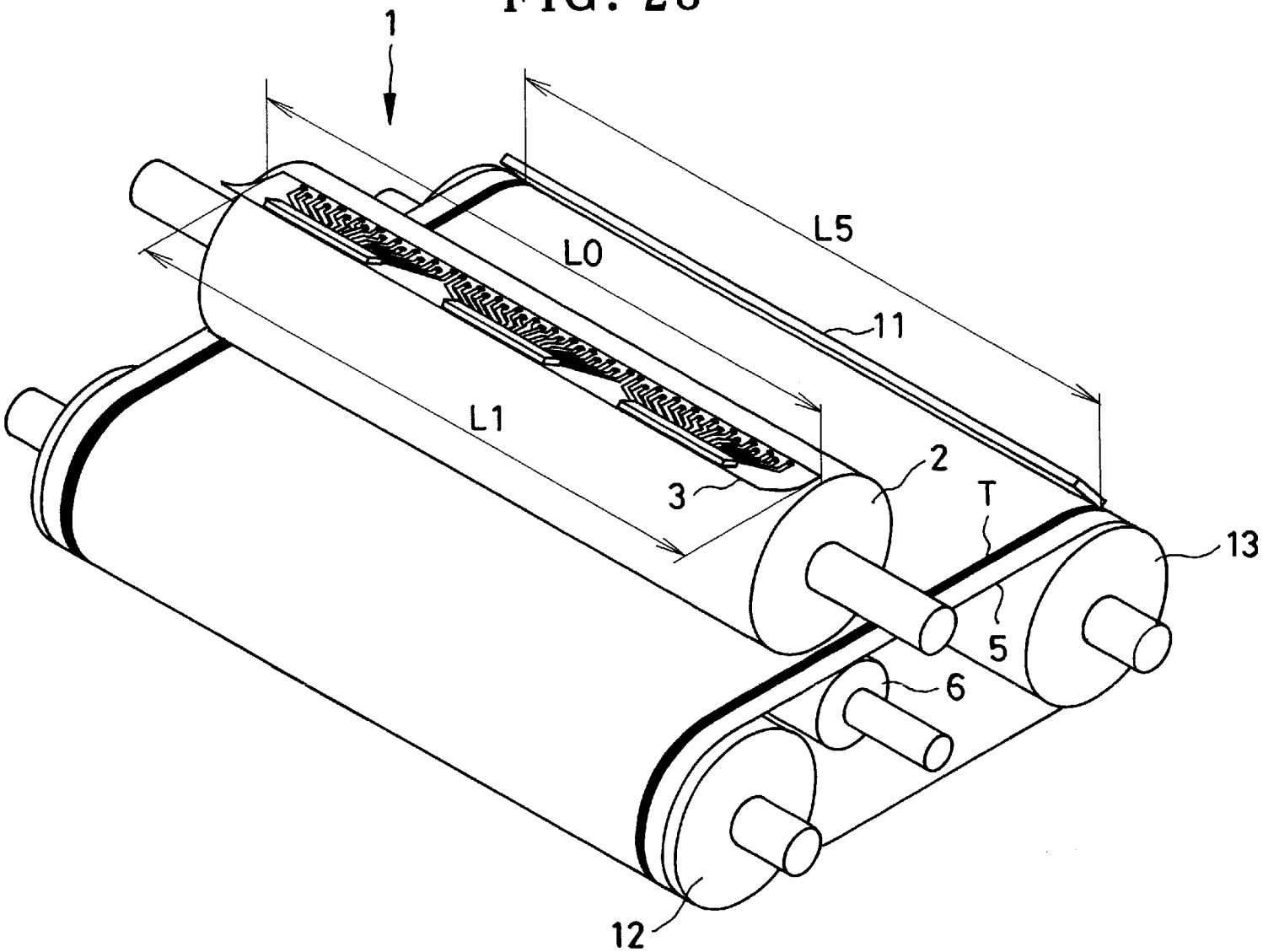
FIG. 28 is a perspective view partially showing another embodiment of the image forming apparatus of the present invention.

In the image forming apparatus according to the present invention as shown in FIG. 28, the latent image carrier width L0 is set to be larger than the writing device width L1 as the contact width of the writing device 3 relative to the latent image carrier 2 and the cleaning blade width L5 as the contact width of the cleaning blade 11 relative to the intermediate transferring belt 5 is set to be larger than the latent image carrier width L0 in order to prevent leakage toner T at ends of the cleaning blade 11 on the intermediate transferring belt 5 from adhering to end portions of the latent image carrier 2 and further from passing under the writing device 3 even when the leakage toner T adheres to the end portions of the latent image carrier 2. By satisfying the relation $L1<L0<L5$ as mentioned above, the leakage toner T at the ends of the cleaning blade 11 which is arranged in contact with the intermediate transferring belt 5 for removing residual toner cannot adhere to the end portions of the latent image carrier 2, thereby preventing the end leakage toner T from passing under the substrate of the writing device 3 and thus from adhering to the contact portion between the writing device 3 and the latent image carrier 2.

Hereinafter, respective components of the image forming apparatus will be described in detail. The image forming apparatus 1 shown in FIG. 28 and FIG. 1 comprises, at least, the latent image carrier 2 on which an electrostatic latent image is formed, the writing device 3 which is arranged in contact with the latent image carrier 2 to write the electrostatic latent image onto the latent image carrier 2, a developing device 4 for developing the electrostatic latent image on the latent image carrier 2 with toner, the intermediate transferring belt 5 and a transferring roller 6 for temporally transferring the image developed by the developing device 4, i.e. a toner image, on the latent image carrier 2, a cleaning blade 7 for removing residual toner left on the latent image carrier 2 after the transfer, a cleaning blade 11 for removing toner left on the intermediate transferring belt 5 after transfer, and belt supporting rollers 12, 13 for supporting the intermediate transferring belt 5. The writing device 3 is supported, at its one end, by a fixing portion in the cantilevered form and is, at its other end, in contact with the latent image carrier 2.

In the image forming apparatus as mentioned above, the electric writing device 3 has a plurality of writing electrodes 3*b* which are arranged in contact with or proximity to the latent image carrier 2 along the axial direction of the latent image carrier 2. A slight amount of leakage toner at ends of the cleaning blade 11 is left on the latent image carrier 2 and on the intermediate transferring belt 5 and may inhomogeneously adhere to contact portion between the writing device 3 and the latent image carrier 2. The inhomogeneous adhering varies the pressing force of the writing device 3 to the latent image carrier 2 and/or contaminate the writing electrodes 3*b*, thereby damaging the formation of a latent image and producing image irregularities.

To avoid the aforementioned damaging factor, in the image forming apparatus according to the present invention, the latent image carrier width L0 of the latent image carrier 2 is set to be larger than the writing device width L1 as the contact width of the writing device 3 relative to the latent image carrier 2 and the cleaning blade width L5 as the contact width of the cleaning blade 11 relative to the intermediate transferring belt 5 is set to be larger than the latent image carrier width L0. By this setting, the leakage toner at the ends of the cleaning blade 11 can be prevented from adhering to the latent image carrier 2. Since the leakage toner cannot adhere to the latent image carrier 2, the leakage toner at the ends of the cleaning blade 11 is prevented from entering and adhering to the contact portion between the writing device 3 and the latent image carrier 2 via the latent image carrier 2, thereby avoiding the aforementioned factor of damaging the formation of latent images.

Now, description will be made as regard to the efficiency obtained by setting the latent image carrier width L0 to be larger than the writing device width L1 and setting the cleaning blade width L5 to be larger than the latent image carrier width L0 with reference to FIG. 24 and FIG. 25.

The electric writing device 3 is provided with auxiliary wiring electrodes for adjusting the position of image relative to the maximum image size. The substrate 3*a* is provided with margins (length) L outside of the distal electrodes 3*b*R to stabilize the contact of the distal electrodes 3*b*R relative to the latent image carrier 2 as shown in FIG. 24. Without the margins L, the pressing force of the distal electrodes 3*b*R and the writing electrodes near the distal electrodes 3*b*R against the latent image carrier 2 should be smaller than that of the writing electrodes located at a middle portion. In this case, homogeneous application of charge for writing can not be achieved. On the other hand, as also shown in FIG. 25, it is impossible to completely remove toner at contact boundary faces between the cleaning blade 11 and an end seal 11*a* so as to produce leakage toner which adheres to the intermediate transferring belt 5.

In a relationship relative to the electric writing device 3, in general, the cleaning blade 11 is enough to have a width larger than the width of the maximum recording sheet size. However, a region on which toner can not be removed (to produce end leakage) is created outside of the cleaning blade 11. Therefore, when the cleaning blade width L5 as the contact width of the cleaning blade 11 relative to the intermediate transferring belt 5 is smaller than the width L1 of the writing device 3, residual toner after cleaning adheres to a side edge of the writing device 3 little by little as shown in FIG. 25, whereby the contact of the writing electrodes 3*b* near the side edge becomes unsteady with time, causing variation in the gap between the electrodes and the latent image carrier 2. This variation leads to image irregularities.

Therefore, as shown in FIG. 28, according to the present invention, by setting the latent image carrier width L0 to be larger than writing device width L1 and setting the cleaning blade width L5 larger than the latent image carrier width L0. By this setting, leakage toner at the end seals of the cleaning blade 11 is prevented from adhering to the latent image carrier 2. Therefore, the end leakage toner is prevented from entering to the writing device 3 via the latent image carrier 2, thereby avoiding the factor damaging the formation of latent images and thus achieving steady formation of images regardless of operating time.

In case of the image forming apparatus shown in FIG. 26, the cleaning blade 11 is provided for the purpose of eliminating positioning marks for respective colors formed on the sheet feeding belt 5'. Leakage toner at ends of the cleaning blade 11 may move from the sheet feeding belt 5' to the contact portions between the writing devices 3 and the latent image carriers 2 so as to inhomogeneously adhere to contact portions between the writing devices 3 and the latent image carriers 2. The inhomogeneous adhering varies the pressing force of the writing devices 3 to the latent image carriers 2 and/or contaminate the writing electrodes 3*b*, thereby damaging the formation of a latent image and producing image irregularities.

To avoid the aforementioned factor, in the image forming apparatus to which the present invention is applied, the contact width of the cleaning blade 11 relative to the sheet feeding belt 5' is set to be larger than the width of the latent image carriers 2 for the respective color image forming units 1 and the width of the latent image carriers 2 is set to be larger than the contact width of the writing devices 3 relative to the latent image carriers 2 just like the embodiment shown in FIG. 28. By this setting, the leakage toner at the ends of the cleaning blade 11 can be prevented from adhering to the latent image carriers 2 and is prevented from entering and adhering to the contact portions between the writing devices 3 and the latent image carriers 2, thereby avoiding the factor damaging the formation of latent images.

Accordingly, employment of the writing devices 3 of the present invention achieves reduction in size and simplification of the structure of such a multicolor image forming apparatus comprising image forming units 1 for the respective colors arranged in tandem. By setting the contact width of the cleaning blade 11 relative to the sheet feeding belt 5' to be larger than the width of the latent image carrier 2 and setting the width of the latent image carrier 2 is larger than the contact width of the writing device 3 relative to the latent image carrier 2, gap between the writing electrodes and the corresponding latent image carrier can be prevented from varying due to end leakage toner adhering to the contact portions between the writing electrodes and the latent image carrier, thereby preventing the production of image irregularities.

In case of the image forming apparatus shown in FIG. 27, the cleaning blade 11 is provided for the purpose of removing residual toner left on the intermediate transferring belt 5 after transfer. Leakage toner at ends of the cleaning blade 11 may move from the intermediate transferring belt 5 so as to inhomogeneously adhere to contact portions between the writing devices 3 and the latent image carriers 2. The inhomogeneous adhering varies the pressing force of the writing devices 3 to the latent image carriers 2 and/or contaminate the writing electrodes 3*b*, thereby damaging the formation of a latent image and producing image irregularities.

To avoid the aforementioned damaging factor, in the image forming apparatus to which the present invention is applied, the width L0 of the latent image carrier 2 is set to be larger than the writing device width L1 as the contact width of each writing device 3 relative to each latent image carrier 2 and the cleaning blade width L5 as the contact width of the cleaning blade 11 relative to the intermediate transferring belt 5 is set to be larger than the width L0 of the latent image carrier 2 just like the embodiment shown in FIG. 28. By this setting, the leakage toner at the ends of the cleaning blade 11 can be prevented from moving and adhering to the contact portions between the writing devices 2 and the latent image carriers 2 through the latent image carriers 2, thereby avoiding the aforementioned factor of damaging the formation of latent images.

Accordingly, employment of the writing devices 3 of the present invention still achieves reduction in size and simplification of the structure of such a multicolor image forming apparatus comprising an intermediate transferring belt 5 and image forming units 1 for the respective colors arranged in tandem. By setting the contact width of the cleaning blade 11 relative to the intermediate transferring belt 5 to be larger than the width of the latent image carriers 2 and setting the width of the latent image carrier 2 to be larger than the contact width of the writing device 3 relative to the latent image carrier 2, gap between the writing electrodes and the corresponding latent image carrier can be prevented from varying due to end leakage toner adhering to the contact portions between the writing electrodes and the corresponding latent image carrier, thereby preventing the production of image irregularities.

Of course, employment of the writing devices of the present invention still achieves reduction in size and simplification of the structure of a black-and-white image forming apparatus, a monochrome image forming apparatus, and a multicolor image forming apparatus of rotary type. By setting the contact width of a cleaning blade to be larger than the contact width of the writing electrode relative to the latent image carrier, gap between writing electrodes and the latent image carrier can be prevented from varying due to end/ leakage toner adhering to the contact portions between the writing electrodes and the latent image carrier, thereby preventing the production of image irregularities.

Though, in the illustrated example, the writing devices 3 and the developing devices 4 are arranged along a straight portion of the endless belt in the order of Y, M, C, BK from the upstream side of the rotational direction of the endless belt, the writing devices 3 and the developing devices 4 may be arranged in any order other than the illustrated one. All of the respective writing electrodes 3*b* of the writing devices 3 for the respective colors are arranged in contact with the corresponding latent image carriers 2 by small pressing forces as mentioned above. In the image forming apparatus 1 of this example, the writing device 3 writes an electrostatic latent image after the surface of the latent image carrier 2 is made into the uniformly charged state by a charge control device. However, the apparatus may not comprise the charge control device.

According to the present invention, leakage toner at the ends of the cleaning means left in slight amount on the sheet feeding means or the intermediate transferring member even after removal of toner by the cleaning means can be prevented from adhering to the latent image carrier, thereby preventing the leakage toner at the ends of the cleaning means from entering and inhomogeneously adhering to the contact portions between the writing means and the latent image carrier and thus preventing damage onto the formation of latent images. Therefore, contact between the electric writing device and the latent image carrier can be stabilized so as to enable homogeneous writing by selective application of charge, thereby obtaining a high quality image without image irregularities nor linear stains.

Though the present invention has been described with regard to the aforementioned embodiments, the present invention is not limited thereto and various modifications can be made. Hereinafter, description will now be made as regard to concrete examples of the image forming apparatus employing the writing device of the present invention of which the electrode portion 3*b* is arranged in contact with the latent image carrier 2 to write an electrostatic latent image onto the latent image carrier 2.

Figure 29:
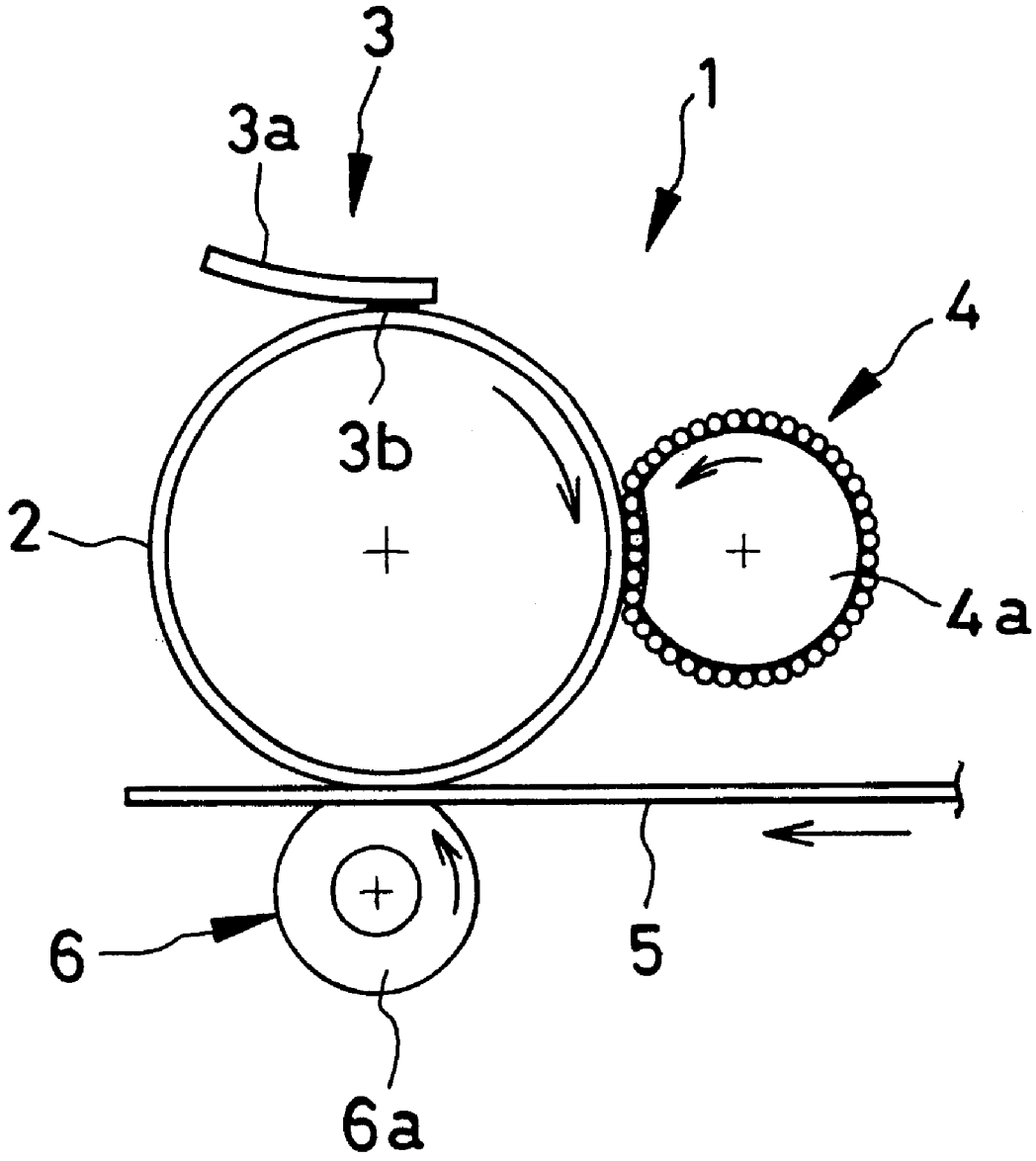
FIG. 29 through FIG. 32 are views each schematically showing another example of the image forming apparatus employing the writing device according to the present invention.

The image forming apparatus 1 shown in FIG. 29 is similar to the image forming apparatus 1 shown in FIG. 1(A), but without the cleaning device 7, that is, it is a cleaner-less image forming apparatus. In the image forming apparatus 1 of this example, a developing roller 4*a* of the developing device 4 is in contact with the latent image carrier 2 so as to conduct contact developing.

In the image forming apparatus 1, the surface of the latent image carrier 2 is uniformly charged by the charge control device, not shown, together with residual developing powder on the latent image carrier after the former transfer. Then, the writing electrodes 3*b* of the writing device 3 write an electrostatic latent image on the surface of the latent image carrier 2 and the residual developing powder by applying charge to or removing charge from the surface of the latent image carrier 2 and the surface of the residual developing powder. By the developing device 4, the latent image is developed. During this, by selectively charging the writing electrodes 3*b* to have the same polarity as the original polarity of the developing powder 8, residual developing powder on non-image portions of the latent image carrier 2 is charged into the polarity by the writing electrodes 3*b* so as to move toward the developing device 4, while residual developing powder on image portions of the latent image carrier 2 still remains on the latent image carrier 2 as developing powder for subsequent developing. By transferring the residual developing powder on the non-image portions toward the developing device 4 as mentioned above, the surface of the latent image carrier 2 can be cleaned even without the cleaning device. In particular, a brush may be arranged at a downstream side than the transferring device 6 in the rotational direction of the latent image carrier 2, but not illustrated. In this case, the residual developing powder can be scattered to be uniformly distributed on the latent image carrier 2 by this brush, thus further effectively transferring the residual developing powder on the non-image portions to the developing device 4.

Figure 30:
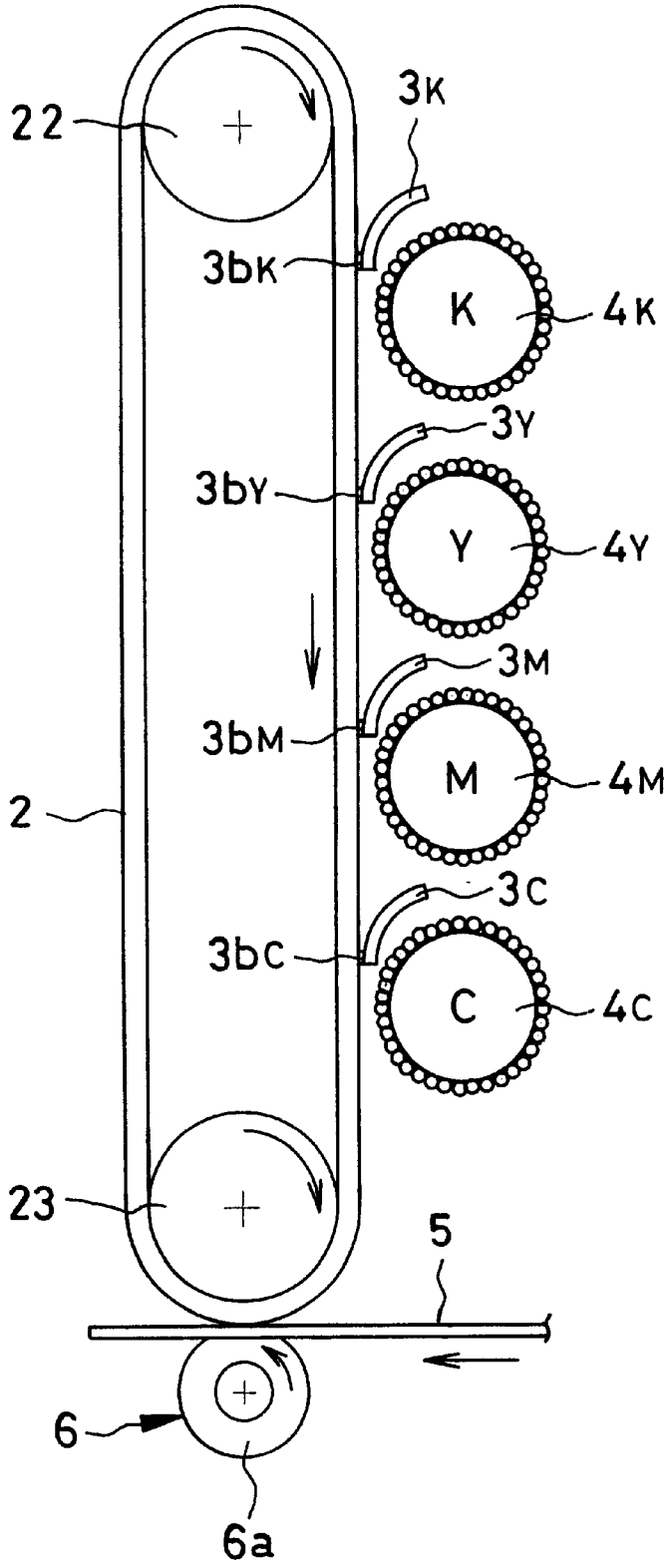

FIG. 30 is a view schematically showing another example of the image forming apparatus employing the writing device according to the present invention.

As shown in FIG. 30, the image forming apparatus 1 of this example is a color image forming apparatus for developing full color image by superposing developing powder images in four colors of black K, yellow Y, magenta M, and cyan C on a latent image carrier 2 where in the latent image carrier is in an endless belt-like form. This endless belt-like latent image carrier 2 is tightly held by two rollers 22, 23 and is rotatable in the clockwise direction in FIG. 30 by a driven roller, i.e. one of the rollers 22, 23.

Writing devices $\mathbf{3}_K$, $\mathbf{3}_Y$, $\mathbf{3}_M$, $\mathbf{3}_C$ and developing devices $\mathbf{4}_K$, $\mathbf{4}_Y$, $\mathbf{4}_M$, $\mathbf{4}_C$ for the respective colors are arranged along a straight portion of the endless belt of the latent image carrier 2, in the order of colors K, Y, M, C from the upstream of the rotational direction of the latent image carrier 2. It should be understood that the developing devices $\mathbf{4}_K$, $\mathbf{4}_Y$, $\mathbf{4}_M$, $\mathbf{4}_C$ may be arranged in any order other than the illustrated one. All of the respective writing electrodes $\mathbf{3}b_K$, $\mathbf{3}b_Y$, $\mathbf{3}b_M$, $\mathbf{3}b_C$ of the writing devices $\mathbf{3}_K$, $\mathbf{3}_Y$, $\mathbf{3}_M$, $\mathbf{3}_C$ are formed on flexible substrates $\mathbf{3}a_K$, $\mathbf{3}a_Y$, $\mathbf{3}a_M$, $\mathbf{3}a_C$ as mentioned above. Also in the image forming apparatus of this example, the aforementioned charge control device is disposed adjacent to a straight portion of the endless belt of the latent image carrier 2, at a side opposite to the side where the writing devices $\mathbf{3}_K$, $\mathbf{3}_Y$, $\mathbf{3}_M$, $\mathbf{3}_C$ are arranged, but not illustrated.

In the image forming apparatus 1 of this example having the aforementioned structure, first an electrostatic latent image for black K is written on the surface of the latent image carrier 2 by electrodes $\mathbf{3}b_K$ of the writing device $\mathbf{3}_K$ for black K. The electrostatic latent image for black K is then developed by the developing device $\mathbf{4}_K$ so as to form a black developing powder image on the surface of the latent image carrier 2. An electrostatic latent image for yellow Y is subsequently written on the surface of the latent image carrier 2 and on the black developing powder image, already formed, by the electrodes $\mathbf{3}b_Y$ of the writing device $\mathbf{3}_Y$ for yellow Y such that the electrostatic latent image for yellow Y is partly superposed on the black developing powder image. The electrostatic latent image for yellow Y is then developed by the developing device 4y so as to form a yellow developing powder image on the surface of the latent image carrier 2. In the same manner, an electrostatic latent image for magenta M is subsequently written on the surface of the latent image carrier 2 and on the black and yellow developing powder images, already formed, by the electrodes $\mathbf{3}b_M$ of the writing device $\mathbf{3}_M$ for magenta M such that the electrostatic latent image for magenta M is partly superposed on the black and yellow developing powder images. The electrostatic latent image for magenta M is then developed by the developing device $\mathbf{4}_M$ so as to form a magenta developing powder image on the black and yellow developing powder images and the surface of the latent image carrier 2. Moreover, an electrostatic latent image for cyan C is subsequently written on the surface of the latent image carrier 2 and on the black, yellow and magenta developing powder images, already formed, by the electrodes $\mathbf{3}b_C$ of the writing device $\mathbf{3}_C$ for cyan C such that the electrostatic latent image for cyan C is partly superposed on the black, yellow and magenta developing powder images. The electrostatic latent image for cyan C is then developed by the developing device $\mathbf{4}_C$ so as to form a cyan developing powder image on the black, yellow and magenta developing powder images and the surface of the latent image carrier 2. These developing powder images are toned. Then, these developing powder images are transferred to the receiving medium 5 by the transferring device 6 to form a multicolored developing powder image on the receiving medium 5. It should be understood that the developing powder of colors may be deposited in any order other than the aforementioned order.

Accordingly, employment of the writing devices 3 of the present invention still achieves reduction in size and simplification of the structure of such a color image forming apparatus for forming a multicolored developing powder image by superposing and toning the developing powder images for the respective colors on a latent image carrier 2.

Figure 31:
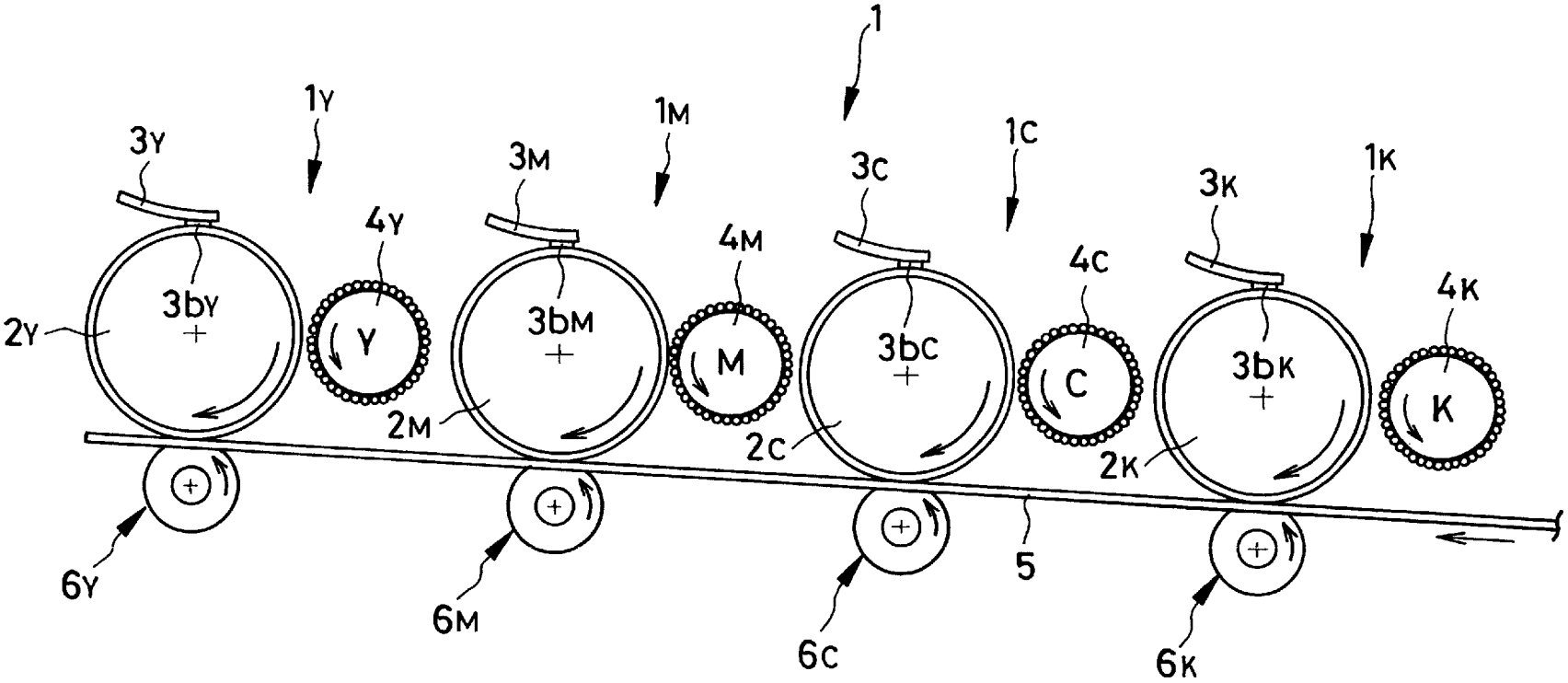

FIG. 31 is a view schematically showing still another example of the image forming apparatus employing the writing device according to the present invention.

As shown in FIG. 31, the image forming apparatus 1 of this example comprises image forming units $\mathbf{1}_K$, $\mathbf{1}_C$, $\mathbf{1}_M$, $\mathbf{1}_Y$ for the respective colors which are arranged in tandem in this order from the upstream in the feeding direction of a receiving medium 5. It should be understood that the image forming units $\mathbf{1}_K$, $\mathbf{1}_C$, $\mathbf{1}_M$, $\mathbf{1}_Y$ may be arranged in any order. The image forming units $\mathbf{1}_K$, $\mathbf{1}_C$, $\mathbf{1}_M$, $\mathbf{1}_Y$ comprise latent image carriers $\mathbf{2}_K$, $\mathbf{2}_C$, $\mathbf{2}_M$, $\mathbf{2}_Y$, writing devices $\mathbf{3}_K$, $\mathbf{3}_C$, $\mathbf{3}_M$, $\mathbf{3}_Y$, developing devices $\mathbf{4}_K$, $\mathbf{4}_C$, $\mathbf{4}_M$, $\mathbf{4}_Y$, and transferring devices $\mathbf{6}_K$, $\mathbf{6}_C$, $\mathbf{6}_M$, $\mathbf{6}_Y$, respectively. In the image forming units $\mathbf{1}_K$, $\mathbf{1}_C$, $\mathbf{1}_M$, $\mathbf{1}_Y$ of this example, but not shown, the aforementioned charge control devices 7 may be disposed on the upstream sides of the writing devices $\mathbf{3}_K$, $\mathbf{3}_C$, $\mathbf{3}_M$, $\mathbf{3}_Y$ in the rotational direction of the latent image carriers $\mathbf{2}_K$, $\mathbf{2}_C$, $\mathbf{2}_M$, $\mathbf{2}_Y$, respectively.

The actions of the image forming apparatus 1 of this example having the aforementioned structure will now be described. First in the image forming unit $\mathbf{1}_K$ for black K, after the surface of the latent image carrier $\mathbf{2}_K$ is uniformly charged by the charge control device 7 for black K, an electrostatic latent image for black K is written on the surface of the latent image carrier $\mathbf{2}_K$ by the electrodes $\mathbf{3}b_K$ of the writing device $\mathbf{3}_K$. The electrostatic latent image for black K is then developed by the developing device $\mathbf{4}_K$ so as to form a black developing powder image on the surface of the latent image carrier $\mathbf{2}_K$. The black developing powder image on the latent image carrier $\mathbf{2}_K$ is transferred to the receiving medium 5 by the transferring device $\mathbf{6}_K$ supplied so as to form a black developing powder image on the receiving medium 5. Subsequently, in the image forming unit $\mathbf{1}_C$ for cyan C, after the surface of the latent image carrier $\mathbf{2}_C$ is uniformly charged by the charge control device 7 for cyan C, an electrostatic latent image for cyan C is written on the surface of the latent image carrier $\mathbf{2}_C$ by the electrodes $\mathbf{3}b_C$ of the writing device $\mathbf{3}_C$. The electrostatic latent image for cyan C is then developed by the developing device $\mathbf{4}_C$ so as to form a cyan developing powder image on the surface of the latent image carrier $\mathbf{2}_C$. The cyan developing powder image on the latent image carrier $\mathbf{2}_C$ is transferred to the receiving medium 5 by the transferring device $\mathbf{6}_C$, supplied and already having the black developing powder image thereon, such that the cyan developing powder image is formed to be partly superposed on the black developing powder image on the receiving medium 5. In the same manner, in the image forming unit $\mathbf{1}_M$ for magenta M, an electrostatic latent image for magenta M is written on the surface of the latent image carrier $\mathbf{2}_M$ by the electrodes $\mathbf{3}b_M$ of the writing device $\mathbf{3}_M$ and then developed by the developing device $\mathbf{4}_M$ to form a magenta developing powder image, and the magenta developing powder image is transferred to the receiving medium 5 by the transferring device $\mathbf{6}_M$ such that the magenta developing powder image is formed and partly superposed on the developing powder images already formed on the receiving medium 5. After that, in the image forming unit $\mathbf{1}_Y$ for yellow Y, an electrostatic latent image for yellow Y is written on the surface of the latent image carrier $\mathbf{2}_Y$ by the electrodes $\mathbf{3}b_Y$ of the writing device $\mathbf{3}_Y$ and then developed by the developing device $\mathbf{4}_Y$ to form a yellow developing powder image on the latent image carrier 2Y, and the yellow developing powder image is transferred to the receiving medium 5 by the transferring device $6_Y$, thereby superposing the developing powder images for the respective colors to produce a toned multicolored developing powder image on the receiving medium 5.

Accordingly, employment of the writing devices 3 of the present invention still achieves reduction in size and simplification of the structure of such a color image forming apparatus comprising image forming units $1_K$, $1_C$, $1_M$, $1_Y$ for the respective colors arranged in tandem.

Figure 32:
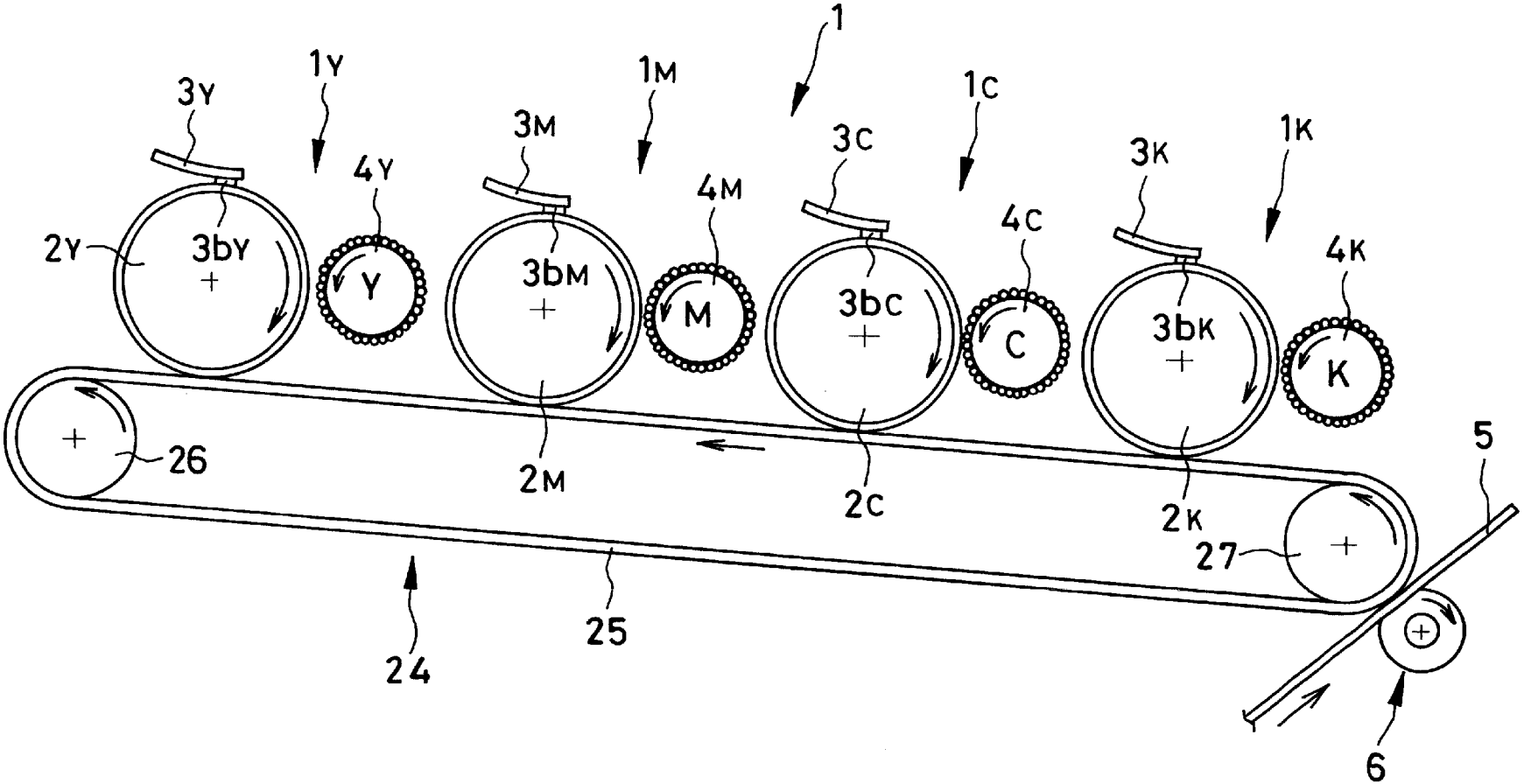

FIG. 32 is a view schematically showing further another example of the image forming apparatus employing the writing device according to the present invention.

In the image forming apparatus 1 of the example shown in FIG. 31 comprising the image forming units $1_K$, $1_C$, $1_M$, $1_Y$ for the respective colors which are arranged in tandem, respective color developing powder images formed on the latent image carriers $2_K$, $2_C$, $2_M$, $2_Y$ of the image forming units $1_K$, $1_C$, $1_M$, $1_Y$ are transferred to the receiving medium 5 at every unit $1_K$, $1_C$, $1_M$, $1_Y$. In the image forming apparatus 1 of this example, however, the respective color developing powder images are temporally transferred to another medium before transferred to the receiving medium 5 as shown in FIG. 32. That is, the image forming apparatus 1 of this example is different from the image forming apparatus 1 of the example shown in FIG. 31 by including an intermediate transferring device 24. The intermediate transferring device 24 comprises an intermediate transferring member 25 taking the form as an endless belt. This intermediate transferring member 25 is tightly held by two rollers 26, 27 and is rotated in the counter-clockwise direction in FIG. 32 by the drive of one of the rollers 26, 27. Image forming units $1_K$, $1_C$, $1_M$, $1_Y$ are arranged along a straight portion of the intermediate transferring member 25. Further, the image forming apparatus 1 has a transferring device 6 disposed adjacent to the roller 27. The other structures of the image forming apparatus 1 of this example are the same as those of the image forming apparatus 1 of the example shown in FIG. 31.

In the image forming apparatus 1 of this example having the aforementioned structure, developing powder images for the respective colors are formed on the latent image carriers $2_K$, $2_C$, $2_M$, $2_Y$ in the same manner as the image forming apparatus 1 of the example shown in FIG. 31, and the developing powder images for the respective colors are transferred to the intermediate transferring member 25 to be superposed and toned on each other in the same manner as the case of transferring developing powder images to the receiving medium 5 as shown in FIG. 31. The developing powder images for the respective colors temporally transferred to the intermediate transferring member 25 are transferred to the receiving medium 5 by the transferring device 6 so as to form a multicolored developing powder image on the receiving medium 5. The other actions of the image forming apparatus 1 of this example are the same as those of the image forming apparatus 1 of the example shown in FIG. 31.

Accordingly, employment of the writing devices 3 of the present invention still achieves reduction in size and simplification of the structure of such a color image forming apparatus comprising an intermediate transferring device 24 and image forming unit $1_K$, $1_C$, $1_M$, $1_Y$ for the respective colors arranged in tandem.

What we claim is:

1. An image forming apparatus comprising a latent image carrier, a writing means having a plurality of writing electrodes which are aligned in the axial direction of said latent image carrier and arranged in contact with or proximity to said latent image carrier to form an electrostatic latent image on said latent image carrier, a developing means for developing the electrostatic latent image on said latent image carrier, and a cleaning means which is arranged in contact with said latent image carrier to remove residual toner, being characterized in that the contact width of said writing means relative to said latent image carrier is set within the contact width of said cleaning means relative to said latent image carrier.

2. An image forming apparatus comprising a latent image carrier, a writing means having a plurality of writing electrodes which are aligned in the axial direction of said latent image carrier and arranged in contact with or proximity to said latent image carrier to form an electrostatic latent image on said latent image carrier, and a developing means for developing the electrostatic latent image on said latent image carrier, being characterized in that the contact width of said writing means relative to said latent image carrier is set within the width of a toner carrying portion of said developing means confronting said latent image carrier.

3. An image forming apparatus comprising a latent image carrier, a writing means having a plurality of writing electrodes which are aligned in the axial direction of said latent image carrier and arranged in contact with or proximity to said latent image carrier to form an electrostatic latent image on said latent image carrier, a developing means for developing the electrostatic latent image on said latent image carrier, and a transferring means, being characterized in that a relation $L1<L2$ and a relation $L1<L3$ are satisfied, wherein $L1$ is the contact width of said writing means relative to said latent image carrier, $L2$ is the width of a toner carrying portion of said developing means confronting said latent image carrier, $L0$ is the width of said latent image carrier, and $L3$ is the width of said transferring means.

4. An image forming apparatus as claimed in claim 3, being characterized in that a relation $L1<L3<L2$ is satisfied.

5. An image forming apparatus comprising a latent image carrier, a writing means having a plurality of writing electrodes which are aligned in the axial direction of said latent image carrier and arranged in contact with or proximity to said latent image carrier to form an electrostatic latent image on said latent image carrier, a developing means for developing the electrostatic latent image on said latent image carrier, and a charge removing means for removing charge from residual toner on said latent image carrier, being characterized in that at least the width of a charge removing portion of said charge removing means is set to be larger than the contact width of said writing means relative to said latent image carrier.

6. An image forming apparatus as claimed in claim 5, being characterized in that the width of a charge removing portion of said charge removing means is set to be larger than the width of a toner control portion of said developing means.

7. An image forming apparatus comprising a latent image carrier, a writing means having a plurality of writing electrodes which are aligned in the axial direction of said latent image carrier and arranged in contact with or proximity to said latent image carrier to form an electrostatic latent image on said latent image carrier, a developing means for developing the electrostatic latent image on said latent image carrier, an intermediate transferring member for temporally transferring a toner image obtained on said latent image carrier by the deploying, and a cleaning means which is arranged in contact with said intermediate transferring member to remove residual toner, wherein the toner image on said intermediate transferring member is transferred to a recording medium, said image forming apparatus being characterized in that at least the contact width of said cleaning means relative to said intermediate transferring member is set to be larger than the contact width of said writing means relative to said latent image carrier.

8. An image forming apparatus comprising a latent image carrier, a writing means having a plurality of writing electrodes which are aligned in the axial direction of said latent image carrier and arranged in contact with or proximity to said latent image carrier to form an electrostatic latent image on said latent image carrier, a developing means for developing the electrostatic latent image on said latent image carrier, an intermediate transferring member for temporally transferring a toner image obtained on said latent image carrier by the deploying, and a cleaning means which is arranged in contact with said intermediate transferring member to remove residual toner, wherein the toner image on said intermediate transferring member is transferred to a recording medium, said image forming apparatus being characterized in that at least the width of said latent image carrier is set to be larger than the width of said writing means and the contact width of said cleaning means relative to said intermediate transferring member is set to be larger than the width of said latent image carrier.

9. An image forming apparatus comprising a latent image carrier, a writing means having a plurality of writing electrodes which are aligned in the axial direction of said latent image carrier and arranged in contact with or proximity to said latent image carrier to form an electrostatic latent image on said latent image carrier, a developing means for developing the electrostatic latent image on said latent image carrier, a transferring means for transferring a toner image obtained on said latent image carrier by the deploying to a recording medium fed by a recording medium feeding means, and a cleaning means which is arranged in contact with said recording medium feeding means to remove residual toner, being characterized in that at least the contact width of said cleaning means relative to said recording medium feeding means is set to be larger than the contact width of said writing means relative to said latent image carrier.

10. An image forming apparatus comprising a latent image carrier, a writing means having a plurality of writing electrodes which are aligned in the axial direction of said latent image carrier and arranged in contact with or proximity to said latent image carrier to form an electrostatic latent image on said latent image carrier, a transferring means for transferring a toner image obtained on said latent image carrier by the deploying to a recording medium fed by a recording medium feeding means, and a cleaning means which is arranged in contact with said recording medium feeding means to remove residual toner, being characterized in that at least the width of said latent image carrier is set to be larger than the width of said writing means and the contact width of said cleaning means relative to said recording medium feeding means is set to be larger than the width of said latent image carrier.

* * * * *